US010727019B2

(12) United States Patent
Yoneda et al.

(10) Patent No.: US 10,727,019 B2
(45) Date of Patent: Jul. 28, 2020

(54) FUSE DEVICE

(71) Applicant: DEXERIALS CORPORATION, Tokyo (JP)

(72) Inventors: Yoshihiro Yoneda, Tochigi (JP); Yuji Furuuchi, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 108 days.

(21) Appl. No.: 15/766,870

(22) PCT Filed: Oct. 5, 2016

(86) PCT No.: PCT/JP2016/079599

§ 371 (c)(1),
(2) Date: Apr. 9, 2018

(87) PCT Pub. No.: WO2017/061458

PCT Pub. Date: Apr. 13, 2017

(65) Prior Publication Data

US 2018/0294125 A1 Oct. 11, 2018

(30) Foreign Application Priority Data

Oct. 9, 2015 (JP) ..... 2015-201383
Jan. 13, 2016 (JP) ..... 2016-004691

(51) Int. Cl.
*H01H 85/175* (2006.01)
*H01H 85/11* (2006.01)
(Continued)

(52) U.S. Cl.
CPC ..... *H01H 85/11* (2013.01); *H01H 85/0056* (2013.01); *H01H 85/08* (2013.01);
(Continued)

(58) Field of Classification Search
CPC ..... H01H 85/0017; H01H 85/0056; H01H 85/006; H01H 85/06; H01H 85/08–12;
(Continued)

(56) References Cited

U.S. PATENT DOCUMENTS 4,357,588 A 11/1982 Leach et al.
8,081,057 B2 * 12/2011 Chiu ..... H01H 69/02 29/623
(Continued)

FOREIGN PATENT DOCUMENTS

CN 104185889 A 12/2014
JP S58-001942 A 1/1983
(Continued)

OTHER PUBLICATIONS

Aug. 23, 2019 Chinese Office Action issued in Chinese Patent Application No. 201680056025.0.
(Continued)

*Primary Examiner* — Jacob R Crum
(74) *Attorney, Agent, or Firm* — Oliff PLC

(57) ABSTRACT

A fuse device includes a fuse element and a cooling member, wherein the fuse element includes a low thermal conductivity portion having a relatively low thermal conductivity in which an interrupting portion that is blown out by heat is separated from the cooling member, and a high thermal conductivity portion having a relatively high thermal conductivity, provided in a portion other than the interrupting portion, and in contact with or close to the cooling member.

55 Claims, 48 Drawing Sheets

(51) Int. Cl.

| | |
|---|---|
| ***H01H 85/00*** | (2006.01) |
| ***H01H 85/17*** | (2006.01) |
| ***H01H 85/08*** | (2006.01) |
| *H01H 85/06* | (2006.01) |
| *H01H 85/041* | (2006.01) |

(52) U.S. Cl.
CPC ..... *H01H 85/17* (2013.01); *H01H 85/006* (2013.01); *H01H 85/0069* (2013.01); *H01H 85/06* (2013.01); *H01H 85/175* (2013.01); *H01H 2085/0414* (2013.01)

(58) Field of Classification Search
CPC ..... H01H 85/17; H01H 85/175; H01H 2085/0414
See application file for complete search history.

(56) References Cited

U.S. PATENT DOCUMENTS

| | | | | |
|---|---|---|---|---|
| 9,460,882 | B2 * | 10/2016 | Enriquez | H01H 85/08 |
| 10,008,356 | B2 | 6/2018 | Yoneda | |
| 2003/0142453 | A1 | 7/2003 | Parker et al. | |
| 2008/0191336 | A1 * | 8/2008 | Tsai | H01L 23/3121 257/682 |
| 2008/0191832 | A1 * | 8/2008 | Tsai | H01H 69/022 337/297 |
| 2009/0189730 | A1 * | 7/2009 | Oh | H01H 85/10 337/186 |
| 2015/0084734 | A1 | 3/2015 | Yoneda | |
| 2016/0013001 | A1 * | 1/2016 | Yoneda | H01H 85/11 337/227 |
| 2016/0111240 | A1 * | 4/2016 | Beckert | H01H 85/08 337/187 |
| 2016/0172143 | A1 | 6/2016 | Yoneda et al. | |
| 2016/0240342 | A1 * | 8/2016 | Yoneda | H01H 85/045 |

FOREIGN PATENT DOCUMENTS

| | | | |
|---|---|---|---|
| JP | S58-134853 | U | 9/1983 |
| JP | S62-193029 | A | 8/1987 |
| JP | H01-287905 | A | 11/1989 |
| JP | H08-236004 | A | 9/1996 |
| JP | 2003-263949 | A | 9/2003 |
| JP | 2004-152518 | A | 5/2004 |
| JP | 2005-026577 | A | 1/2005 |
| JP | 2013-229295 | A | 11/2013 |
| JP | 2014-209467 | A | 11/2014 |
| JP | 2015-111526 | A | 6/2015 |
| WO | 2015/030023 | A1 | 3/2015 |

OTHER PUBLICATIONS

Feb. 3, 2020 Office Action issued in Chinese Patent Application No. 201680056025.0.
Apr. 19, 2019 Korean Office Action issued in Korean Patent Application No. 10-2018-7007640.
Jan. 2, 2019 Chinese Office Action issued in Chinese Patent Application No. 201680056025.0.
Dec. 6, 2016 International Search Report issued in Patent Application No. PCT/JP2016/079599.
Jan. 7, 2020 Office Action issued in Japanese Patent Application No. 2016-004691.
Dec. 13, 2019 Office Action issued in Taiwanese Patent Application No. 105132137.

* cited by examiner

FUSE DEVICE

TECHNICAL FIELD

The present disclosure relates to a fuse device mounted on a current path and cutting off the current path by blowing, and more particularly to a fuse device which is reduced in size, reduced in resistance, and adapted for large current. This application claims priority to Japanese Patent Application No. 2015-201383 filed on Oct. 9, 2015 in Japan and Japanese Patent Application No. 2016-004691 filed on Jan. 13, 2016 in Japan, all of which are incorporated herein by reference.

BACKGROUND ART

Conventionally, a fuse element is blown by self-heating when a rate-exceeding current flows therethrough and is used to interrupt the electrical current path. Examples of often-used fuse elements include, for example, fuses fixed by a holder wherein solder is enclosed in glass, chip fuses wherein an Ag electrode is printed onto a ceramic substrate surface, and screw-in or insertion type fuses wherein part of a copper electrode is made thinner and assembled into a plastic case.

Unfortunately, problems have been identified in the aforementioned existing fuse elements such as surface mounting using reflow being impossible and current ratings being low.

Moreover, a hypothetical reflow-use fuse device having high-speed blowout properties would, in general, preferably use a high melting point Pb(lead)-containing solder having a melting point of more than 300° C. in the fuse element so as not to be blown by reflow heat and in view of blowout properties. However, use of solder containing Pb is limited with few exceptions under the RoHS directive and demand for a transition to Pb-free products is expected to increase.

Therefore, there is demanded a fuse element capable of surface mounting by reflow, excellent in mountability to a fuse device, and applicable to large currents by increasing the rating.

CITATION LIST

Patent Literature

PLT 1: Japanese Unexamined Patent Application Publication No. 2005-26577

SUMMARY OF INVENTION

Technical Problem

In order to meet such a demand, a fuse element using a metal having a high melting point and low resistance such as Cu has also been proposed. This type of fuse element is formed in a rectangular plate shape and has a structure in which the width in the longitudinal central portion is partially narrowed. Alternatively, a fuse element having a wire-like structure thinner than the electrode size as a whole has also been proposed. The narrowed portion having narrowed width of this type of fuse element serves as an interrupting portion having a high resistance to blow out by self-heating.

However, since a fuse element with a high melting point generates heat until reaching high temperatures at the time of blowout, if an electrode terminal connected to the fuse element is close to the interrupting portion, terminal temperature rises to near the melting point of high melting point metal and might cause problems such as melting connection solders for surface mounting. Therefore, it is necessary to increase the length of the fuse element and ensure the distance between the interrupting portion and the electrode terminal.

In addition, although decreasing length of a fuse element and increasing cross-sectional area of a fuse element are effective for reducing the resistance of the fuse element, it was difficult to further improve the current rating because of the effects of the heat of the fuse element at the time of blowout. Furthermore, increasing the length of the fuse element is problematic in view of reducing a fuse device in size using the fuse element.

It is therefore an object of the present disclosure to provide a fuse device capable of achieving high rating by reducing the resistance of a fuse element and achieving size reduction.

Solution to Problem

To solve the above problem, a fuse device according to the present disclosure includes a fuse element and a cooling member, wherein the fuse element includes a low thermal conductivity portion provided with a relatively low thermal conductivity in which an interrupting portion that is blown out by heat is separated from the cooling member, and a high thermal conductivity portion provided with a relatively high thermal conductivity, provided in a portion other than the interrupting portion, and in contact with or close to the cooling member.

Advantageous Effects of Invention

According to the present disclosure, thermally contacting the periphery of the interrupting portion of the fuse element with the cooling member can suppress temperature increase at the time of overcurrent of the fuse element, increase the rated current, suppress the effects on the terminal portion, and achieve size reduction.

DESCRIPTION OF EMBODIMENTS

Figure 1A:
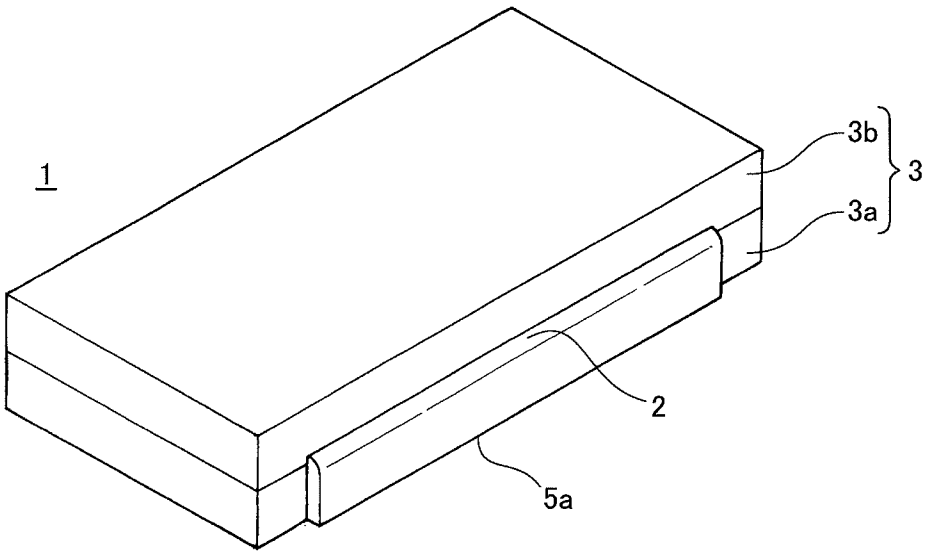
FIG. 1 is a view illustrating a fuse device according to the present disclosure, (A) being an external perspective view, and (B) being a cross-sectional view.

Hereinafter, a fuse device according to the present disclosure will be described in detail with reference to the drawings. It should be noted that the present disclosure is not limited to the embodiments described below and various modifications can be made without departing from the scope of the present disclosure. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

A fuse device 1 according to the present disclosure realizes a compact and highly rated fuse device, by having a small planar size of 3 to 5 mm×5 to 10 mm and a height of 2 to 5 mm, while having a resistance of 0.2 to 1 mil, and a high current rating of 50 to 150 A. It is a matter of course that the present disclosure can be applied to a fuse device having any size, resistance value, and current rating.

Figure 1B:
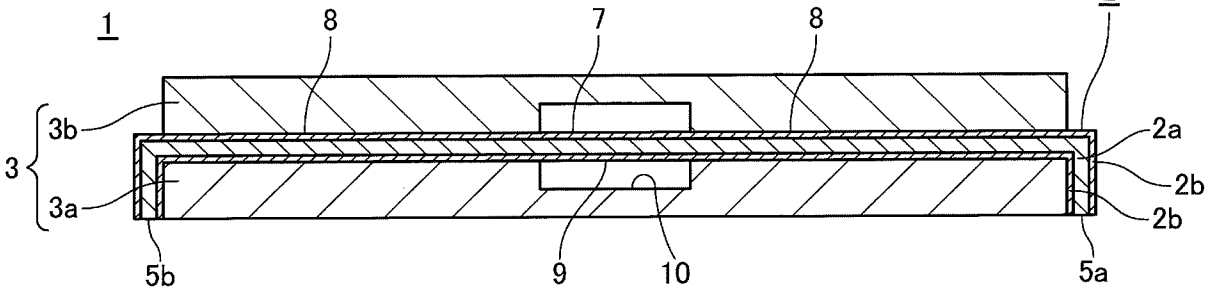

As shown in FIGS. 1 (A) and (B), the fuse device 1 includes a fuse element 2 and a cooling member 3; the fuse element 2 is connected on the current path of an external circuit and blown out due to self-heating (Joule heat) by a current exceeding the rating to interrupt the current path, and the cooling member 3 is in contact with or close to the fuse element 2.

Figure 2A:
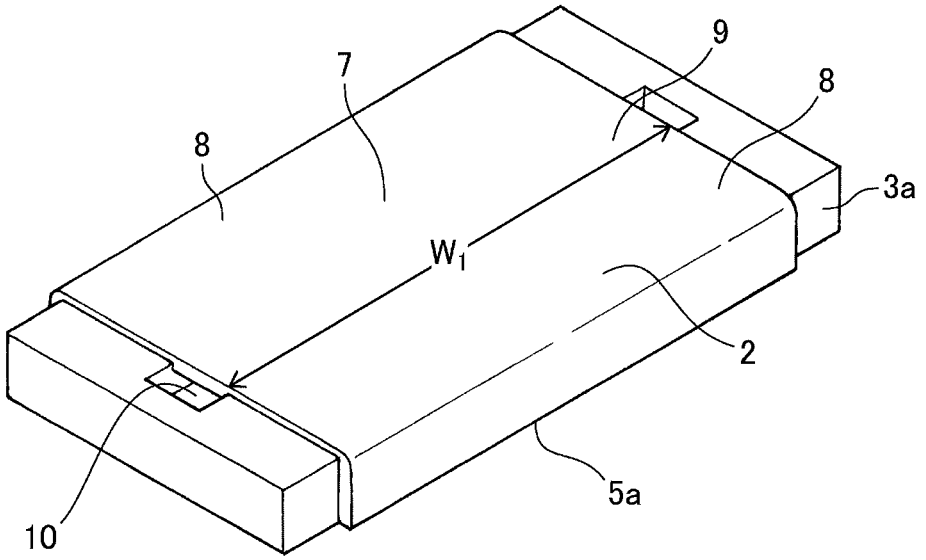
FIG. 2 (A) is an external perspective view illustrating a cooling member to which a fuse element is fitted, and FIG. 2 (B) is an external perspective view of the cooling member.
Figure 2B:
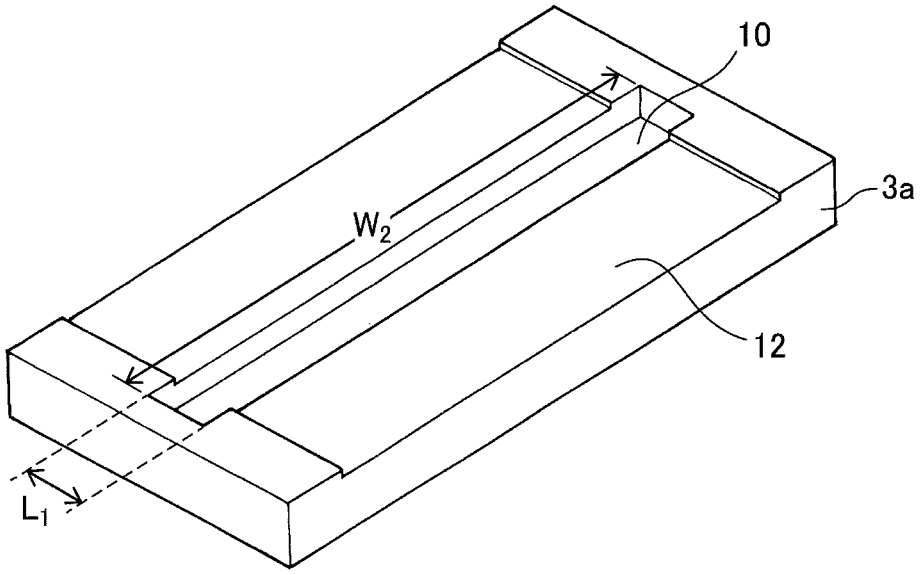

For example, as shown in FIG. 2 (A), the fuse element 2 is formed in a rectangular plate shape, and both end portions in the current direction are terminal portions 5*a*, 5*b* connected to connection electrodes of an external circuit (not shown). The fuse element 2 is sandwiched between a pair of upper and lower cooling members 3*a*, 3*b*, leads a pair of terminal portions 5*a*, 5*b* out of the cooling members 3*a*, 3*b*, and can be connected to the connection electrodes of the external circuit via the terminal portions 5*a*, 5*b*. The specific configuration of the fuse element 2 will be described in detail later.

In addition, in the fuse device 1, the pair of upper and lower cooling members 3*a*, 3*b* sandwiches the fuse element 2 to form a low thermal conductivity portion 7 separated from the cooling members 3*a*, 3*b* and having a relatively low thermal conductivity, and a high thermal conductivity portion 8 in contact with or close to the cooling members 3*a*, 3*b* and having a relatively high thermal conductivity in the fuse element 2. The cooling member 3 may be formed using an electrically insulating material having a high thermal conductivity such as ceramics and can be molded into an arbitrary shape by powder molding, for example. Furthermore, the cooling member 3 preferably has a thermal conductivity of 1 W/(m*K) or more. Although the cooling member 3 may be formed using a metal material, it is preferable to insulate the surface of the cooling member 3 in view of handling properties and preventing short circuits with surrounding parts. The pair of upper and lower cooling members 3*a*, 3*b* are coupled to each other by, for example, an adhesive, thereby forming a device housing.

The low thermal conductivity portion 7 refers to a portion which is provided along an interrupting portion 9 in which the fuse element 2 blows out along the width direction orthogonal to the current direction extending between the terminal portions 5*a*, 5*b* of the fuse element 2, at least a part of which is spaced apart from the cooling members 3*a*, 3*b* so as not to be in thermal contact with them, and the thermal conductivity of which is relatively low in the plane of the fuse element 2.

In addition, the high thermal conductivity portion 8 refers to a portion at least a part of which is in contact with or close to the cooling members 3*a*, 3*b* at portions other than the interrupting portion 9, and the thermal conductivity of which is relatively high in the plane of the fuse element 2. It is sufficient that the high thermal conductivity portion 8 is in thermal contact with the cooling member 3, and other than directly contacting the cooling member 3, it may be in contact via a member having thermal conductivity.

Figure 3A:
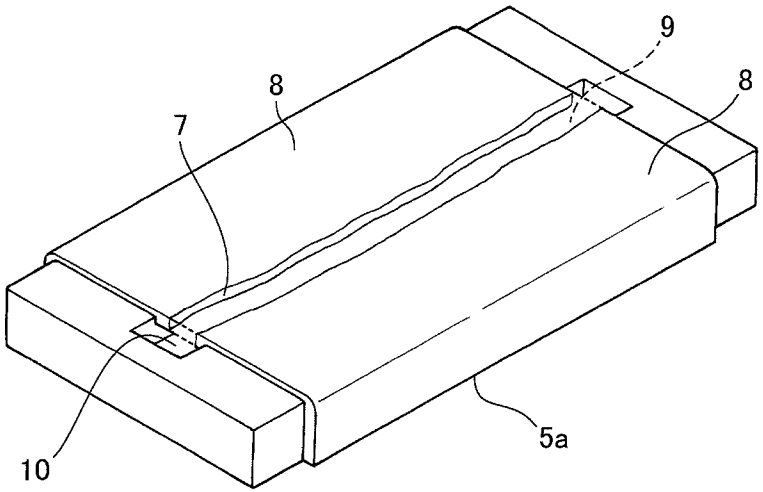
FIG. 3 (A) is an external perspective view illustrating a fuse element in which an interrupting portion is blown, and FIG. 3 (B) is a cross sectional view illustrating a device in which a fuse element is blown.
Figure 3B:
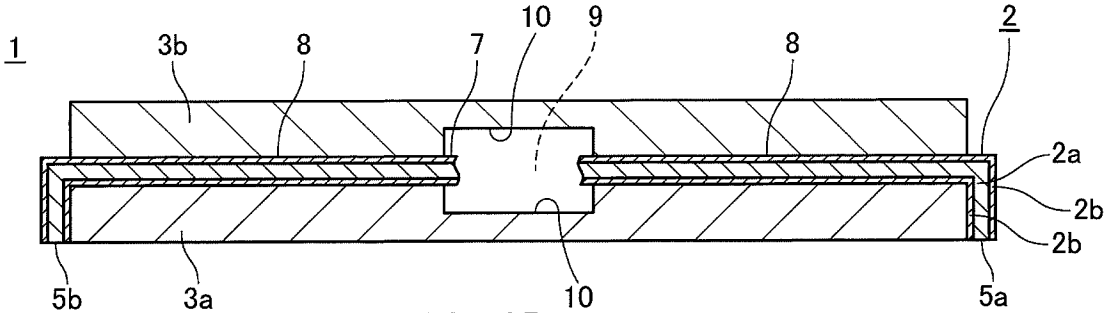

As shown in FIGS. 3 (A) and (B), in the plane of the fuse element 2, the low thermal conductivity portion 7 is provided along the interrupting portion 9, and the high thermal conductivity portion 8 is provided in a portion other than the interrupting portion 9; therefore, when the fuse element 2 generates heat during an overcurrent exceeding the rating, heat of the high thermal conductivity portion 8 is actively dissipated to the outside, and the fuse device 1 can suppress temperature increase in portions other than the interrupting portion 9 and concentrate heat on the low thermal conductivity portion 7 formed along the interrupting portion 9, to blow out the interrupting portion 9 while suppressing the effects of heat on the terminal portions 5*a*, 5*b*. As a result, the fuse device 1 blows out the portion between the terminal portions 5*a*, 5*b* of the fuse element 2 and interrupts the current path of the external circuit.

Therefore, the fuse device 1 can solve problems such as melting connection solder for surface mounting, thus realizing size reduction by forming the fuse element 2 into a rectangular plate shape, reducing the length in the current direction to decrease resistance, while improving the current rating to suppress overheating of the terminal portions 5*a*, 5*b* connected to the connection electrodes of the external circuit via connection solder.

It is preferable that the high thermal conductivity portion 8 of the fuse element 2 has an area larger than that of the low thermal conductivity portion 7. This enables the fuse element 2 to selectively heat and blow out the interrupting portion 9, actively dissipate heat from portions other than the interrupting portion 9, and suppress the effects of overheating of the terminal portions 5*a*, 5*b*, thus achieving size reduction and high rating.

Furthermore, as shown in FIG. 2 (B) in the fuse device 1, a groove 10 is formed in the cooling member 3 at a position corresponding to the interrupting portion 9, the cooling member 3 is in contact with or close to a portion other than the interrupting portion 9 of the fuse element 2, and the interrupting portion 9 is overlapped on the groove 10. The low thermal conductivity portion 7 is thus formed in the fuse device 1 by the interrupting portion 9 of the fuse element 2 being in contact with air, which is less thermally conductive than the cooling member 3.

In the fuse device 1, the fuse element 2 is sandwiched between a pair of upper and lower cooling members 3, so that both surfaces of the interrupting portion 9 overlaps with the grooves 10 (FIG. 1 (B)). This increases the difference in thermal conductivity between the interrupting portion 9 and the portions other than the interrupting portion 9, so as to reliably blow out the interrupting portion 9, improve the cooling efficiency of the high thermal conductivity portion 8, and suppress overheating of the terminal portions 5*a*, 5*b* due to temperature increase of the fuse element 2.

Figure 4A:
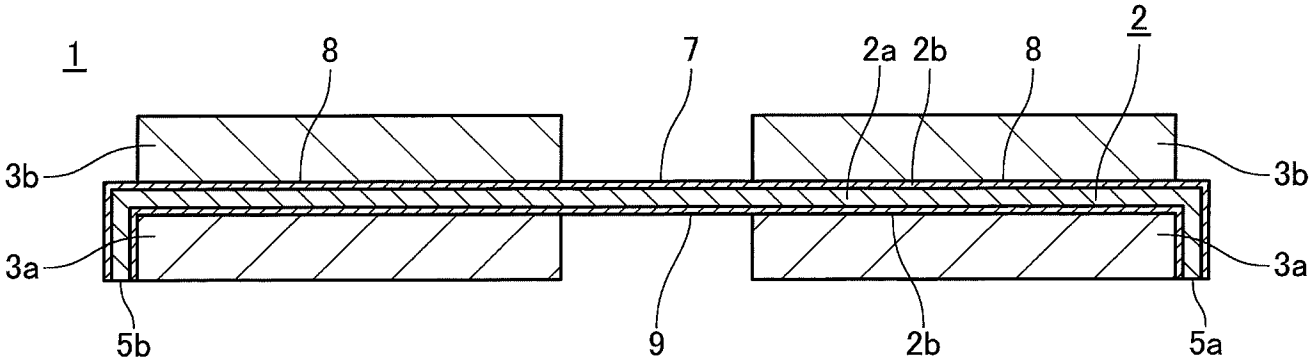
FIGS. 4 (A) and (B) are cross-sectional views illustrating another embodiment of a fuse device according to the present disclosure.
Figure 4B:
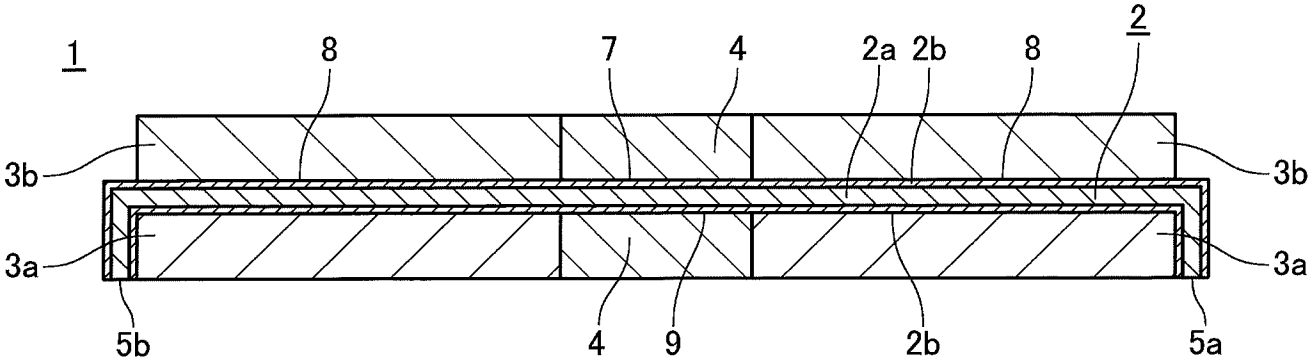

In the fuse device 1, as shown in FIG. 4 (A), by disposing and adhering the cooling members 3*a*, 3*b* on both sides of the interrupting portion 9, the interrupting portion 9 may be brought into contact with the air. In this case, in order to prevent the fuse element 2 from scattering at the time of blowout of the interrupting portion 9, it is preferable to provide a cover member at least covering the interrupting portion 9.

Figure 5:
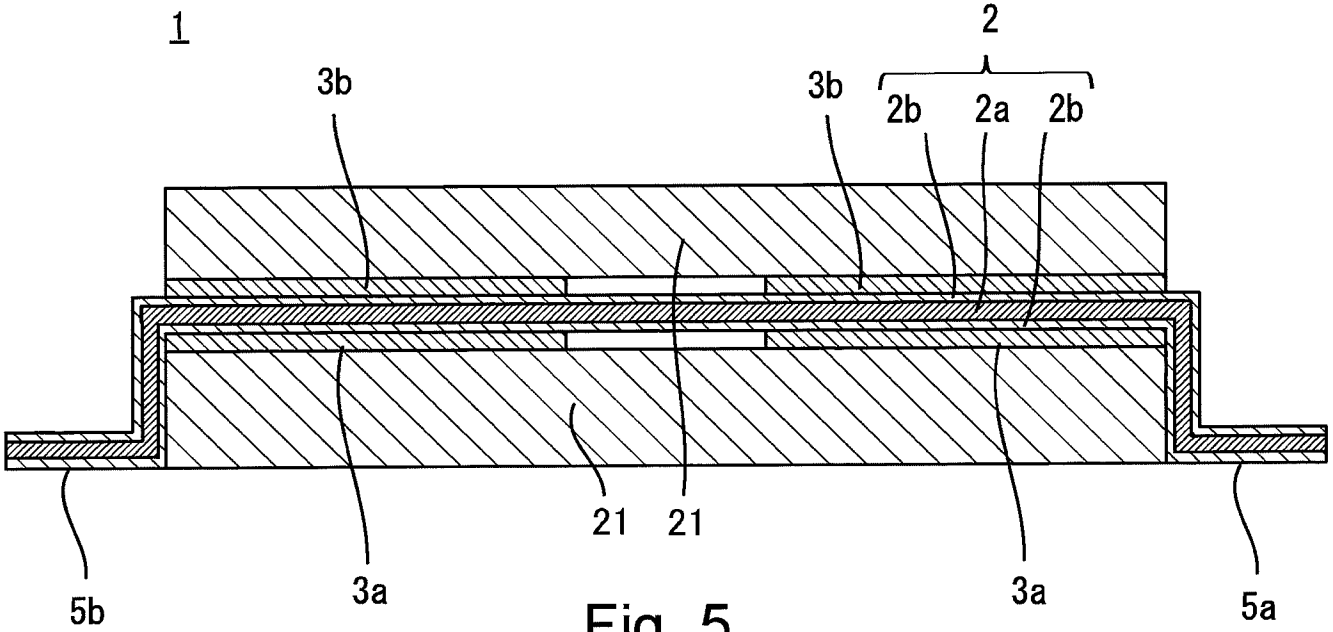
FIG. 5 is a cross-sectional view illustrating a fuse device in which a fuse element is sandwiched by supporting members formed with cooling members made of a metal material.

FIG. 5 is a cross-sectional view illustrating the fuse device 1 in which the cooling members 3*a*, 3*b* made of a metal material are arranged on both sides of the interrupting portion 9. The cooling members 3*a*, 3*b* made of a metal material are supported by a supporting member 21 made of an insulating material. The fuse device 1 is formed by sandwiching the fuse element 2 with the supporting member 21 provided with the cooling members 3*a*, 3*b*. As the supporting member 21, known insulating materials such as engineering plastics, ceramic substrates, and glass epoxy substrates can be used.

As shown in FIG. 5, for example, the cooling members 3*a*, 3*b* are formed in a region excluding positions overlapping the interrupting portion 9 of the fuse element 2 and is provided separately on both sides of the interrupting portion 9 provided across the width direction of the fuse element 2. In the fuse device 1, the fuse element 2 is sandwiched by the supporting members 21 via the cooling members 3*a*, 3*b* made of a metal material, such that the interrupting portion 9 of the fuse element 2 is separated from the cooling members 3*a*, 3*b* and acts as the low thermal conductivity portion 7 having a relatively low thermal conductivity, and both sides of the interrupting portion 9 are in contact with or close to the cooling members 3*a*, 3*b* and serve as the high thermal conductivity portion 8 having a relatively high thermal conductivity. It should be noted that the metal material layer constituting the cooling members 3*a*, 3*b* has an adequate thickness for sufficiently separating the interrupting portion 9 from the supporting member 21, and for reliably blowing out the interrupting portion 9 by providing a difference in thermal conductivity between the interrupting portion 9 and a portion other than the interrupting portion 9. The thickness of the metal material layer is preferably 100 or more.

A conductive adhesive 15 or a solder 96 may be interposed as appropriate between the metal material layer constituting the cooling members 3*a*, 3*b* and the fuse element 2. Connecting the cooling members 3*a*, 3*b* and the high thermal conductivity portion 8 of the fuse element 2 via the adhesive 15 or the solder 96 can enhance close fitting for more efficient heat transfer to the cooling members 3*a*, 3*b* in the fuse device 1.

Since the fuse device 1 shown in FIG. 5 uses a plate-like fuse element 2 and is formed by sandwiching the fuse element 2 with the supporting member 21 having the cooling members 3*a*, 3*b* made of a metal material layer formed thereon, machining of concaves or grooves is unnecessary, thereby facilitating the manufacturing process. In the plane of the fuse element 2, the low thermal conductivity portion 7 is provided along the interrupting portion 9, and the high thermal conductivity portion 8 is provided in a portion other than the interrupting portion 9; therefore, when the fuse element 2 generates heat at an overcurrent exceeding the rating, the heat of the high thermal conductivity portion 8 is actively dissipated to the outside via the cooling members 3*a*, 3*b* made of a metal material layer, the fuse device 1 can suppress temperature increase in portions other than the interrupting portion 9 and concentrate heat on the low thermal conductivity portion 7 formed along the interrupting portion 9 to blow out the interrupting portion 9 and interrupt the current path of the external circuit.

In the fuse device 1, although it is preferable that the cooling members 3*a*, 3*b* made of a metal material are formed on both sides of the interrupting portion 9 on both faces of the fuse element 2 as shown in FIG. 5, the difference in thermal conductivity can be provided between the interrupting portion 9 and the portions other than the interrupting portion 9 as long as at least one face of the fuse element 2 is provided with the cooling member 3*a* or the cooling member 3*b* on both sides of the interrupting portion 9.

Furthermore, as shown in FIG. 4 (B), the fuse device may include a heat insulating member 4 having a thermal conductivity lower than that of the cooling members 3*a*, 3*b*, such that the interrupting portion 9 of the fuse element 2 comes into contact with or comes close to the heat insulating member 4 to form the low thermal conductivity portion 7 having a thermal conductivity relatively lower than that of the high thermal conductivity portion 8. It should be noted that the heat insulating member 4 may be disposed in the groove 10 of the cooling members 3*a*, 3*b* shown in FIG. 1 so as to be in contact with or close to the interrupting portion 9.

Figure 6:
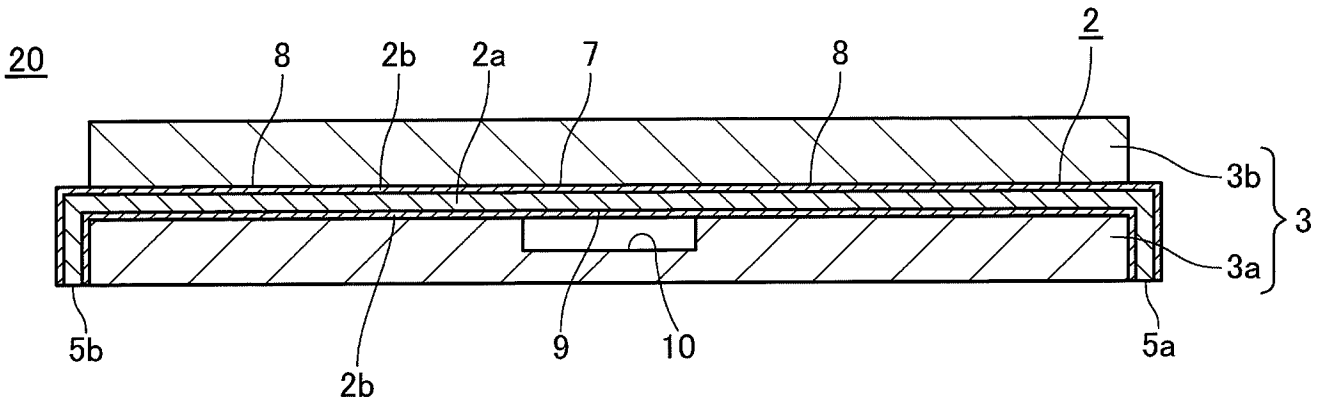
FIG. 6 is a cross-sectional view illustrating another embodiment of a fuse device according to the present disclosure.

As shown in FIG. 6, in the fuse device, a groove 10 may be formed at a position corresponding to the interrupting portion 9 in one of the cooling members 3*a* of the pair of upper and lower cooling members 3 sandwiching the fuse element 2, the groove 10 being disposed on the interrupting portion 9 and being brought into contact with or close to a portion other than the interrupting portion 9, and the other cooling member 3*b* being not provided with the groove 10 and being brought into contact with or close to the interrupting portion 9 of the fuse element 2 and a portion other than the interrupting portion 9.

Also in a fuse device 20 shown in FIG. 6, a difference in thermal conductivity is provided between the interrupting portion 9 and a portion other than the interrupting portion 9, the low thermal conductivity portion 7 is provided along the interrupting portion 9 in the plane of the fuse element 2, and the high thermal conductivity portion 8 is formed in a portion other than the interrupting portion 9. In this way, the fuse device 20 actively dissipates the heat of the high thermal conductivity portion 8 to the outside when the fuse element 2 generates heat at an overcurrent exceeding the rating, thereby suppressing temperature increase in portions other than the interrupting portion 9 and concentrating heat on the low thermal conductivity portion 7 formed along the interrupting portion 9 to blow out the interrupting portion 9.

It should be noted that the fuse device may be constituted such that one surface of the cooling member 3 overlaps the fuse element 2, and the other surface is covered with a cover member 13. In the fuse device 30 shown in FIG. 7, the cooling member 3 having the groove 10 is brought into contact with or close to the lower surface of the fuse element 2, and the upper surface thereof is covered with the cover member 13. In the cooling member 3, the groove 10 is overlapped with the interrupting portion 9 of the fuse element 2, and the cooling member 3 is in contact with or close to a portion other than the interrupting portion 9.

Figure 7:
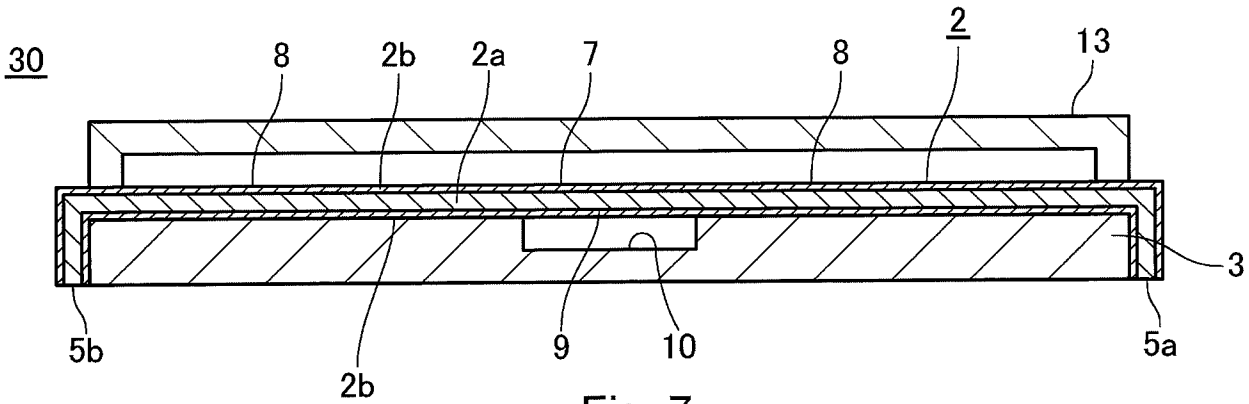
FIG. 7 is a cross-sectional view illustrating another embodiment of a fuse device according to the present disclosure.

In the fuse device 30 shown in FIG. 7, a difference in thermal conductivity is provided between the interrupting portion 9 and a portion other than the interrupting portion 9, the low thermal conductivity portion 7 is provided along the interrupting portion 9 in the plane of the fuse element 2, and the high thermal conductivity portion 8 is formed in a portion other than the interrupting portion 9. In this way, the fuse device actively dissipates the heat of the high thermal conductivity portion 8 to the outside when the fuse element 2 generates heat at an overcurrent exceeding the rating, thereby suppressing temperature increase in portions other than the interrupting portion 9 and concentrating heat on the low thermal conductivity portion 7 formed along the interrupting portion 9 to blow out the interrupting portion 9.

By leading out the terminal portions 5*a*, 5*b* of the fuse device 30 and disposing the cooling member 3 on the mounting surface to be mounted on the circuit board on which the external circuit is formed, the heat of the fuse element 2 can be transmitted to the circuit board side, thereby achieving more efficient cooling.

In the fuse device 30, the cooling member 3 may be disposed on the opposite surface of the mounting surface to the circuit board, and the cover member 13 may be disposed on the mounting surface from which the terminal portions 5*a*, 5*b* are led out. In this case, since the terminal portions 5*a*, 5*b* are in contact with the side surface of the cover member 13, the transmission of heat to the terminal portions 5*a*, 5*b* via the cooling member 3 is suppressed, thereby further reducing the risk of melting connection solder for surface mounting.

Furthermore, as shown in FIG. 2 (B), the fuse device 1 is provided with a fitting recess 12 for fitting the fuse element 2 on the surface of the cooling member 3 that holds the fuse element 2. The fitting recess 12 has a depth such that it is in contact with or close to both sides of the fuse element 2 when the pair of upper and lower cooling members 3*a*, 3*b* sandwiches the fuse element 2, with both ends open so that the terminal portions 5*a*, 5*b* can be led to the outside. Then, as shown in FIGS. 1 (A) and (B), when the pair of upper and lower cooling members 3 are brought into contact with each other, the fuse device 1 is sealed except for the openings from which the terminal portions 5*a*, 5*b* are led out, and each of the fitting recesses 12 of the pair of upper and lower cooling members 3 is in contact with or close to the surface of the fuse element 2.

Figure 8B:
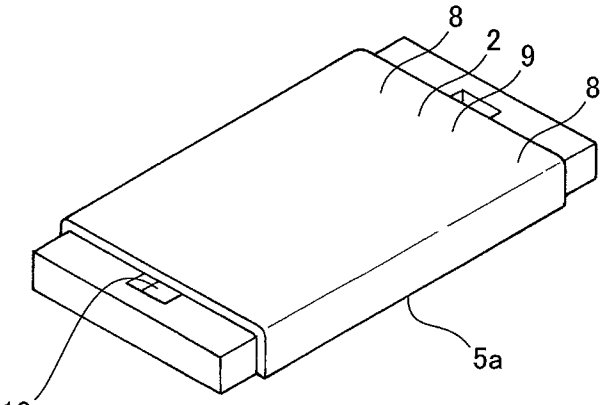
FIG. 8 is a view illustrating another embodiment of a fuse device according to the present disclosure, (A) being an external perspective view of a cooling member, (B) being an external perspective view illustrating a cooling member to which a fuse element is fitted, and (C) being an external perspective view of the fuse device.
Figure 8C:
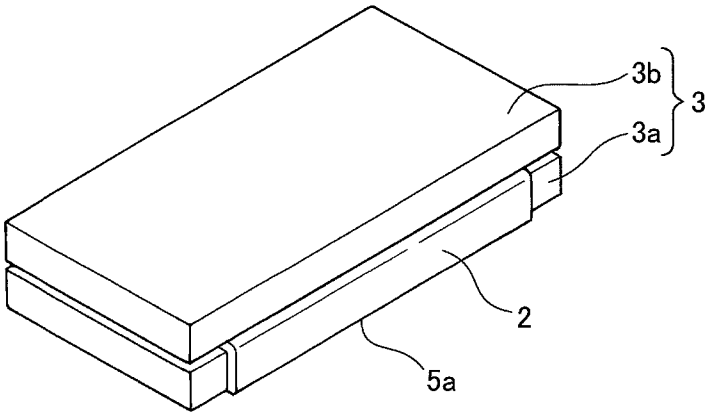
Figure 8A:
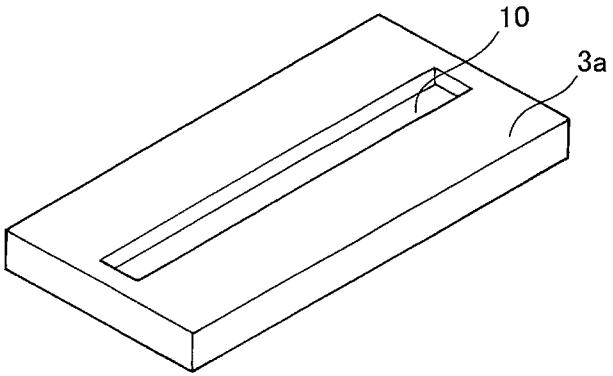

It should be noted that the configuration of the fuse device 1 described below can also be applied to the fuse devices 20 and 30 described above. As shown in FIGS. 8 (A) to (C), the fuse device 1 does not need to be provided with the fitting recess 12 in at least one of the cooling members 3. In this case, when the fuse element 2 of the fuse device 1 is sandwiched between the pair of cooling members 3, a gap is formed by the fuse element 2, thereby enabling discharge of gas vaporized by the element material generated at the time of blowout of the fuse element 2 to the outside. Therefore, the fuse device 1 can prevent the housing from being destroyed by an increase in internal pressure due to gas generation.

Groove

Furthermore, in the fuse device 1, the groove 10 is formed continuously in the width direction of the interrupting portion 9 orthogonal to the current direction of the fuse element 2. In this case, as shown in FIG. 2, the groove 10 of the fuse device 1 has a width $W_2$ greater than a width $W_1$ of the fuse element 2 to form the low thermal conductivity portion 7 over the entire width of the interrupting portion 9 of the fuse element 2. Therefore, in the fuse device 1, the interrupting portion 9 can be heated and blown over the entire width.

Figure 9:
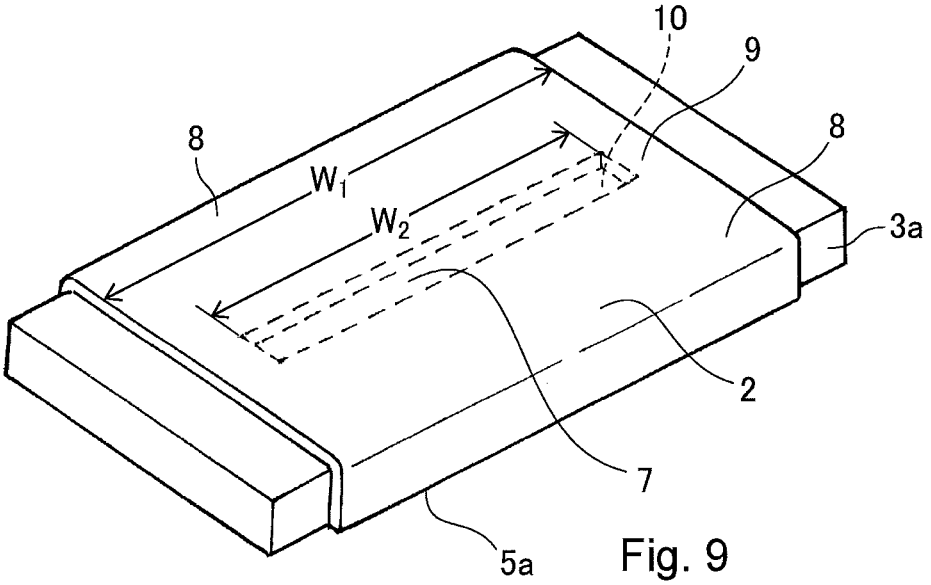
FIG. 9 is an external perspective view illustrating a cooling member in which a groove shorter than the width of an interrupting portion of a fuse element is formed.

It should be noted that, as shown in FIG. 9, the low thermal conductivity portion 7 of the fuse device 1 may be formed over a part in the length direction of the interrupting portion 9, with the width $W_2$ of the groove 10 being less than the width $W_1$ of the fuse element 2. Alternatively, as shown in FIG. 10, in the fuse device 1, the low thermal conductivity portion 7 may be formed intermittently over the length direction of the interrupting portion 9 by intermittently forming a plurality of grooves 10 across the width direction of the fuse element 2.

Figure 10:
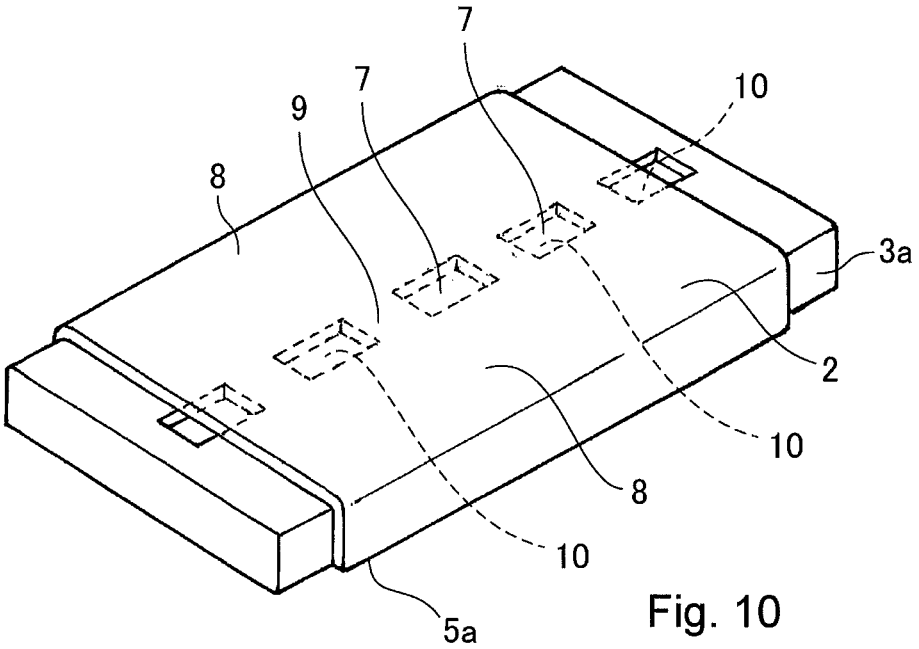
FIG. 10 is an external perspective view illustrating a cooling member in which grooves are intermittently formed along an interrupting portion of a fuse element.

Even in the case where the low thermal conductivity portion 7 is provided in a part of the interrupting portion 9 as shown in FIGS. 9 and 10, when the fuse element 2 generates heat at an overcurrent exceeding the rating, the interrupting portion 9 is heated and melted from the low thermal conductivity portion 7, and the interrupting portion 9 can be blown out and interrupt the entire width of the interrupting portion 9, the blowout being triggered by the melting of the low thermal conductivity portion(s) 7.

In the case of using the fuse element 2 in the form of a rectangular plate as shown in FIG. 2, a length $L_1$ of the groove 10 formed in the cooling member 3 in the current direction of the fuse element 2 is preferably equal to or less than the minimum width in the interrupting portion 9 of the fuse element 2, and more preferably ½ or less of the minimum width of the interrupting portion 9 of the fuse element 2.

The minimum width in the interrupting portion 9 means the minimum width in the width direction orthogonal to the current direction of the interrupting portion 9 of the fuse element 2 on the surface of the rectangular plate-like fuse element, and corresponds to the minimum width of the interrupting portion 9 when the interrupting portion 9 has a shape such as an arc shape, a taper shape, and a stepped shape, among others, and is formed to be narrower than the portion other than the interrupting portion 9, or corresponds to the width $W_1$ of the fuse element 2 when the interrupting portion 9 is formed with the same width as the portion other than the interrupting portion 9 as shown in FIG. 2 (A).

By reducing the length $L_1$ of the groove 10 to be equal to or smaller than the minimum width of the interrupting portion 9 or not more than ½ of the minimum width of the interrupting portion 9, the fuse device 1 can suppress occurrence of arc discharge at the time of blowout and improve the insulation resistance.

Rod-Like Fuse Element

In addition, a rod-like fuse element may be used in the fuse device. For example, the fuse device 40 shown in FIGS. 11 (A) and (B) has a columnar fuse element 41, a pair of terminal pieces 42*a*, 42*b* provided at both ends of the fuse element 41, and a pair of upper and lower cooling members 3*a*, 3*b* sandwiching the fuse element 41. In the fuse device 40, the cooling members 3*a*, 3*b* are fitted between the terminal pieces 42*a*, 42*b* to be flush with the terminal pieces 42*a*, 42*b*, and the cooling members 3*a*, 3*b* and the terminal pieces 42*a*, 42*b* form a device housing.

In the fuse device 40, a groove 10 is formed at a position corresponding to the interrupting portion 9 of the fuse element 41 in the pair of upper and lower cooling members 3*a*, 3*b*, and the fuse element 41 is sandwiched, such that a low thermal conductivity portion 7 which is separated from the cooling members 3*a*, 3*b* and has relatively low thermal conductivity, and a high thermal conductivity portion 8 which is in contact with or close to the cooling members 3*a*, 3*b* and has a relatively high thermal conductivity are formed in the fuse element 41.

Figure 11A:
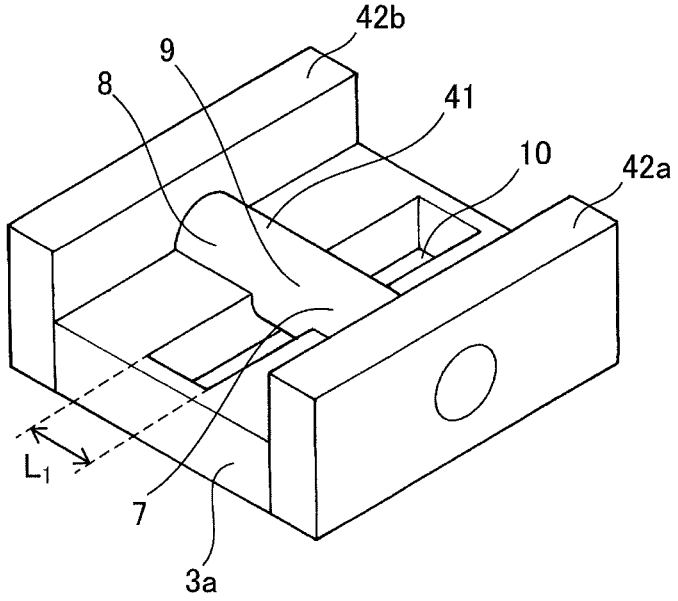
FIG. 11 (A) is an external perspective view of a cooling member in which a columnar fuse element is disposed, and FIG. 11 (B) is an external perspective view of a fuse device using the columnar fuse element.
Figure 11B:
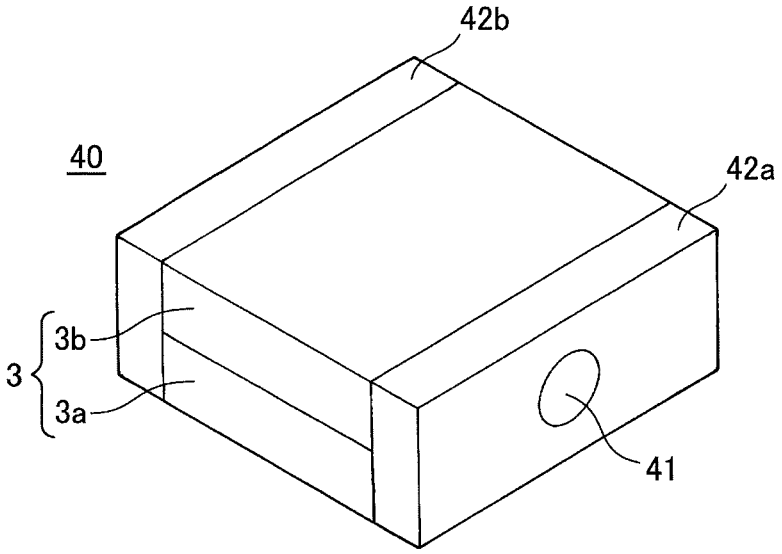

In the fuse device 40, it is preferable that the length $L_1$ of the groove 10 formed in the cooling member 3 in the current direction of the fuse element 41 is not more than twice the minimum diameter of the interrupting portion 9 of the fuse element 2. The minimum diameter in the interrupting portion 9 means the minimum diameter in the width direction orthogonal to the current direction of the interrupting portion 9 of the fuse element 41, and corresponds to the minimum diameter of the interrupting portion 9 when the interrupting portion 9 has a conical shape in which the diameter decreases gradually toward the center or a shape in which small diameter cylinders are continuous through steps and is formed with a smaller diameter than a portion other than the interrupting portion 9, or corresponds to the diameter of the fuse element 41 when the interrupting portion 9 is formed with the same diameter as the portion other than the interrupting portion 9 as shown in FIG. 11 (A).

By limiting the length $L_1$ of the groove 10 to not more than twice the minimum diameter of the fuse element 41 in the interrupting portion 9, the fuse device 40 can suppress occurrence of arc discharge at the time of blowout and improve insulation resistance.

Furthermore, in the fuse devices 1, 40 described above, it is preferable that the length $L_1$ of the groove 10 formed in the cooling member 3 in the current direction of the fuse elements 2, 41 is 0.5 mm or more. By providing a low thermal conductivity portion 7 having a length of 0.5 mm or more, the fuse devices 1, 40 can form a temperature difference with the high thermal conductivity portion 8 at the time of overcurrent, thereby selectively blowing out the interrupting portion 9.

Furthermore, in the fuse devices 1, 40 described above, it is preferable that the length $L_1$ of the groove 10 formed in the cooling member 3 in the current direction of the fuse elements 2, 41 is 5 mm or less. In the fuse devices 1, 40, the length $L_1$ of the groove 10 exceeding 5 mm increases the area of the interrupting portion 9 and correspondingly extends the time required for blowing, thus degrading rapid blowout properties, as well as increases the amount of scattering of the fuse elements 2, 41 due to arc discharge, possibly resulting in insulation resistance being lowered by melted metal adhering to the surroundings.

In the above fuse devices 1, 40, it is preferable that the minimum gap between the high thermal conductivity portion 8 of the adjacent fuse elements 2, 41 and the cooling members 3*a*, 3*b* is 100 μm or less. As described above, the fuse elements 2, 41 are sandwiched between the cooling members 3*a*, 3*b*, so that a portion in contact with or close to the cooling members 3*a*, 3*b* serves as the high thermal conductivity portion 8. In this case, by setting the minimum gap between the high thermal conductivity portion 8 of the fuse elements 2, 41 and the cooling members 3*a*, 3*b* to 100 μm or less, the portions of the fuse elements 2, 41 other than the interrupting portion 9 and the cooling member 3 can be brought into close contact with each other, thereby transmitting heat generated at an overcurrent exceeding the rating to the outside via the cooling member 3, and selectively blowing out only the interrupting portion 9. In contrast, when the minimum gap between the high thermal conductivity portion 8 of the fuse elements 2, 41 and the cooling members 3*a*, 3*b* exceeds 100 μm, the thermal conductivities of these portions decrease, and unexpected portions other than the interrupting portion 9 may be over-heated and melt at an overcurrent exceeding the rating.

Parallel Arrangement of Fuse Element

Figure 12A:
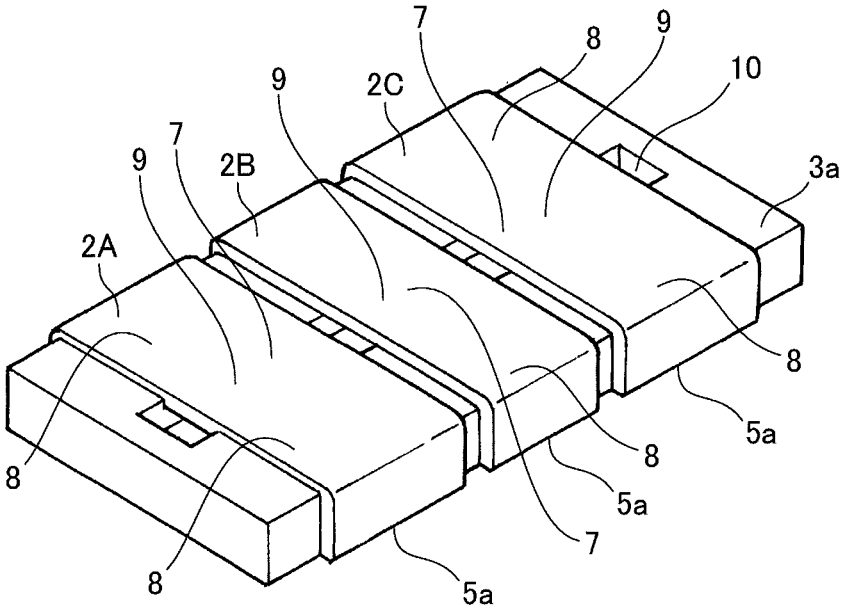
FIG. 12 (A) is an external perspective view illustrating a cooling member in which three fuse elements are arranged in parallel, and FIG. 12 (B) is an external perspective view of a fuse device in which three fuse elements are arranged in parallel.
Figure 12B:
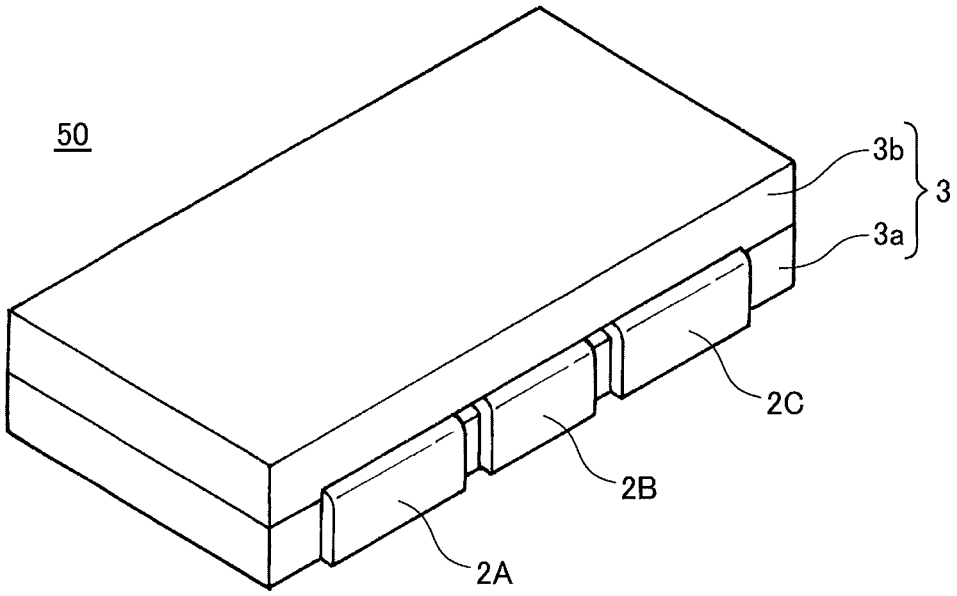

The fuse device may include, as the fuse element, a plurality of fuse elements 2 connected in parallel. As shown in FIGS. 12 (A) and (B), in the fuse device 50, for example, three pieces of fuse elements 2A, 2B, and 2C are arranged in parallel on the cooling member 3*a*. The fuse elements 2A to 2C are formed in a rectangular plate shape, and terminal portions 5*a*, 5*b* are formed by bending both ends. The fuse elements 2A to 2C are connected in parallel by connecting the respective terminal portions 5*a*, 5*b* to a common connection electrode of an external circuit. As a result, the fuse device 50 has a current rating equivalent to that of the above-described fuse device 1 using one fuse element 2. Each of the fuse elements 2A to 2C is arranged in parallel at a sufficient distance to not contact an adjacent fuse element at the time of blowout.

As shown in FIG. 12 (A), in the fuse elements 2A to 2C, the interrupting portion 9 which interrupts the current path extending between the terminal portions 5*a*, 5*b* overlaps the groove 10 formed in the cooling member 3*a*, such that a low thermal conductivity portion 7 is provided along the interrupting portion 9, and the high thermal conductivity portion 8 is formed in a portion other than the interrupting portion 9 in the plane of the element. When overcurrent exceeding the rating generates heat, the fuse elements 2A to 2C actively dissipate the heat of the high thermal conductivity portion 8 to the outside via the cooling member 3, thereby suppressing temperature increase in portions other than the interrupting portion 9 and concentrating heat on the low thermal conductivity portion 7 formed along the interrupting portion 9 to blow out the interrupting portion 9.

At this time, the fuse elements 2A to 2C are sequentially blown out from one having a lower resistance value through which a larger amount of current flows. The fuse device 50 interrupts the current path of the external circuit by blowing out all the fuse elements 2A to 2C.

In addition, even when a current exceeding the rating flows through the fuse elements 2A to 2C and an arc discharge occurs at the time of blowout, the fuse device 50 can prevent melted fuse element from scattering over a wide range to form a new current path by scattered metal or can prevent scattered metal from adhering to terminals and surrounding electronic components, among others.

In particular, since the fuse elements 2A to 2C are arranged in parallel in the fuse device 50, when a current exceeds the rating, a large amount of current flows through the first fuse element 2 having a lowest resistance value and they are sequentially blown out by self-heating, such that an arc discharge occurs only when the last fuse element 2 is blown out. Therefore, according to the fuse device 50, even when an arc discharge occurs at the time of blowout of the finally remaining fuse element 2, the arc discharge is reduced in size in accordance with the volume of the fuse element 2, thereby preventing explosive scattering of melted metal to significantly improve insulation properties after blowout. Furthermore, since the fuse device 50 blows out the plurality of fuse elements 2A to 2C one by one, the thermal energy required for blowing out each fuse element can be reduced, thereby achieving rapid interruption.

In addition, the fuse device 50 may control the blowout sequence by making the width of the interrupting portion 9 of one of the plurality of fuse element 2 narrower than the width of the interrupting portion 9 of the other fuse element. Furthermore, it is preferable that three or more fuse elements 2 are arranged in parallel in the fuse device 50, and the width of at least one fuse element 2 other than the both sides of the parallel arrangement is narrower than the width of the other fuse elements.

For example, in the fuse device 50, a part or the whole of width of the middle fuse element 2B among the fuse elements 2A to 2C is made narrower than the widths of the other fuse elements 2A and 2C to provide a difference in cross-sectional area, thereby relatively increasing the resistance of the fuse element 2B. As a result, when a current exceeding the rating flows, the fuse elements 2A and 2C having relatively low resistance receive a large portion of the current and are blown out first in the fuse device 50. Since the blowout of these fuse elements 2A and 2C is not accompanied by arc discharge due to self-heating, there is no explosive scattering of melted metal. Thereafter, current concentrates on the remaining high-resistance fuse element 2B, and finally blows it out accompanied by arc discharge. As a result, the fuse device 50 can sequentially blow out the fuse elements 2A to 2C. In the fuse elements 2A to 2C, since the scale of arc discharge occurring upon the blowout of the fuse element 2B with a small sectional area is limited in accordance with the volume of the fuse element 2B, explosive scattering of melted metal can be prevented.

Furthermore, in the fuse device 50, by finally blowing out the fuse element 2B disposed in an inner position, even if an arc discharge occurs, the melted metal of the fuse element 2B can be trapped by the precedingly blown out fuse elements 2A and 2C disposed in an outer position. This suppresses scattering of the melted metal of the fuse element 2B and prevents short circuits, among other problems, caused by the melted metal.

High Melting Point Fuse Element

Figure 13A:
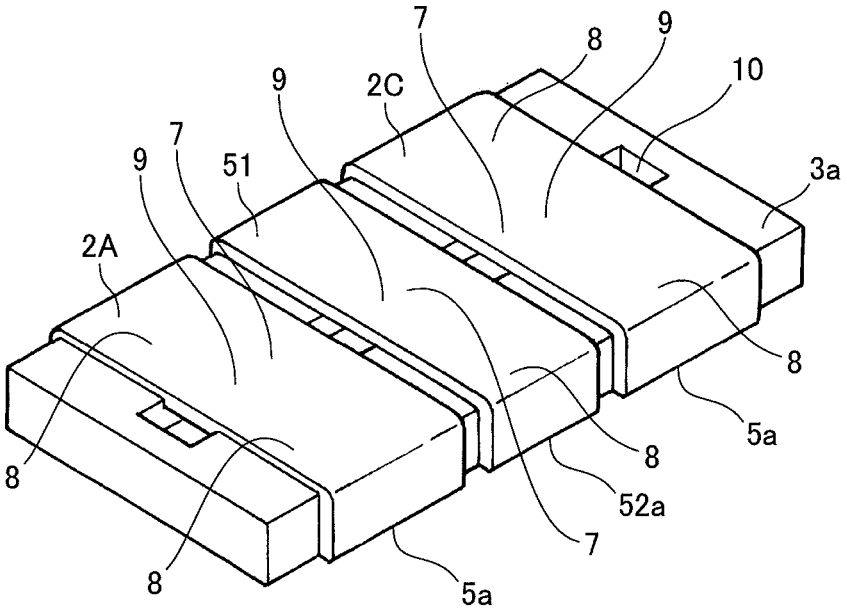
FIG. 13 (A) is an external perspective view illustrating a cooling member in which a high melting point fuse element is arranged in parallel between fuse elements, and FIG. 13 (B) is an external perspective view of a fuse device in which a high melting point fuse element is arranged in parallel between fuse elements.
Figure 13B:
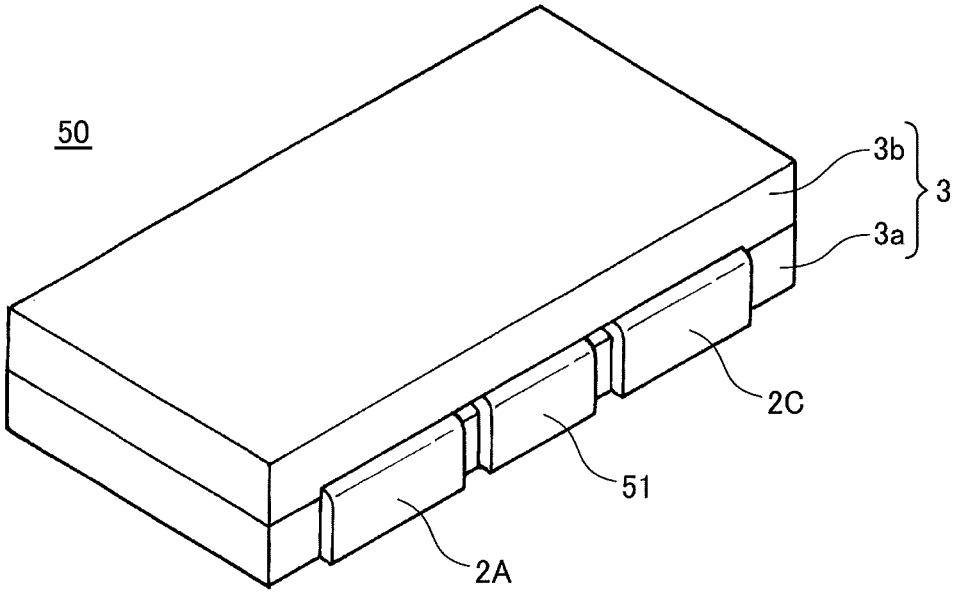

Furthermore, the fuse device 50 may include a high melting point fuse element 51 having a melting temperature higher than that of the fuse element 2, and a plurality of the fuse elements 2 and the high melting point fuse element 51 may be disposed at a predetermined interval. As shown in FIG. 13, for example, in the fuse device 50, three pieces of the fuse elements 2A, 2C and the high melting point fuse element 51 are arranged in parallel in the cooling member 3.

The high melting point fuse element 51 can be formed using a high melting point metal such as Ag or Cu, or an alloy containing any of these as a primary constituent. In addition, the high melting point fuse element 51 may be composed of a low melting point metal and a high melting point metal as described later. The high melting point fuse element 51 is formed in a substantially rectangular plate shape which is the same as the fuse element 2, and terminal portions 52*a*, 52*b* are bent at both end portions, these terminal portions 52*a*, 52*b*, together with the terminal portions 5*a*, 5*b* of the fuse element 2 being connected to the common connection electrode of the external circuit, thus being connected in parallel with the fuse element 2. As a result, the fuse device 50 has a current rating equal to or higher than that of the above-described fuse device 1 using one fuse element 2. It should be noted that the fuse elements 2A, 2C and the high melting point fuse element 51 are arranged in parallel at a sufficient distance to not contact an adjacent fuse element at the time of blowout.

As shown in FIG. 13, as in the fuse elements 2A and 2C, in the high melting point fuse element 51, the interrupting portion 9 which interrupts the current path extending between the terminal portions 52*a*, 52*b* overlaps with the groove 10 formed in the cooling member 3, such that a low thermal conductivity portion 7 is provided along the interrupting portion 9, and the high thermal conductivity portion 8 is formed in a portion other than the interrupting portion 9 in the plane of the element. When the high melting point fuse element 51 generates heat at an overcurrent exceeding the rating, the high melting point fuse element 51 actively dissipates the heat of the high thermal conductivity portion 8 to the outside, thereby suppressing temperature increase in portions other than the interrupting portion 9 and concentrating heat on the low thermal conductivity portion 7 formed along the interrupting portion 9 to blow out the interrupting portion 9.

In the fuse device 50 shown in FIG. 13, the fuse elements 2A, 2C having a low melting point are blown out first at an overcurrent exceeding the rating, and the high melting point fuse element 51 having a high melting point is blown out last. Therefore, the high melting point fuse element 51 can be interrupted in a short time in accordance with its volume, in addition, even when an arc discharge occurs at the time of blowout of the finally remaining high melting point fuse element 51, the arc discharge is reduced in size in accordance with the volume of the high melting point fuse element 51, thereby preventing explosive scattering of melted metal to significantly improve the insulation properties after blowout. The fuse device 50 interrupts the current path of the external circuit by blowing out all the fuse elements 2A, 2C and the high melting point fuse element 51.

It is preferable that the high melting point fuse element 51 is disposed in a location other than both sides of the parallel arrangement in parallel with the fuse element 2. For example, as shown in FIG. 13, the high melting point fuse element 51 is preferably disposed between the two fuse elements 2A, 2C.

By finally blowing out the high melting point fuse element 51 disposed in an inner position, even if an arc discharge occurs, the melted metal of the high melting point fuse element 51 can be trapped by the precedingly blown out fuse elements 2A, 2C disposed in the outer sides and it is possible to suppress scattering of the melted metal of the high melting point fuse element 51 and to prevent short circuits, among other problems, caused by the melted metal.

Metal Layer

Figure 14:
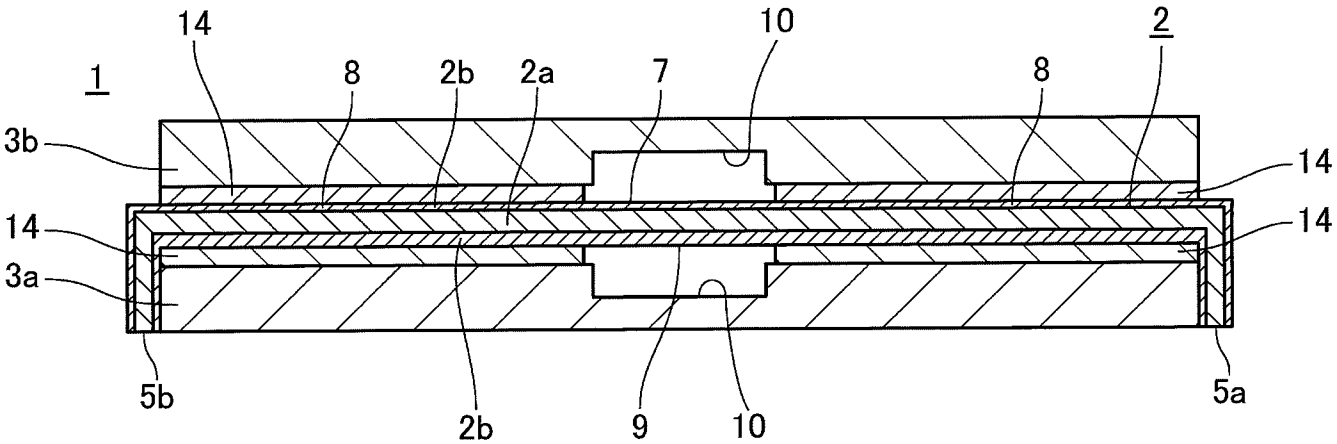
FIG. 14 is a cross-sectional view illustrating a fuse device in which a metal layer is formed on a contact surface of a cooling member contacting a fuse element.

In each of the fuse devices 1, 20, 30, 40, and 50 described above, the cooling member 3 may be provided with a metal layer 14 on a part or the whole of the contact surface contacting the fuse element 2, 51. Hereinafter, the fuse device 1 will be described by way of example with reference to FIG. 14. The metal layer 14 can be formed by applying a metal paste made of, for example, solder, Ag, Cu or an alloy using these. By providing the metal layer 14 on the contact surface of the cooling member 3 contacting the fuse element 2, the fuse element 2 improves the thermal conductivity of the high thermal conductivity portion 8 and the high thermal conductivity portion 8 can be cooled more efficiently.

The metal layer 14 may be provided on both of the upper and lower cooling members 3 or may be provided on only one of them. Furthermore, the metal layer 14 may be provided on the back surface in addition to the surface sandwiching the fuse element 2 of the cooling member 3.

Moreover, in each fuse device 1 described above, connection electrodes to be connected to the connection electrodes of the external circuit may be provided on the back surface of the cooling member 3 to be mounted on the circuit board of the external circuit, and the terminal portions 5*a*, 5*b* may not be provided in the fuse element 2. In this case, in the fuse device 1, the metal layer 14 and the connection electrodes formed on the back surface are connected by through holes and castellation, among others.

Adhesive

Figure 15:
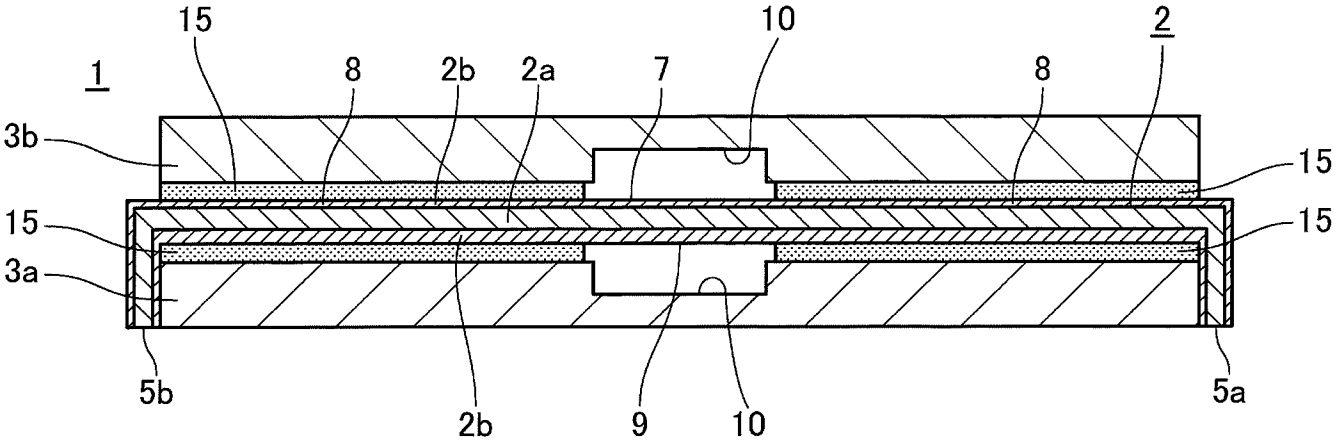
FIG. 15 is a cross-sectional view illustrating a fuse device in which an adhesive layer is formed on a contact surface of a cooling member contacting a fuse element.

Furthermore, in each of the fuse devices 1, 20, 30, 40, and 50 described above, the fuse elements 2, 51 may be connected to the cooling member 3 with an adhesive 15. Hereinafter, the fuse device 1 will be described by way of example with reference to FIG. 15. The adhesive 15 is provided at a portion other than the interrupting portion 9 of the cooling member 3 and of the fuse element 2. As a result, in the fuse device 1, the adhesion between the cooling member 3 and the high thermal conductivity portion 8 of the fuse element 2 is enhanced via the adhesive 15, and heat can be more efficiently transferred to the cooling member 3.

Any of known adhesives can be used for the adhesive 15, but it is preferable for the adhesive 15 to have a high thermal conductivity in order to promote cooling of the fuse element 2 (for example, KJR-9086 manufactured by Shin-Etsu Chemical Co., Ltd., SX 720 manufactured by CEMEDINE Co., Ltd., and SX1010 manufactured by CEMEDINE Co., Ltd.) In addition, as the adhesive 15, a conductive adhesive in which conductive particles are contained in a binder resin may be used. By using a conductive adhesive as the adhesive 15, in addition to enhancing the adhesion between the cooling member 3 and the fuse element 2, it is possible to efficiently transfer the heat of the high thermal conductivity portion 8 to the cooling member 3 via the conductive particles. The connection may use a solder instead of the adhesive 15.

Fuse Element

Next, the fuse element 2 will be described. It should be noted that the configuration of the fuse element 2 described below can also be applied to the fuse elements 41, 51. The above-described fuse element 2 is a low melting point metal such as solder or Pb free solder containing Sn as a primary constituent, or a laminate of a low melting point metal and a high melting point metal. For example, the fuse element 2 may have a laminated structure composed of an inner layer and an outer layer, the inner layer serving as the low melting point metal layer 2*a* and the outer layer serving as the high melting point metal layer 2*b* laminated on the low melting point metal layer 2*a* (see FIG. 1 (B)).

The low melting point metal layer 2*a* is preferably a metal containing Sn as a primary constituent and is a material generally called "Pb free solder". The melting point of the low melting point metal layer 2*a* is not necessarily higher than the reflow temperature and the low melting point metal layer 2*a* may melt at about 200° C. The high melting point metal layer 2*b* is a metal layer laminated on the surface of the low melting point metal layer 2*a* made of, for example, Ag, Cu or a metal containing any of these as a primary constituent, and has a high melting point which does not melt the metal even when the fuse devices 1, 20, 30, 40, and 50 are mounted on an external circuit board by a reflow furnace.

By laminating the high melting point metal layer 2*b* as the outer layer on the low melting point metal layer 2*b* as the inner layer to form the fuse element 2, even when the reflow temperature exceeds the melting temperature of the low melting point metal layer 2*a*, the fuse element 2 is not blown out. Therefore, the fuse device 1 can be efficiently mounted by reflow.

In addition, while the predetermined rated current flows, the fuse element 2 is not blown out by self-heating. When a current having a value higher than the rating flows, melting starts from the melting point of the low melting point metal layer 2*a* by self-heating, and the current path between the terminal portions 5*a*, 5*b* can be promptly interrupted. For example, when the low melting point metal layer 2*a* is made of a Sn—Bi based alloy or an In—Sn based alloy, the fuse element 2 starts melting at a low temperature of about 140° C. or about 120° C. In these cases, for example, by using an alloy containing 40% or more of Sn as a low melting point metal of the fuse element 2, the melted low melting point metal layer 2*a* erodes the high melting point metal layer 2*b* so that the high melting point metal layer 2*b* melts at a temperature lower than the melting temperature thereof. Therefore, the fuse element 2 can be blown out in a short time by utilizing the erosive action of the low melting point metal layer 2*a* on the high melting point metal layer 2*b*.

In addition, since the fuse element 2 is formed by laminating the high melting point metal layer 2*b* on the inner low melting point metal layer 2*a*, the melting temperature can be significantly reduced as compared with the conventional chip fuses made of a high melting point metal. Therefore, by forming the fuse element 2 wider in width and shorter in the current direction than the high melting point metal element, it is possible to reduce the fuse element 2 in size while significantly improving the current rating, and to suppress the effects of heat on connection parts to be connected with the circuit board. In addition, this fuse can be made smaller and thinner than the conventional chip fuse having the same current rating, and it is also excellent in rapid blowout properties.

Moreover, improvements in surge tolerance (pulse tolerance), in the case of an abnormally high voltage is momentarily applied, are enabled by the fuse element 2 in electrical systems in which the fuse device 1 is incorporated. For example, the fuse element 2 should not blow out even in the case of a current of 100 A flowing for a few milliseconds. This is because a large current flowing for a very short duration flows across the surface of a conductor (skin effect), and because the high melting point metal layer 2*b* comprising an Ag plating having a low resistance is provided as an outer layer in the fuse element 2, a current caused by a surge can be easily allowed to flow and blowout due to self-heating can be prevented. Therefore, the fuse element 2 can significantly improve surge tolerance in comparison to conventional fuses made from solder alloys.

The fuse element 2 can be manufactured by using film forming techniques such as plating techniques to deposit the high melting point metal layer 2*b* on the surface of the low melting point metal layer 2*a*. For example, the fuse element 2 can be efficiently manufactured by applying Ag plating to the surface of the solder foil or solder wire.

In addition, the high melting point fuse element 51 can be manufactured in the same manner as the fuse element 2. In this case, the melting point of the high melting point fuse element 51 can be made higher than that of the fuse element 2, for example, by making the thickness of the high melting point metal layer 2*b* thicker than that of the fuse element 2, or by using a high melting point metal having a melting point higher than that of the high melting point metal used for the fuse element 2.

It should be noted that, in the fuse element 2, it is preferable to form the volume of the low melting point metal layer 2*a* larger than the volume of the high melting point metal layer 2*b*. The fuse element 2 can melt and blow out promptly by eroding the high melting point metal by melting the low melting point metal by self-heating. Therefore, in the fuse element 2, forming the volume of the low melting point metal layer 2*a* larger than the volume of the high melting point metal layer 2*b* promotes this erosive action, such that the path between the terminal portions 5*a*, 5*b* can be promptly interrupted.

Deformation Restricting Portion

Figure 16:
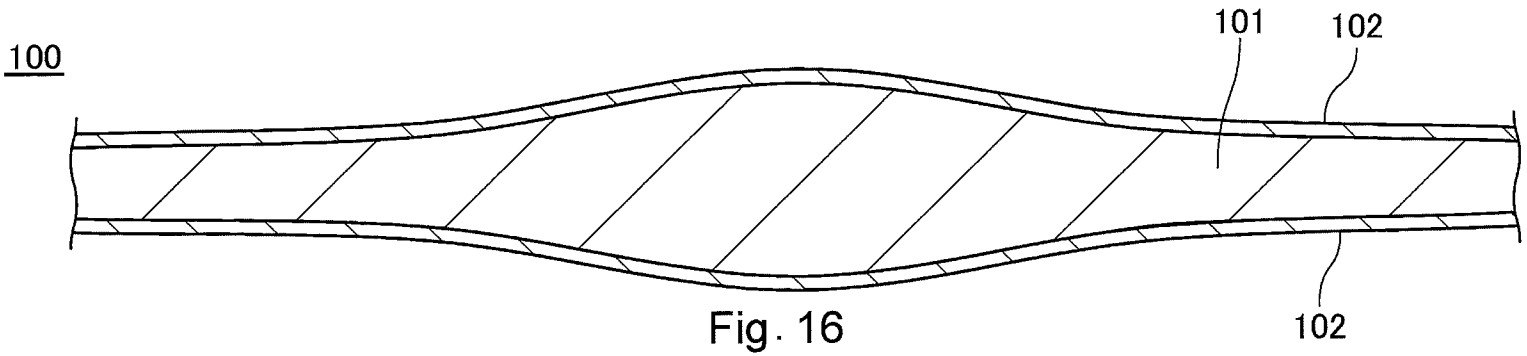
FIG. 16 is a cross-sectional view illustrating a fuse element deformed by melting and flowing of a low melting point metal.

Furthermore, the fuse element 2 may be provided with a deformation restricting portion for suppressing the flow of melted low melting point metal and restricting deformation. This is due to the following reasons. Because applications of fuse devices extend from electronic equipment to large current applications such as industrial machinery, electric bicycles, electric motorcycles and automobiles, which require further higher rating and lower resistance, fuse elements have been increasing in surface area. However, when reflow mounting a fuse device using a fuse element having a large area, the fuse device 100 might deform as shown in FIG. 16 because of the low melting point metal 101 coated with the high melting point metal 102 melting inside and flowing out onto the electrode, or mounting solder supplied to the electrode flowing into the fuse device. This is because the fuse device 100 having a large area has a low rigidity and is locally depressed or expanded due to the tension accompanying the melting of the low melting point metal 101. Such depression and expansion appear as undulations on the entire fuse device 100.

In the fuse device 100 in which such deformation occurs, resistance decreases at sites expanded by agglomerating low melting point metal 101 while resistance increases at sites experiencing outflow, creating variation in resistance values. This might result in failure to blow out at a predetermined temperature/current or in delayed blowout and might, in contrast, result in blowout at a lower temperature/current than predetermined.

To avoid such problems, by providing a deformation restricting portion which suppresses deformation of the fuse element 2 within a certain range to suppress variations in blowout properties, the fuse element 2 can maintain predetermined blowout properties.

Figure 17A:
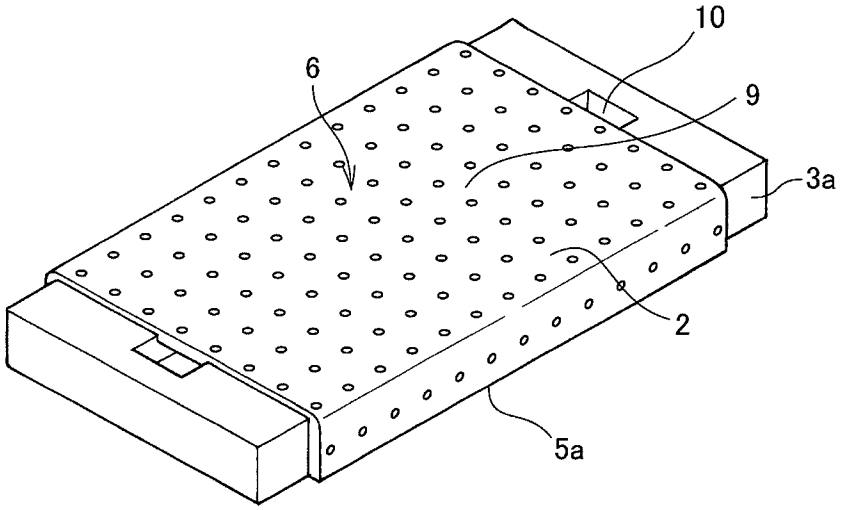
FIG. 17 (A) is an external perspective view illustrating a cooling member in which a fuse element having a deformation restricting portion is disposed, and FIG. 17 (B) is a cross-sectional view of the fuse device using the fuse element having the deformation restricting portion.
Figure 17B:
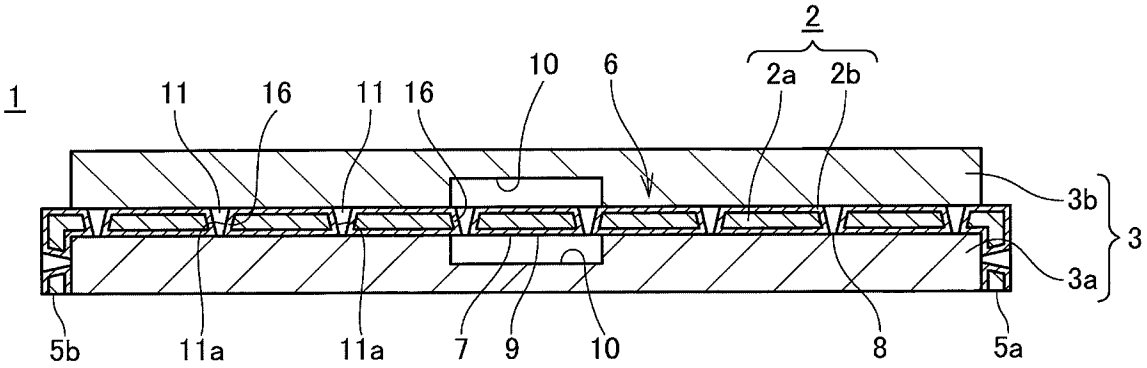

The deformation restricting portion 6 is formed such that, as shown in FIGS. 17 (A) and (B), at least a part of a side surface 11*a* of one or more of holes 11 provided in the low melting point metal layer 2*a* is covered with a second high melting point metal layer 16 continuous with the high melting point metal layer 2*b*. The hole 11 can be formed, for example, by piercing a sharp tip such as a needle into the low melting point metal layer 2*a*, or by subjecting the low melting point metal layer 2*a* to press working using a metal mold, among other methods. Furthermore, the holes 11 are uniformly formed over the entire surface of the low melting point metal layer 2*a* in a predetermined pattern, for example, a tetragonal lattice shape or a hexagonal lattice shape.

As in the material constituting the high melting point metal layer 2*b*, the material constituting the second high melting point metal layer 16 has a high melting point that does not melt at the reflow temperature. It is preferable that the second high melting point metal layer 16 is made of the same material as the high melting point metal layer 2*b* and formed simultaneously in the step of forming the high melting point metal layer 2*b* from the viewpoint of production efficiency.

As shown in FIG. 17 (B) after sandwiching this fuse element 2 with the pair of cooling members 3*a*, 3*b*, the fuse device 1 is attached to an external circuit board of various kinds of electronic equipment and reflow-mounted.

In this case, since the high melting point metal layer 2*b* which does not melt even at the reflow temperature is laminated on the low melting point metal layer 2*a* as an outer layer and the deformation restricting portion 6 is provided in the fuse element 2, even when exposed to a high-temperature environment in reflow mounting of the fuse device 1 to the external circuit board, the deformation restricting portion 6 can suppress deformation of the fuse element 2 within a certain range to suppress variations in blowout properties. Therefore, even when the fuse element 2 has a large area, the fuse device 1 can be reflow mounted, and the mounting efficiency can be improved. Furthermore, in the fuse element 2, it is possible to improve the rating in the fuse device 1.

That is, in the fuse element 2, because the hole 11 is opened in the low melting point metal layer 2*a*, and the deformation restricting portion 6 in which the side surface 11*a* of the hole 11 is covered with the second high melting point metal layer 16 is provided, even when exposed to a high temperature environment of a melting point higher than the melting point of the low melting point metal layer 2*a* for a short time by an external heat source such as a reflow furnace, the second high melting point metal layer 16 covering the side surface 11*a* of the hole 11 suppresses the flow of the melted low melting point metal and the high melting point metal layer 2*b* constituting the outer layer is supported. Therefore, the fuse element 2 can suppress occurrence of local depression or expansion due to the melted low melting point metal agglomerating and expanding by tension or the melted low melting point metal flowing out and becoming thin.

As a result, the fuse element 2 prevents fluctuation in the resistance value due to deformation such as local depression or expansion at the temperature at the time of reflow mounting and maintains the blowout properties to blow out in a predetermined temperature or current for a predetermined time. In addition, even when repeatedly exposed to the reflow temperature, for example, in the case that after the fuse device 1 is reflow-mounted on the external circuit board, the external circuit board is further reflow-mounted on another circuit board, the fuse element 2 can maintain the blowout properties and improve mounting efficiency.

As will be described later, when the fuse element 2 is manufactured by cutting out from a large-sized element sheet, the low melting point metal layer 2*a* is exposed on the side surface of the fuse element 2, and the side surface is in contact with connection electrodes provided on the external circuit board via a connection solder. Also, in this case, since the fuse element 2 suppresses the flow of the melted low melting point metal with the deformation restricting portion 6, the volume of the low melting point metal does not increase due to the melted connection solder being drawn from the side surface and the resistance value does not locally decrease.

Figure 18A:
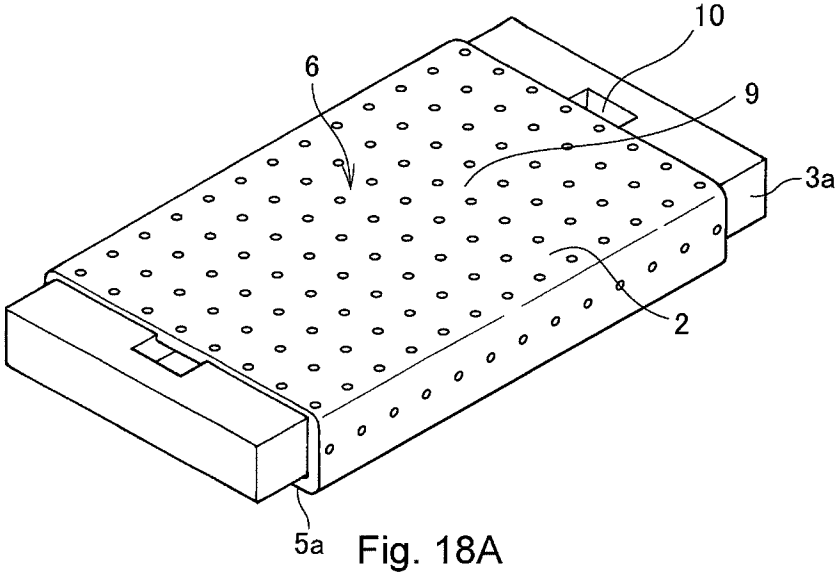
FIG. 18 (A) is an external perspective view illustrating a cooling member in which the terminal portion of the fuse element is formed on the back surface, and FIG. 18 (B) is a cross-sectional view of the fuse device in which the terminal portion of the fuse element is formed on the back surface of the cooling member.
Figure 18B:
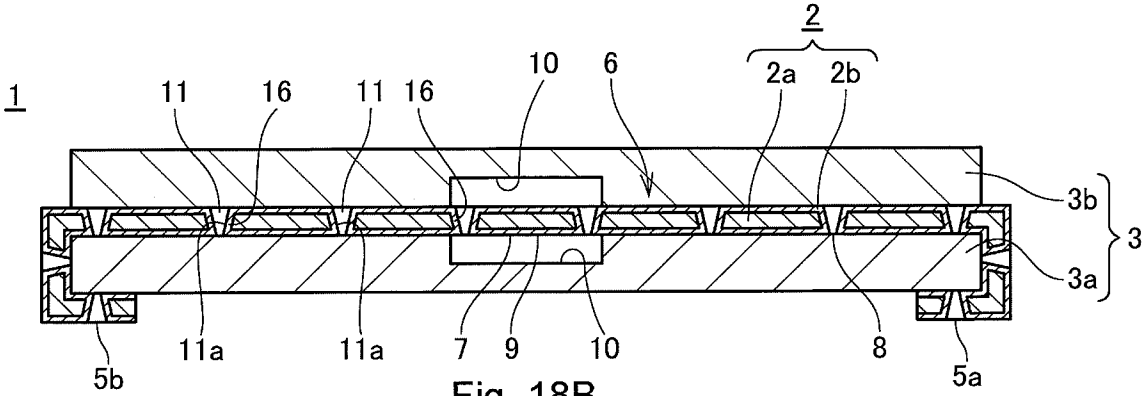

It should be noted that, as shown in FIGS. 18 (A) and (B), while fitting the fuse element 2 to the side surface of the cooling member 3*a*, both ends may be bent toward the back surface of the cooling member 3*a* and the terminal portions 5*a*, 5*b* may be formed on the back surface of the cooling member 3*a*.

Figure 19A:
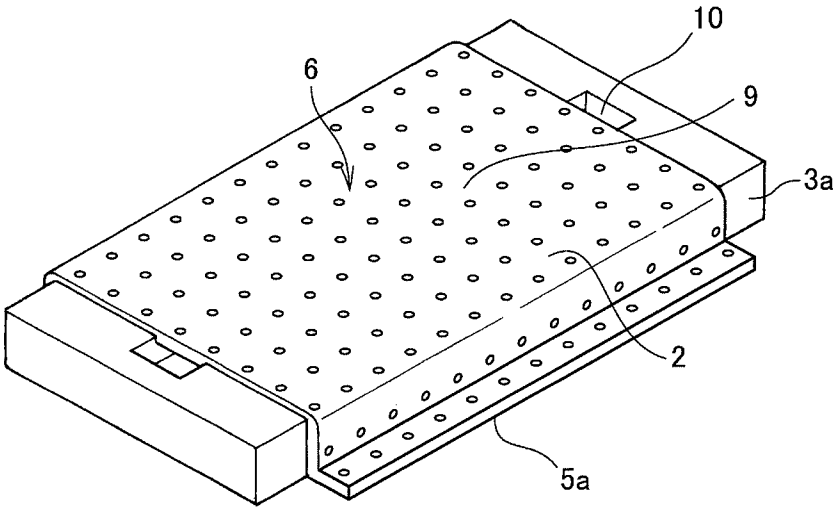
FIG. 19 (A) is an external perspective view illustrating a cooling member in which the terminal portion of the fuse element is formed on the outside, and FIG. 19 (B) is a cross-sectional view of a fuse device in which a terminal portion of the fuse element is formed outside the cooling member.
Figure 19B:
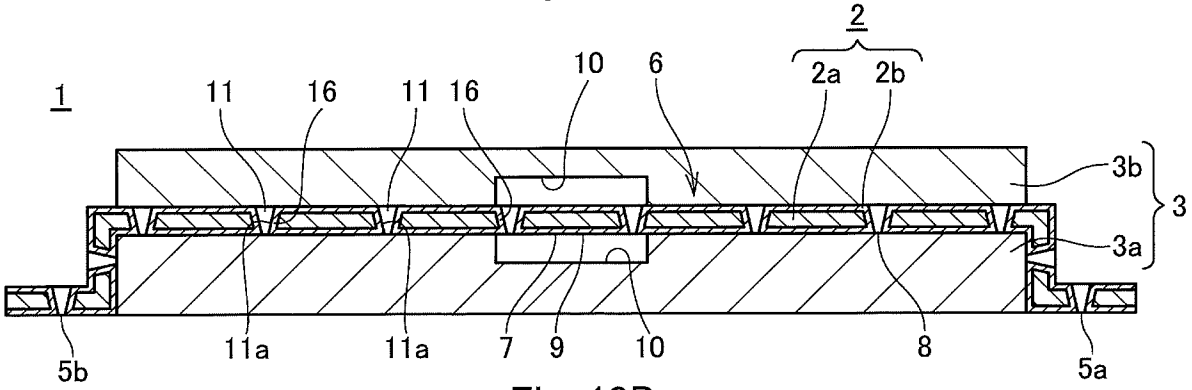

Also, as shown in FIGS. 19 (A) and (B), while fitting the fuse element 2 to the side surface of the cooling member 3*a*, both ends may be bent to the outside of the cooling member 3*a* and the terminal portions 5*a*, 5*b* may be formed outside the cooling member 3*a*. In this case, as shown in FIG. 19 (B), the terminal portions 5*a*, 5*b* of the fuse element 2 may be bent so as to be flush with the back surface of the cooling member 3*a*, or alternatively, may be bent so as to protrude from the back surface of the cooling member 3*a*.

As shown in FIGS. 18 and 19, by forming the terminal portions 5*a*, 5*b* at positions bent further from the side surface of the cooling member 3*a* to the back surface or the outside, the fuse element 2 can suppress outflow of the low melting point metal constituting the inner layer and inflow of the connection solder connecting the terminal portions 5*a*, 5*b* and prevent fluctuation of blowout properties due to local depression or expansion.

Figure 20A:
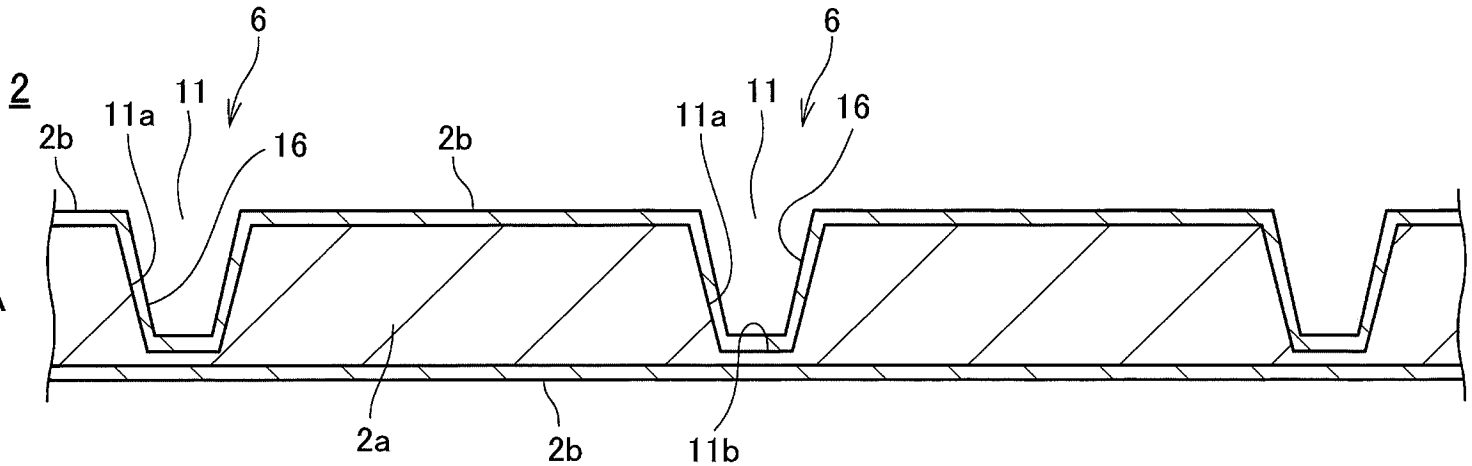
FIG. 20 (A) is a cross-sectional view of a fuse element having a non-through hole before reflow mounting, and FIG. 20 (B) is a cross-sectional view of a fuse element illustrated in FIG. 20 (A) after reflow mounting.
Figure 20B:
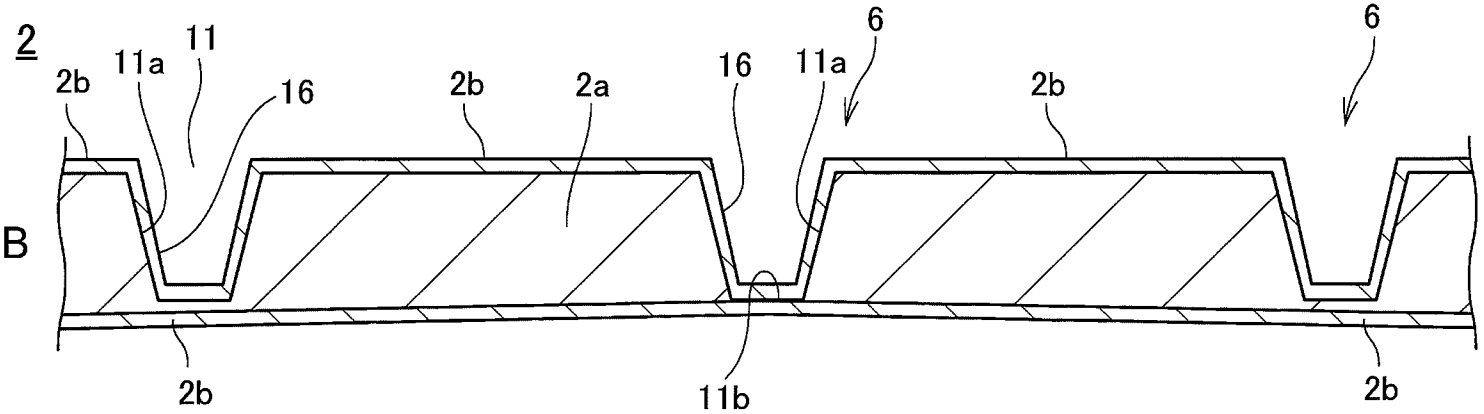

As shown in FIG. 17 (B), the hole 11 may be formed as a through hole penetrating the low melting point metal layer 2*a* in the thickness direction or may be formed as a non-through hole as shown in FIG. 20 (A). When the hole 11 is formed as a through hole, the second high melting point metal layer 16 covering the side surface 11*a* of the hole 11 is continuous with the high melting point metal layer 2*b* laminated on the top and back surfaces of the low melting point metal layer 2*a*.

Furthermore, when the hole 11 is formed as a non-through hole, as shown in FIG. 20 (A), it is preferable that the hole 11 is covered with the second high melting point metal layer 16 to the bottom surface 11*b*. Even when the hole 11 of the fuse element 2 is formed as a non-through hole and the low melting point metal flows due to reflow heating, the flow is suppressed by the second high melting point metal layer 16 covering the side surface 11*a* of the hole 11 and the high melting point metal layer 2*b* constituting the outer layer is supported, as shown in FIG. 20 (B), the fluctuation of the thickness of the fuse element 2 is negligible and does not cause fluctuation of blowout properties.

Figure 21A:
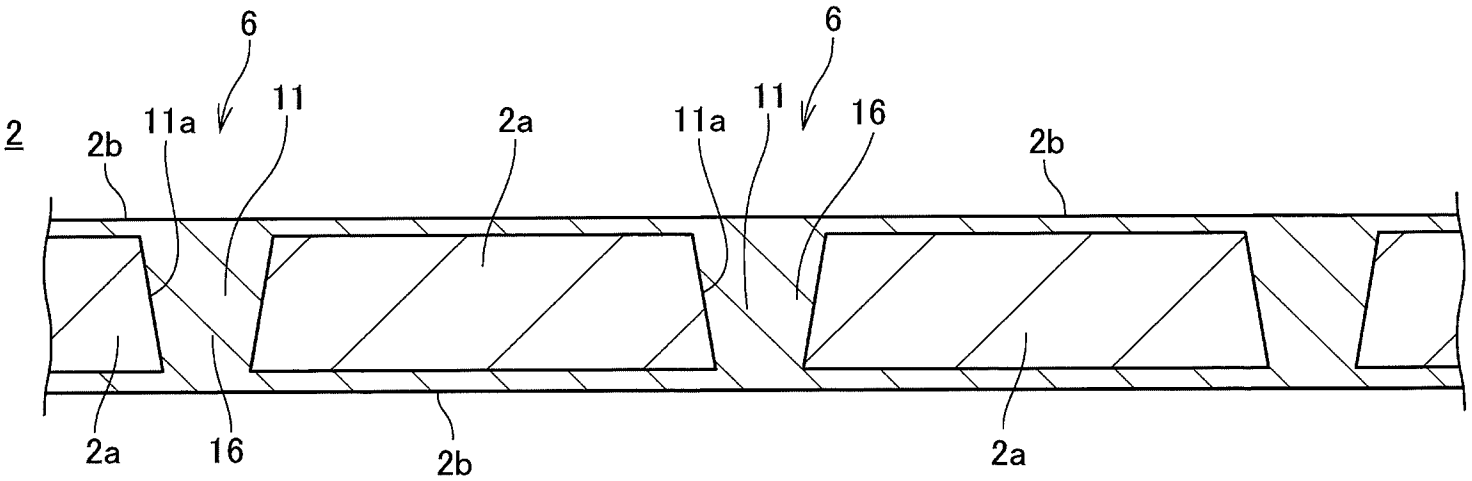
FIG. 21 (A) is a cross-sectional view illustrating a fuse element in which a through hole is filled with a second high melting point metal layer, and FIG. 21 (B) is a cross-sectional view illustrating a fuse element in which a non-through hole is filled with a second high melting point metal layer.
Figure 21B:
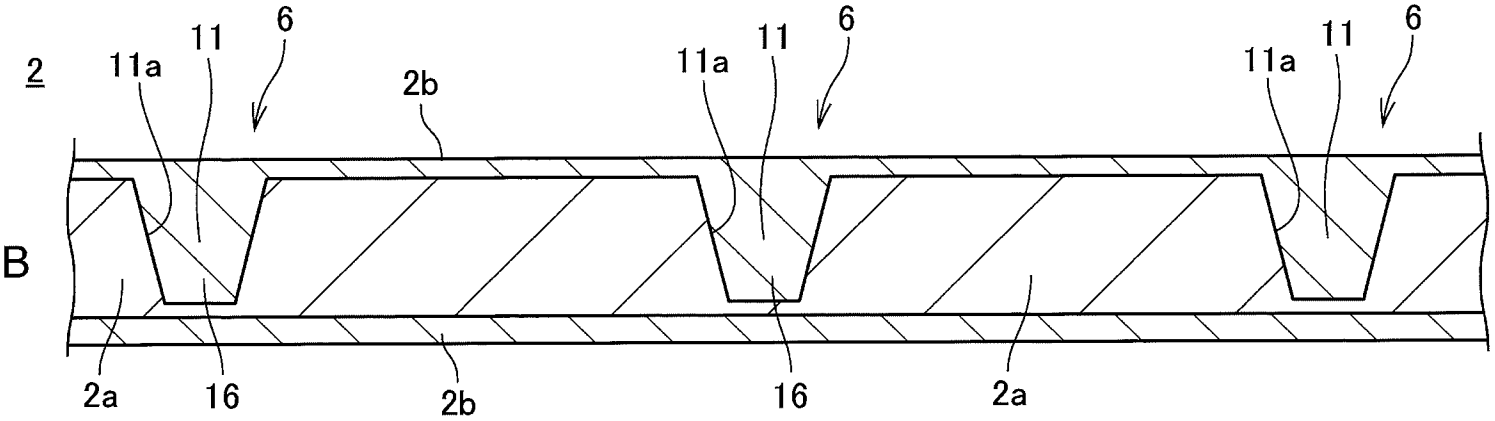

Furthermore, as shown in FIGS. 21 (A) and (B), the holes 11 may be filled with a second high melting point metal layer 16. By filling the hole 11 with the second high melting point metal layer 16, the fuse element 2 improves the strength of the deformation restricting portion 6 supporting the high melting point metal layer 2*b* constituting the outer layer, so that deformation of the fuse element 2 can be further suppressed and the rating can be improved by reducing the resistance.

Figure 22A:
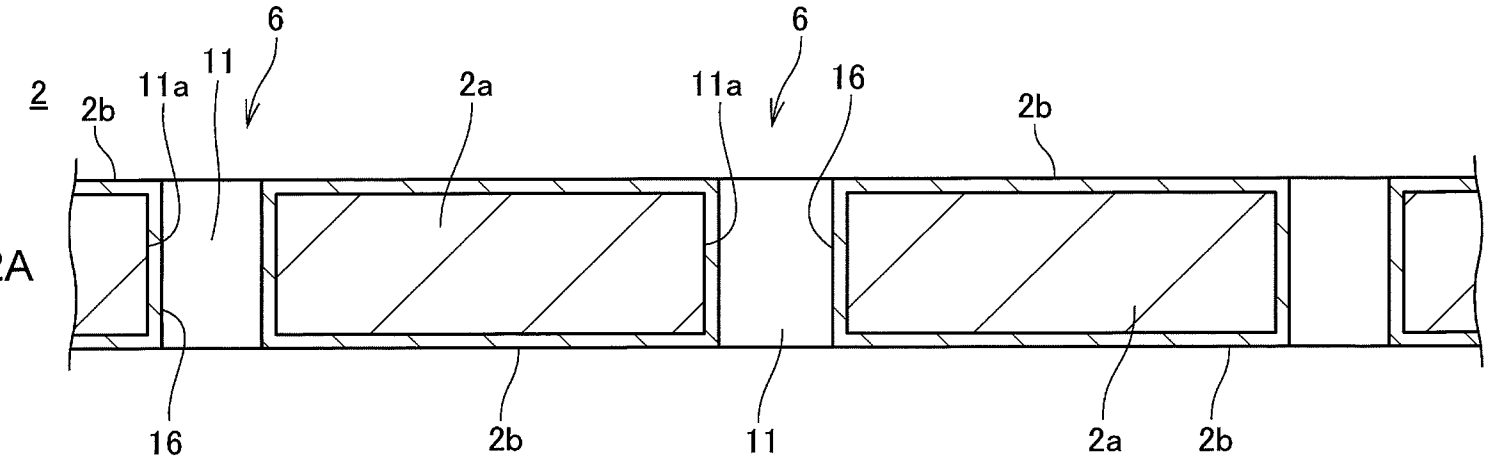
FIG. 22 (A) is a cross-sectional view illustrating a fuse element provided with a through hole having a rectangular cross section, and FIG. 22 (B) is a cross-sectional view illustrating a fuse element provided with a non-through hole having a rectangular cross section.
Figure 22B:
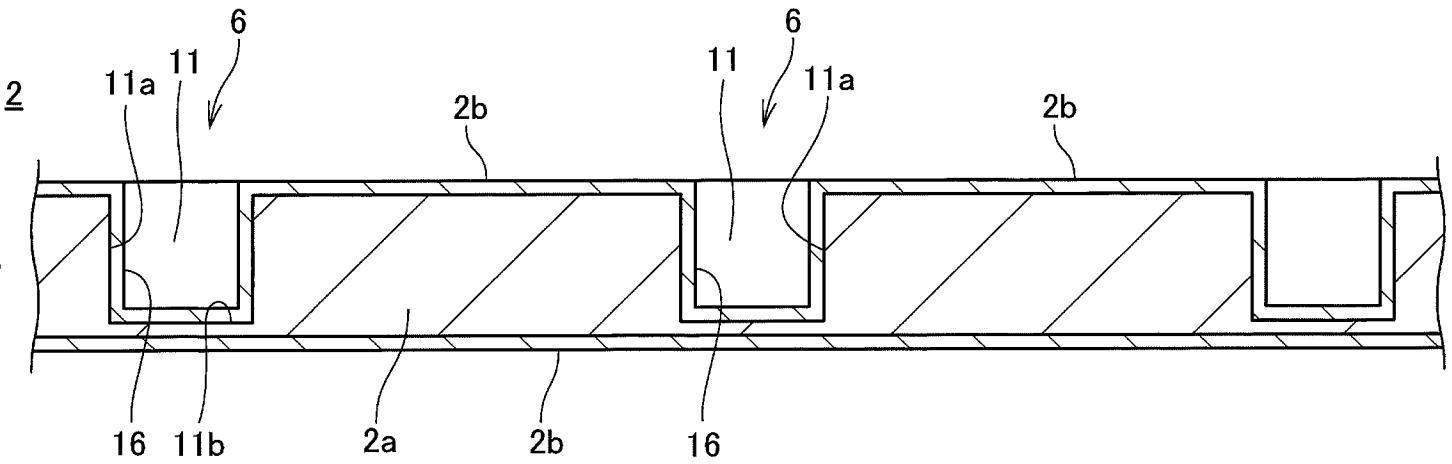

As will be described later, the second high melting point metal layer 16 can be formed, for example, at the same time when forming the high melting point metal layer 2*b* by electrolytic plating on the low melting point metal layer 2*a* in which the hole 11 is opened, and it is possible to fill the inside of the hole 11 with the second high melting point metal layer 16 by adjusting the hole size and plating conditions, Furthermore, as shown in FIG. 20 (A), the hole 11 may be formed to have a tapered cross section. For example, by piercing a sharp tip such as a needle in the low melting point metal layer 2*a* to make an opening, the hole 11 can be formed to have a tapered cross section in accordance with the shape of the sharp tip. Alternatively, as shown in FIGS. 22 (A) and (B), the hole 11 may be formed to have a rectangular cross section. For example, in the fuse element 2, the hole 11 having a rectangular cross section can be opened by performing press working using a mold corresponding to the hole 11 having a rectangular cross section in the low melting point metal layer 2*a*.

Figure 23:
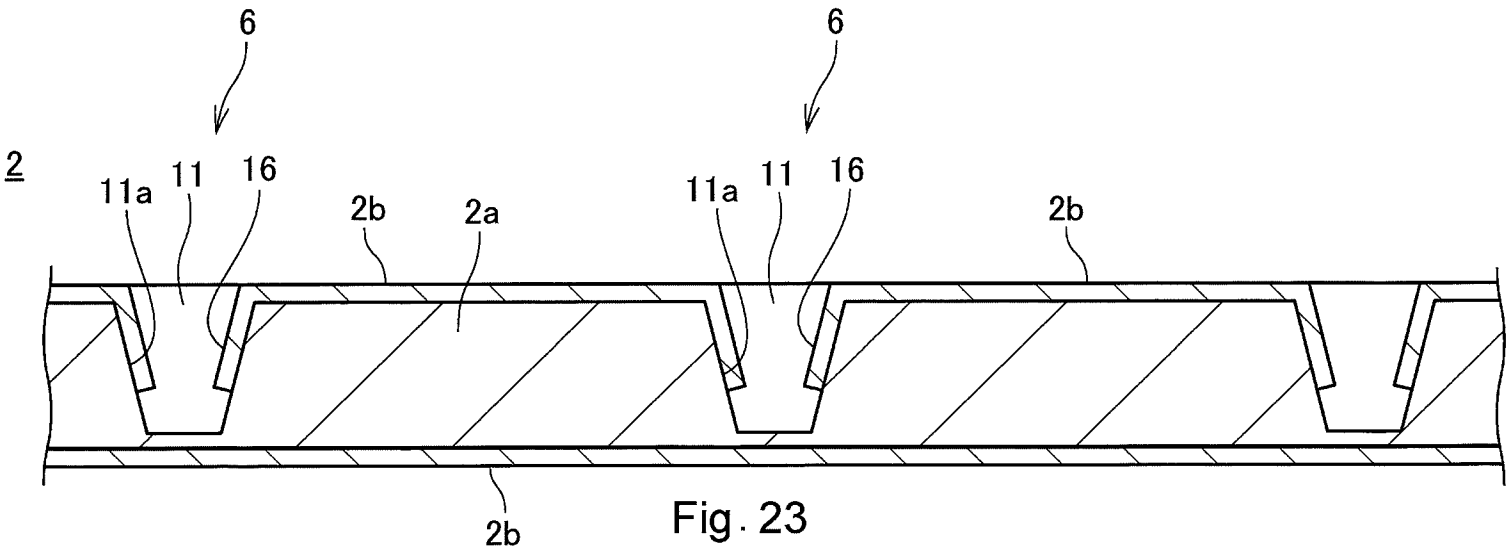
FIG. 23 is a cross-sectional view illustrating a fuse element in which an upper portion of the open end of the hole is covered with a second high melting point metal layer.

It should be noted that the deformation restricting portion 6 may cover at least a part of the side surface 11*a* of the hole 11 with the second high melting point metal layer 16 continuous with the high melting point metal layer 2*b*, and as shown in FIG. 23, only an upper portion of the side surface 11*a* may be covered with the second high melting point metal layer 16. Alternatively, the second high melting point metal layer 16 of the deformation restricting portion 6 may be formed, after forming a laminate of the low melting point metal layer 2*a* and the high melting point metal layer 2*b*, by penetrating a sharp tip from above the high melting point metal layer 2*b* to open or penetrate the hole 11, and by pushing a part of the high melting point metal layer 2*b* into the side surface 11*a* of the hole 11.

As shown in FIG. 23, by laminating the second high melting point metal layer 16 continuous with the high melting point metal layer 2*b* on a part of the side surface 11*a* of the hole 11 on the open end side, the flow of the melted low melting point metal is restricted by the second high melting point metal layer 16 laminated on the side surface 11*a* of the hole 11, the high melting point metal layer 2*b* on the open end side is supported, and it is also possible to suppress local depression and expansion of the fuse element 2.

Figure 24A:
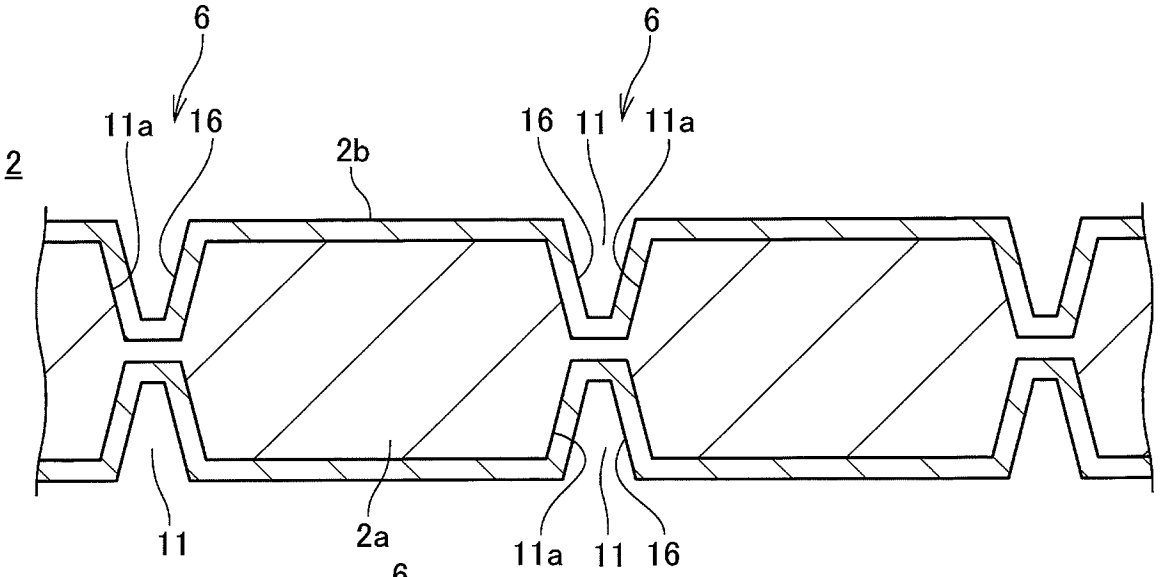
FIG. 24 (A) is a cross-sectional view illustrating a fuse element formed with non-through holes facing each other, and FIG. 24 (B) is a cross-sectional view illustrating a fuse element formed with non-through holes not facing each other.
Figure 24B:
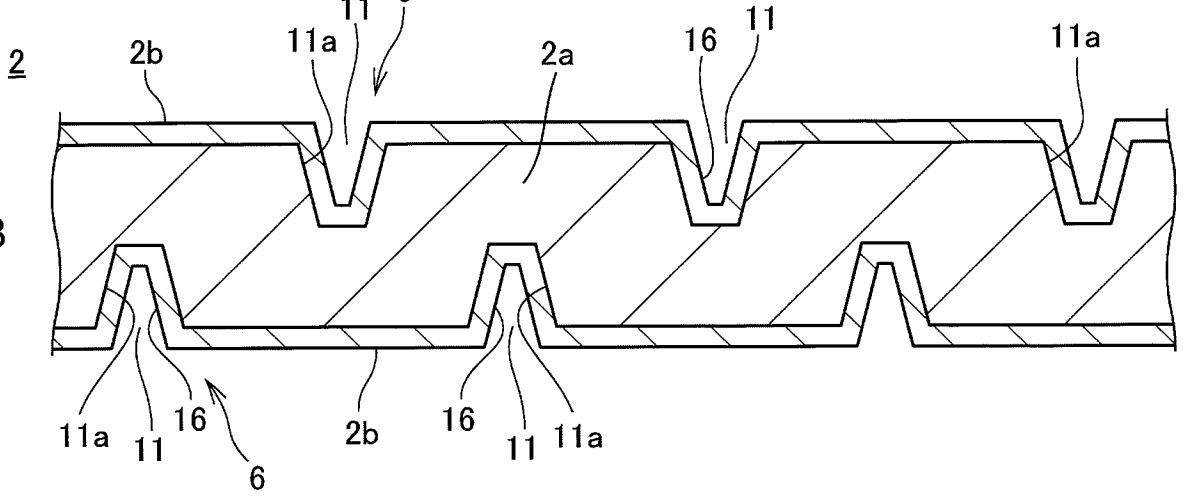

Furthermore, as shown in FIG. 24 (A), in the deformation restricting portion 6, the hole 11 may be formed as a non-through hole, and may be formed to face each other on one side and the other side of the low melting point metal layer 2*a*. Alternatively, as shown in FIG. 24 (B), in the deformation restricting portion, the hole 11 may be formed as a non-through hole, and may be formed not to face each other on one side and the other side of the low melting point metal layer 2*a*. As is the case of the above, by forming non-through holes 11 on both sides of the low melting point metal layer 2*a* so as to face each other or not to face each other, the flow of the melted low melting point metal is restricted by the second high melting point metal layer 16 covering the side surface 11*a* of each hole 11 and the high melting point metal layer 2*b* constituting the outer layer is supported. Therefore, the fuse element 2 can suppress occurrence of local depression or expansion due to the melted low melting point metal agglomerating and expanding by tension or the melted low melting point metal flowing out and becoming thin.

It should be noted that in the deformation restricting portion 6, in order to coat the side surface 11*a* of the hole 11 with the second high melting point metal layer 16 by electrolytic plating, and from the viewpoint of production efficiency, the hole preferably has a diameter that allows plating solution to flow in, and for example, the minimum diameter of the hole is 50 μm or more, and more preferably 70 to 80 μm. Although the maximum diameter of the hole 11 can be set as appropriate depending on the plating limit of the second high melting point metal layer 16 and the thickness of the fuse element 2, a larger hole diameter tends to increase the initial resistance value.

In addition, in the deformation restricting portion 6, the hole 11 preferably has a depth of 50% or more of the thickness of the low melting point metal layer 2*a*. If the depth of the hole 11 is shallower than this, flow of melted low melting point metal cannot be suppressed, and fluctuation of blowout properties may be caused along with deformation of the fuse element 2.

Furthermore, it is preferable that the deformation restricting portion 6 includes the holes 11 formed in the low melting point metal layer 2*a* at a predetermined density, for example, a density of one or more per 15×15 mm.

In addition, it is preferable that the hole 11 of the deformation restricting portion 6 is at least formed in the interrupting portion 9 in which the fuse element 2 blows out at the time of an overcurrent. Since the interrupting portion 9 of the fuse element 2 overlaps with the groove 10, is not supported by the cooling members 3*a*, 3*b*, and is relatively low in rigidity, deformation due to the flow of the low melting point metal is liable to occur at this portion. Therefore, by opening the hole 11 in the interrupting portion 9 of the fuse element 2 and covering the side surface 11*a* with the second high melting point metal layer 16, it is possible to suppress the flow of the low melting point metal at a blowout portion and to prevent deformation.

Furthermore, in the deformation restricting portion 6, it is preferable that the holes 11 are provided at both end sides where the terminal portions 5*a*, 5*b* of the fuse element 2 are provided. In the fuse element 2, the terminal portions 5*a*, 5*b* expose the low melting point metal layer 2*a* constituting the inner layer and are connected to the connection electrode of the external circuit via connection solder, among others. Furthermore, both end portions of the fuse element 2 are not sandwiched by the cooling members 3*a*, 3*b*, thereby having a low rigidity and liable to be deformed. For these reasons, the fuse element 2 is provided, on both end sides thereof, with holes 11 whose side surfaces 11*a* are covered with the second high melting point metal layer 16, thereby increasing rigidity and effectively preventing deformation.

The fuse element 2 can be manufactured by forming the holes 11 constituting the deformation restricting portion 6 in the low melting point metal layer 2*a* and then forming a high melting point metal on the low melting point metal layer 2*a* using a plating technique. For example, by opening predetermined holes 11 in an elongated solder foil, Ag plating the surface to produce an element film, and cutting the film in accordance with required size at the time of use, the fuse element 2 can be manufactured efficiently and can be used easily.

In addition, by using a thin film forming technique such as vapor deposition or other well-known laminating technique, the deformation restricting portion 6 can be formed in the fuse element 2 in which the low melting point metal layer 2*a* and the high melting point metal layer 2*b* are laminated.

Alternatively, the second high melting point metal layer 16 of the deformation restricting portion 6 may be formed, after forming a laminate of the low melting point metal layer 2*a* and the high melting point metal layer 2*b*, by penetrating a sharp tip from above the high melting point metal layer 2*b* to open or penetrate the hole 11, and by pushing a part of the high melting point metal layer 2*b* having viscosity or viscoelasticity into the side surface 11*a* of the hole 11.

In the fuse element 2, an antioxidation film (not shown) may be formed on the surface of the high melting point metal layer 2*b* constituting the outer layer. By further covering the high melting point metal layer 2*b* of the outer layer of the fuse element 2 with the antioxidation film, for example, even when a Cu plating layer is formed as the high melting point metal layer 2*b*, oxidation of Cu can be prevented. Therefore, the fuse element 2 can prevent extended blowout times due to oxidation of Cu and can be blown promptly.

In addition, as the high melting point metal layer 2*b*, inexpensive but easily oxidizable metal such as Cu can be used as the high melting point metal layer 2*b*, and the fuse element 2 can be formed without using an expensive material such as Ag.

The same material as that of the low melting point metal layer 2*a* can be used as the antioxidation film of the high melting point metal, and for example, a Pb free solder containing Sn as a primary constituent can be used. Furthermore, the antioxidation film can be formed by applying tin plating to the surface of the high melting point metal layer 2*b*. Alternatively, the antioxidation film can be formed by Au plating or reflux.

Furthermore, the fuse element 2 may be cut out into a desired size from a large-sized element sheet. That is, after forming a large-sized element sheet of a laminate of the low melting point metal layer 2*a* and the high melting point metal layer 2*b*, on which the deformation restricting portion 6 is uniformly formed over the entire surface, fuse elements 2 of an arbitrary size can be cut out from the sheet. The fuse element 2 cut out from the element sheet having the deformation restricting portion 6 formed uniformly over the entire surface can prevent variations in the resistance value and fluctuation of the blowout properties due to the variation in the thickness even if the low melting point metal layer 2*a* is exposed on the cut surface, since the flow of the melted low melting point metal is restricted by the deformation restricting portion 6, and inflow of connection solder from the cut surface and outflow of low melting point metal can be suppressed.

In the above-described manufacturing method of opening the predetermined holes 11 in elongated solder foil, then producing an element film by subjecting the surface to electrolytic plating, and cutting it to a predetermined length, it was necessary to manufacture an element film for each size since the size of the fuse element 2 is restricted by the width of the element film.

In contrast, by forming the large-sized element sheet, it is possible to cut out the fuse element 2 with a desired size and to increase the degree of freedom of size.

Also, when electrolytic plating is applied to an elongated solder foil, the high melting point metal layer 2*b* is thickly plated on the side edge portion along the longitudinal direction where the electric field is concentrated, and it is difficult to obtain a fuse element 2 having a uniform thickness. Therefore, in the fuse device, a gap is generated between the fuse element 2 and the cooling member 3 due to the thick portion of the fuse element 2, it is necessary to provide an adhesive 15, among other materials, to fill the gap in order to prevent reduction of the thermal conductivity of the high thermal conductivity portion 8.

In contrast, by forming the large-sized element sheet, the fuse element 2 can be cut out while avoiding the thick portion, it is possible to obtain the fuse element 2 having a uniform thickness over the entire surface. Therefore, even when the fuse element 2 cut out from the element sheet is simply disposed on the cooling member 3, the tight contact property with the cooling member 3 can be improved.

Figure 25:
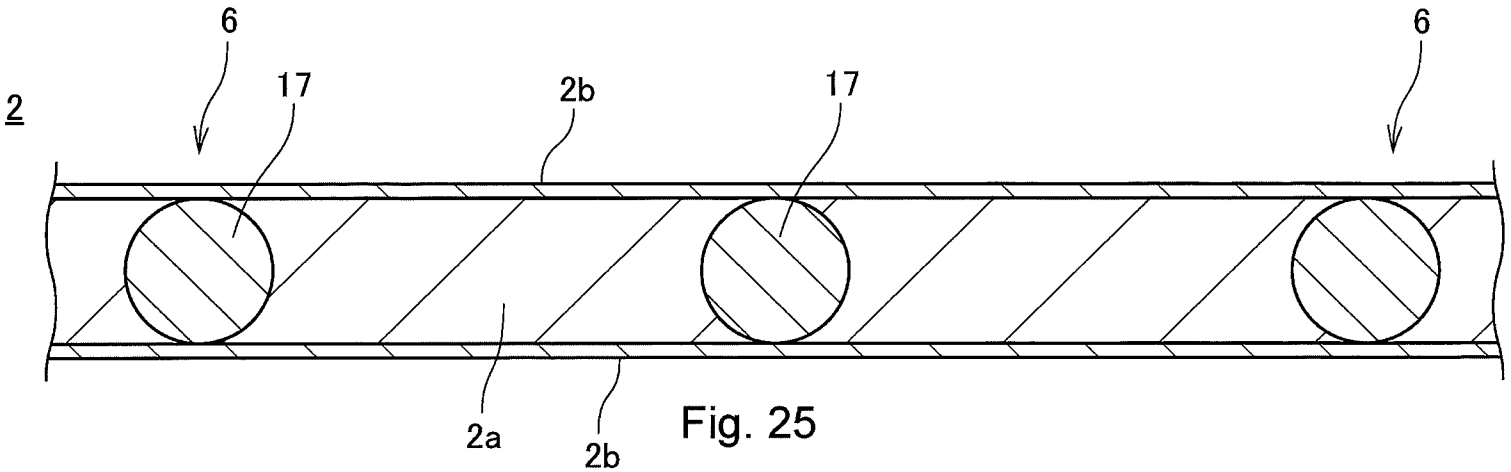
FIG. 25 is a cross-sectional view illustrating a fuse element in which a low melting point metal layer is blended with first high melting point particles.

In addition, as shown in FIG. 25, the deformation restricting portion 6 of the fuse element 2 may be formed by blending first high melting point particles 17 having a melting point higher than that of the low melting point metal layer 2*a* in the low melting point metal layer 2*a*. The first high melting point particle 17 is made of a substance having a high melting point which does not melt even at the reflow temperature, for example, particles made of metals such as Cu, Ag, Ni and alloys containing these, glass particles, ceramic particles, among other particles can be used. In addition, the shape of the first high melting point particles 17 may be spherical or flaky and is not limited. It should be noted that the first high melting point particles 17 made of metal or alloy are more conformable and excellent in dispersibility because the relative density thereof is larger than that of glass or ceramics.

The deformation restricting portion 6 can be formed by blending first high melting point particles 17 into a low melting point metal material, molding it into a film shape to form the melting point metal layer 2*a* in which the first high melting point particles 17 are dispersed in a single layer, and then laminating the high melting point metal layer 2*b*. In addition, to form the deformation restricting portion 6, the fuse element 2 may be pressed in the thickness direction after lamination of the high melting point metal layer 2*b*, so that the first high melting point particles 17 are brought into close contact with the high melting point metal layer 2*b*. Thus, in the deformation restricting portion 6, the first high melting point particles 17 support the high melting point metal layer 2*b* so that the flow of the low melting point metal is suppressed by the first high melting point particles 17 even when the low melting point metal is melted by reflow heating, thereby supporting the high melting point metal layer 2*b* and suppressing local depression and expansion of the fuse element 2.

Figure 26A:
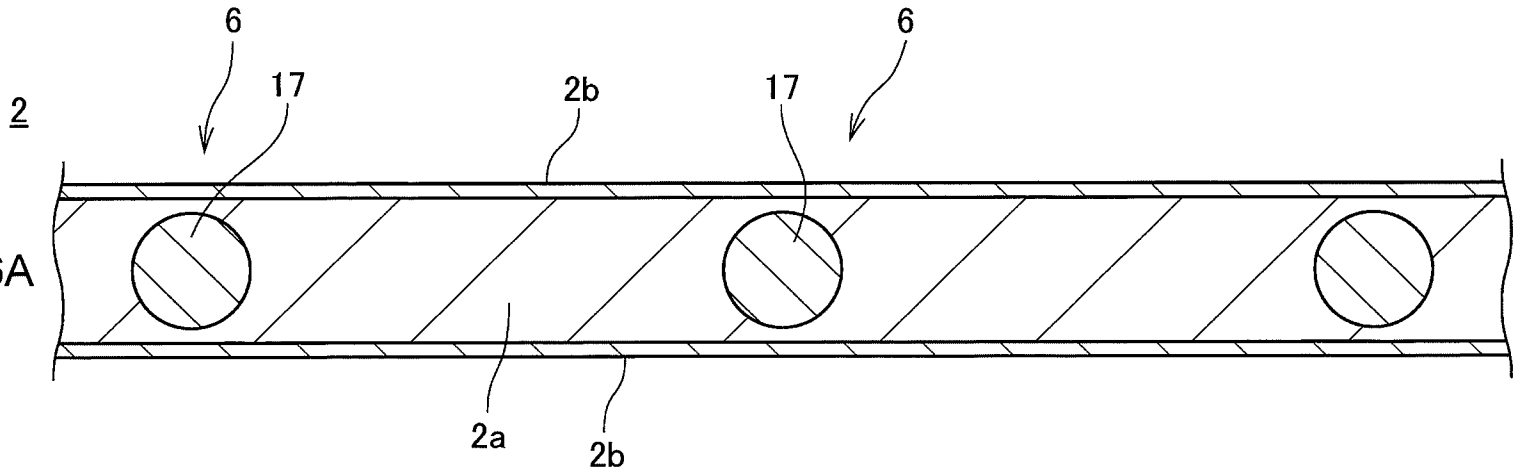
FIG. 26 (A) is a cross-sectional view of a fuse element in which a low melting point metal layer is blended with first high melting point particles having a particle size smaller than the thickness of the low melting point metal layer before reflow mounting, and FIG. 26 (B) is a cross-sectional view of the fuse element shown in FIG. 26 (A) after reflow mounting.
Figure 26B:
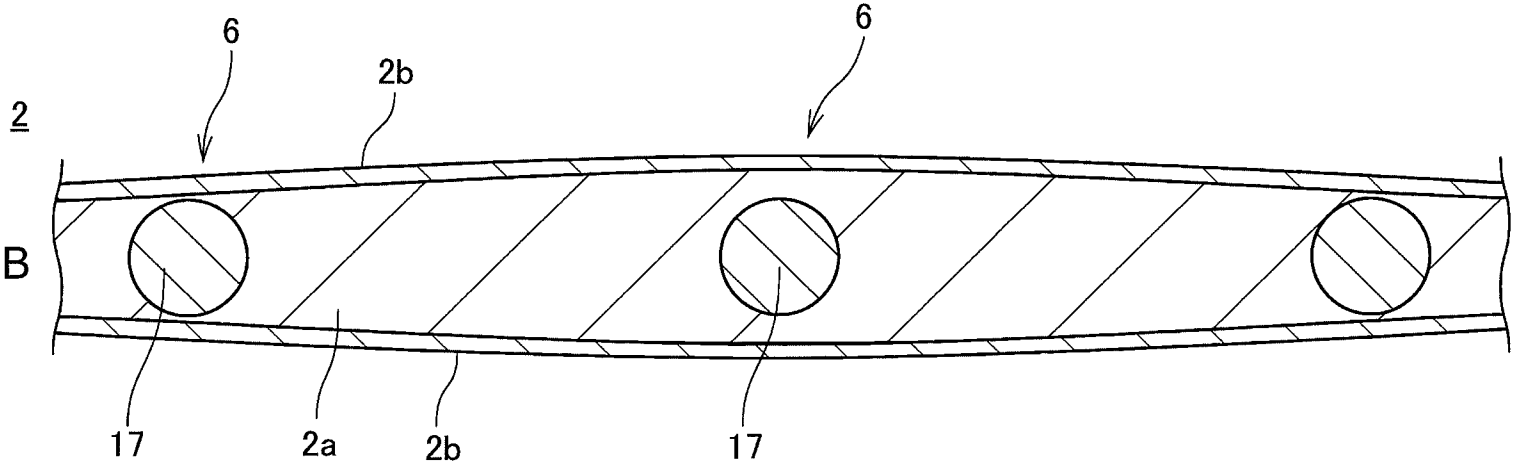

Alternatively, in the deformation restricting portion 6, as shown in FIG. 26 (A), the first high melting point particles 17 having a particle size smaller than the thickness of the low melting point metal layer 2*a* may be blended in the low melting point metal layer 2*a*. Also, in this case, as shown in FIG. 26 (B), the deformation restricting portion 6 suppresses the flow of the melted low melting point metal with the first high melting point particles 17 and supports the high melting point metal layer 2*b*, thereby suppressing occurrence of local depression or expansion of the fuse element 2.

Figure 27:
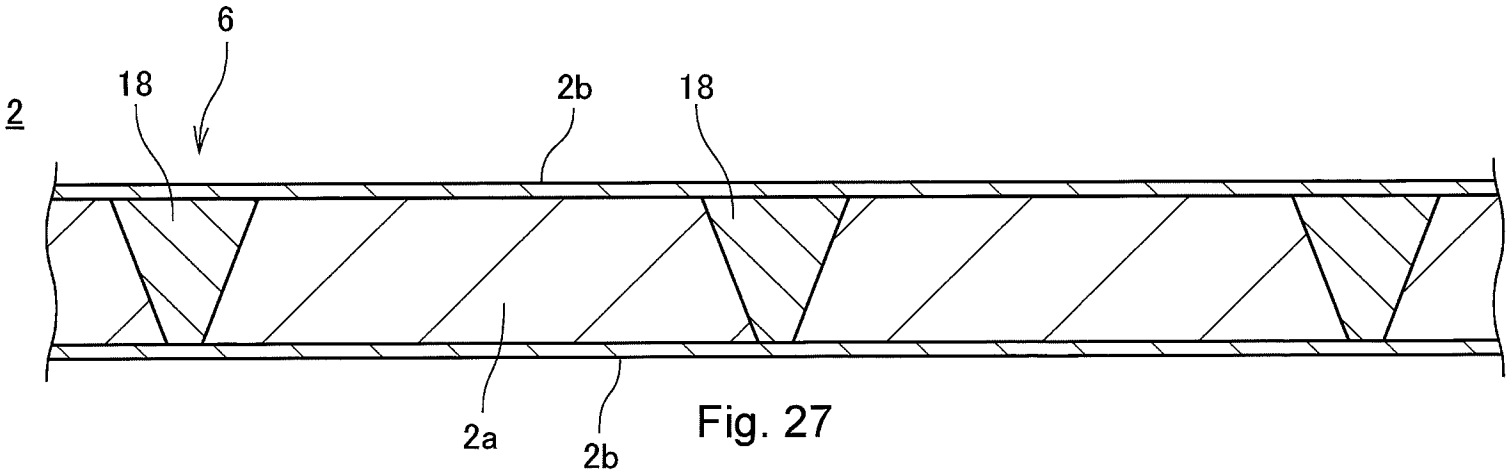
FIG. 27 is a cross-sectional view illustrating a fuse element in which a second high melting point particle is pressed into a low melting point metal layer.

In addition, as shown in FIG. 27, the deformation restricting portion 6 of the fuse element 2 may be formed by press-fitting the second high melting point particles 18 having a melting point higher than that of the low melting point metal layer 2*a* into the low melting point metal layer 2*a*. For the second high melting point particle 18, a substance similar to that of the first high melting point particle 17 described above can be used.

The deformation restricting portion 6 is formed by press-fitting and embedding the second high melting point particle 18 into the low melting point metal layer 2*a* and then laminating the high melting point metal layer 2*b*. In this case, it is preferable that the second high melting point particles 18 penetrate through the low melting point metal layer 2*a* in the thickness direction. Thus, in the deformation restricting portion 6, the second high melting point particles 18 support the high melting point metal layer 2*b* so that the flow of the low melting point metal is suppressed by the second high melting point particles 18 even when the low melting point metal is melted by reflow heating, thereby supporting the high melting point metal layer 2*b* and suppressing local depression and expansion of the fuse element 2.

Figure 28:
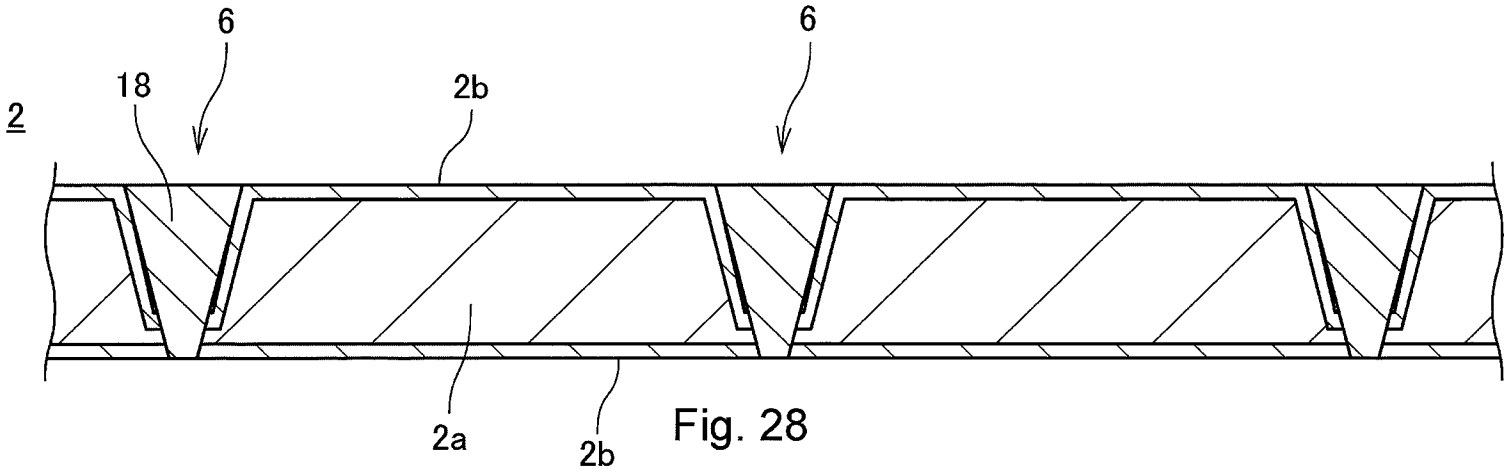
FIG. 28 is a cross-sectional view illustrating a fuse element in which a second high melting point particle is pressed into a first high melting point metal layer and a low melting point metal layer.

Furthermore, as shown in FIG. 28, the deformation restricting portion 6 of the fuse element 2 may be formed by press-fitting the second high melting point particles 18 having a melting point higher than that of the low melting point metal layer 2*a* into the high melting point metal layer 2*b* and the low melting point metal layer 2*a*.

The deformation restricting portion 6 is formed by press-fitting the second high melting point particle 18 into the laminate of the low melting point metal layer 2*a* and the high melting point metal layer 2*b* and embedding it in the low melting point metal layer 2*a*. In this case, it is preferable that the second high melting point particle 18 penetrates through the low melting point metal layer 2*a* and the high melting point metal layer 2*b* in the thickness direction. Thus, in the deformation restricting portion 6, the second high melting point particles 18 support the high melting point metal layer 2*b* so that the flow of the low melting point metal is suppressed by the second high melting point particles 18 even when the low melting point metal is melted by reflow heating, thereby supporting the high melting point metal layer 2*b* and suppressing local depression and expansion of the fuse element 2.

Alternatively, the deformation restricting portion 6 may be formed by forming the hole 11 in the low melting point metal layer 2*a*, laminating the second high melting point metal layer 16, and inserting the second high melting point particle 18 into the hole 11.

Figure 29:
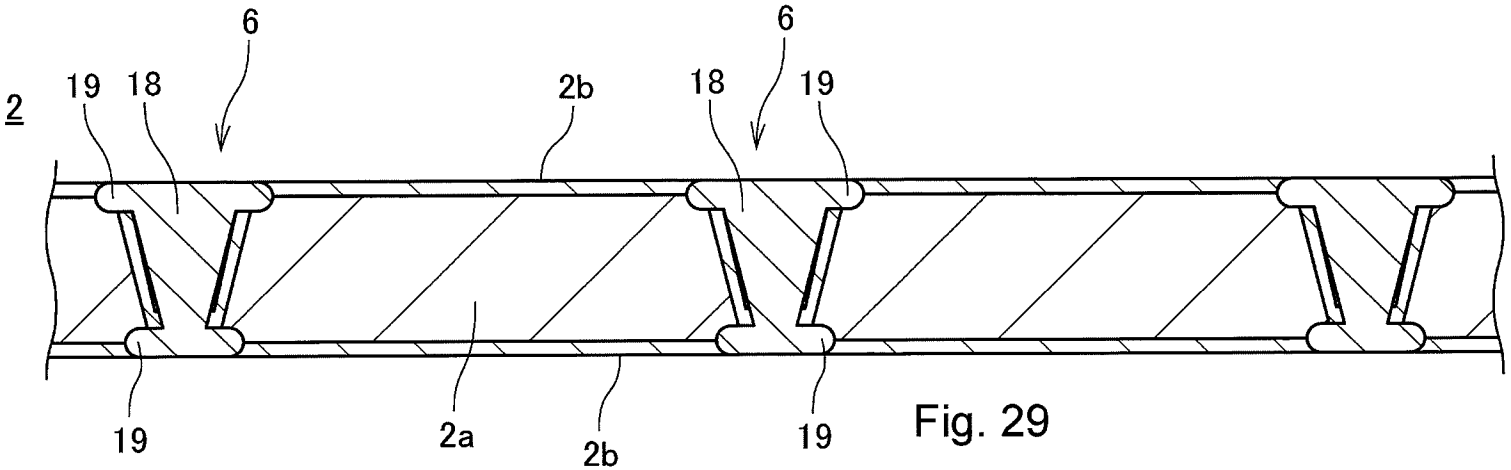
FIG. 29 is a cross-sectional view illustrating a fuse element in which flange portions are formed at both ends of the second high melting point particles.

Furthermore, as shown in FIG. 29, the deformation restricting portion 6 may be provided with a flange portion 19 abutting the high melting point metal layer 2*b* in the second high melting point particle 18. The flange portion 19 can be formed by, for example, press-fitting the first high melting point particles 17 into the high melting point metal layer 2*b* and the low melting point metal layer 2*a*, and then pressing the fuse element 2 in the thickness direction to compress and deform both ends of the second high melting point particle 18. As a result, the deformation restricting portion 6 is more strongly supported by joining the high melting point metal layer 2*b* to the flange portion 19 of the second high melting point particle 18, such that, even when the low melting point metal is melted by reflow heating, the flow of the low melting point metal is suppressed by the second high melting point particles 18 and the high melting point metal layer 2*b* is supported by the flange portion 19, thereby further suppressing occurrence of local depression and expansion of the fuse element 2.

Figure 30A:
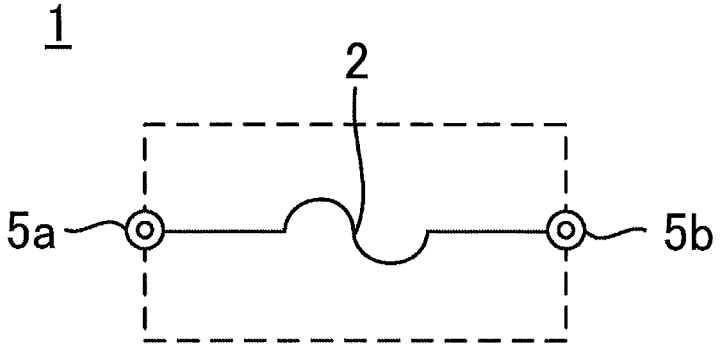
FIG. 30 is a circuit diagram of the fuse device, wherein (A) illustrates the fuse element before blowout and (B) illustrates the fuse element after blowout.
Figure 30B:
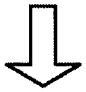
Figure 30B:
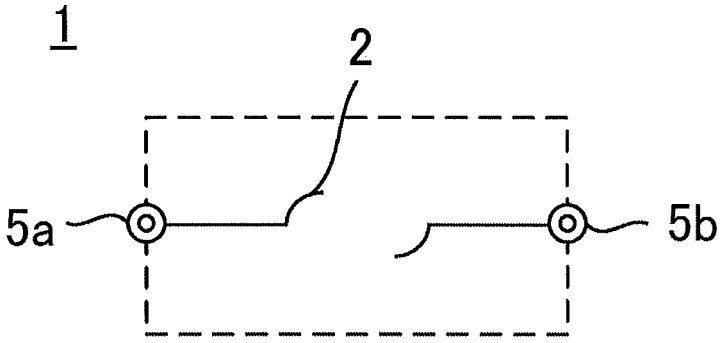

Such a fuse device 1 has a circuit configuration shown in FIG. 30 (A). The fuse device 1 is incorporated in a current path of an external circuit by being mounted on the external circuit via the terminal portions 5*a*, 5*b*. While predetermined rated current flows through the fuse element 2, the fuse device 1 is not blown even by self-heating. Then, when an overcurrent exceeding the rating flows through the fuse device 1, the interrupting portion 9 is blown out by the self-heating of the fuse element 2 to disconnect the path between the terminal portions 5*a*, 5*b*, thereby interrupting the current path of the external circuit (FIG. 30 (B)).

At this time, since the heat generated by the high thermal conductivity portion 8 is actively drawn away through the cooling member 3 as described above, the fuse element 2 can selectively overheat the low thermal conductivity portion 7 formed along the interrupting portion 9. Therefore, the fuse element 2 can blow out the interrupting portion 9 while suppressing the effects of heat on the terminal portions 5*a*, 5*b*.

In addition, because the device includes the low melting point metal layer 2*a* having a melting point lower than that of the high melting point metal layer 2*b*, self-heating due to overcurrent starts melting from the melting point of the low melting point metal layer 2*a* and begins to erode the high melting point metal layer 2*b*. Therefore, by utilizing the erosive action of the low melting point metal layer 2*a* on the high melting point metal layer 2*b*, the fuse element 2 melts the high melting point metal layer 2*b* at a temperature lower than its own melting point, thereby achieving quick blowout.

Heat Generator

Furthermore, the fuse device may include a heat generator in the cooling member, and the fuse element may be melted by heat generated by the heat generator. For example, in the fuse device 60 shown in FIG. 31 (A), a heat generator 61 and an electrically insulating layer 62 covering the heat generator 61 are formed on both sides of the groove 10 of one cooling member 3*a*.

The heat generator 61 is a member having conductivity that generates heat when energized, and is made of, for example, nichrome, W, Mo, Ru, or a material containing these materials. The heat generator 61 can be formed by mixing powdered alloy, composition, or compound of these materials with a resin binder to obtain a paste, screen-printing the paste as a pattern on the cooling member 3*a*, and baking the patterned paste.

Furthermore, the heat generator 61 is formed in the vicinity of the low thermal conductivity portion 7 where the interrupting portion 9 of the fuse element 2 is formed by being formed on both sides of the groove 10. Therefore, in the fuse device 60, heat generated by the heat generator 61 can also be transferred to the low thermal conductivity portion 7 to blow out the interrupting portion 9. It should be noted that the heat generator 61 may be formed on only one side of the groove 10, or on both sides or one side of the groove 10 of the other cooling member.

Furthermore, the heat generator 61 is covered with an electrically insulating layer 62. As a result, the heat generator 61 is overlapped with the fuse element 2 via the insulating layer 62. The insulating layer 62 is provided to protect and insulate the heat generator 61 and to efficiently transfer the heat of the heat generator 61 to the fuse element 2, and comprises, for example, a glass layer.

It should be noted that the heat generator 61 may be formed inside the insulating layer 62 laminated on the cooling member 3*a*. Furthermore, the heat generator 61 may be formed on the back surface opposite to the top surface of the cooling member 3*a* on which the groove 10 is formed or may be formed inside the cooling member 3*a*.

Figure 31A:
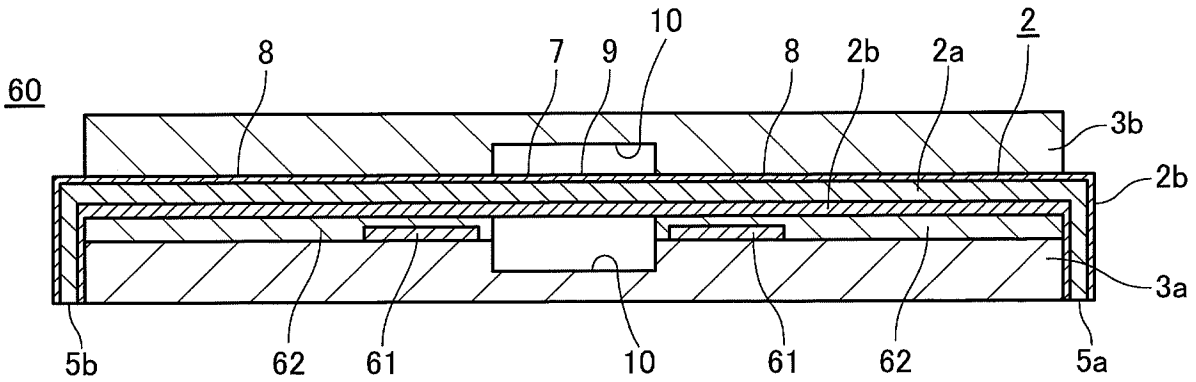
FIG. 31 (A) is a cross-sectional view illustrating a fuse device in which a heat generator is formed in a cooling member, and FIG. 31 (B) is a circuit diagram.
Figure 31B:
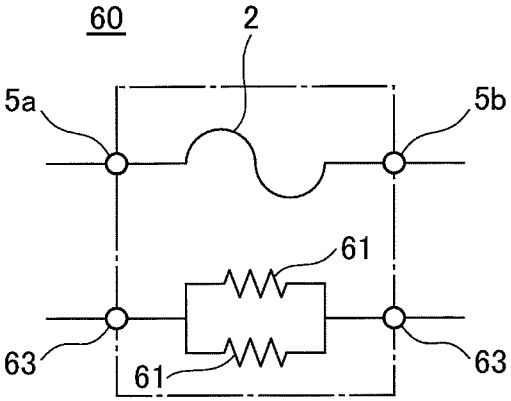

As shown in FIG. 31 (B), the heat generator 61 is connected to an external power supply circuit via the heat generator electrode 63, and when it becomes necessary to interrupt the current path of the external circuit, supplied with current from the external power supply circuit. As a result, the fuse device 60 blows out the interrupting portion 9 of the fuse element 2 incorporated in the current path of the external circuit by heat generated by the heat generator 61 to interrupt the current path of the external circuit. After interrupting the current path of the external circuit, the current path from the power supply circuit is also disconnected, and the heat generator 61 stops temperature increase.

In this case, while the heat of the heat generator 61 is dissipated via the high thermal conductivity portion 8, the fuse element 2 selectively starts melting from the melting point of the low melting point metal layer 2*a* having a melting point lower than that of the high melting point metal layer 2*b* in the low thermal conductivity portion 7 by heat generated by the heat generator 61, and begins to erode the high melting point metal layer 2*b*. In other words, the fuse element 2 utilizes the erosive action of the low melting point metal layer 2*a* on the high melting point metal layer 2*b* to melt the high melting point metal layer 2*b* at a temperature lower than its melting temperature to blow out the interrupting portion 9, thereby promptly interrupting the current path of the external circuit.

Figure 32A:
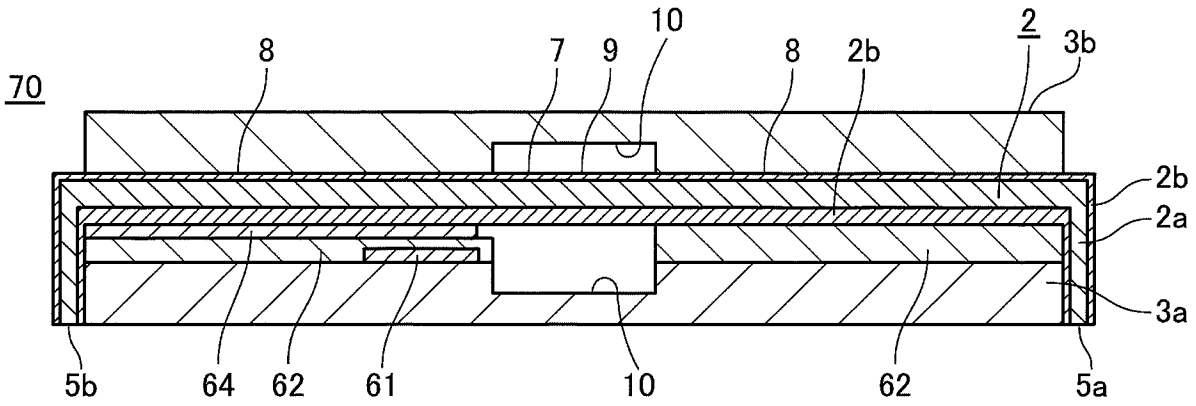
FIG. 32 (A) is a cross-sectional view illustrating a fuse device in which a heat generator lead-out electrode is formed on an insulating layer covering a heat generator, and FIG. 32 (B) is a circuit diagram.
Figure 32B:
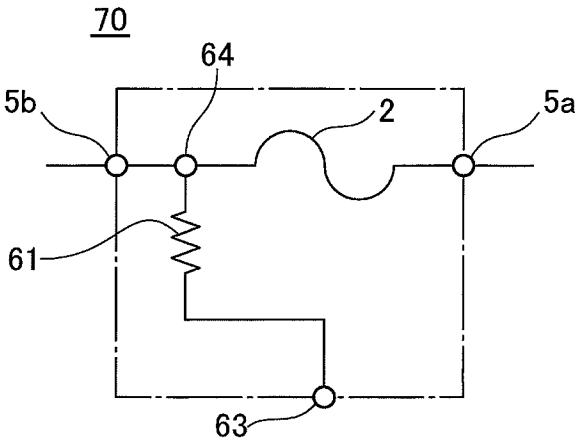

Furthermore, as shown in FIG. 32 (A), in the fuse device 70, the heat generator 61, the insulating layer 62 and the heat generator lead-out electrode 64 may be formed on one side of the groove 10 of the insulating layer 62, for example, only on the left side of the groove 10 to connect the fuse element 2 to the heat generator lead-out electrode 64 via connection solder (not shown). One end of the heat generator 61 is connected to the heat generator lead-out electrode 64 and the other end is connected to the heat generator electrode 63 connected to an external power supply circuit. As a result, the heat generator 61 is thermally and electrically connected to the fuse element 2 via the heat generator lead-out electrode 64. It should be noted that, in the fuse device 70, the insulating layer 62 having excellent thermal conductivity may be provided on the other side (right side in FIG. 32 (A)) opposite to the side of the groove 10 where the heat generator 61 and the other components are provided to align the heights.

In this fuse device 70, a current path to the heat generator 61 is formed, which connects the heat generator electrode 63, the heat generator 61, the heat generator lead-out electrode 64, and the fuse element 2. Furthermore, the fuse device 70 is connected to a power supply circuit for supplying current to the heat generator 61 via the heat generator electrode 63, and the power supply circuit controls the current flowing through the heat generator electrode 63 and the fuse element 2.

The fuse device 70 shown in FIG. 32 has a circuit configuration as shown in FIG. 32 (B). That is, the fuse device 70 has a circuit configuration including the fuse element 2 connected in series with an external circuit via terminal portions 5*a*, 5*b* and the heat generator 61 to generate heat with the current flowing through the fuse element 2 and the heat generator lead-out electrode 64 to blow out the fuse element 2. In the fuse device 70, the terminal portions 5*a*, 5*b* of the fuse element 2 and the heat generator electrode 63 are connected to an external circuit board.

In the fuse device 70 having such a circuit configuration, when it becomes necessary to interrupt the current path of the external circuit, a current control device provided in the external circuit supplies current to the heat generator 61. As a result, in the fuse device 70, the interrupting portion 9 of the fuse element 2 incorporated in the current path of the external circuit is blown by heat generated by the heat generator 61. Therefore, the fuse element 2 reliably blows out the path between the terminal portions 5*a*, 5*b*, and can interrupt the current path of the external circuit.

The fuse device may be provided with a plurality of interrupting portions 9 in the fuse element 2. In the fuse device 80 shown in FIG. 33, two interrupting portions 9 are provided in the fuse element 2 and two grooves 10 are provided at positions of the cooling member 3*a* corresponding to the interrupting portions 9. Furthermore, as shown in FIG. 33, on the surface of the cooling member 3*a* and between the two grooves 10, a heat generator 61, an insulating layer 62 covering the heat generator, and a heat generator lead-out electrode 64 connected to one end of the heat generator 61 and connected to the fuse element 2 are provided in this order.

The cooling member 3*a* is provided with an insulating layer 62, which has substantially the same height as the heat generator lead-out electrode 64, on the opposite side of the groove 10 from the side where the heat generator 61 and other components are provided. Then, the fuse element 2 is mounted on the heat generator lead-out electrode 64 and the insulating layer 62 via connection solder as appropriate and is sandwiched by the pair of cooling members 3*a*, 3*b*. As a result, in the fuse element 2, the interrupting portion 9 overlapped with the groove 10 serves as the low thermal conductivity portion 7, and the portion overlapped with the insulating layer 62 serves as the high thermal conductivity portion 8.

One end of the heat generator 61 is connected to the heat generator lead-out electrode 64 and the other end is connected to the heat generator electrode 63 connected to an external power supply circuit. As a result, the heat generator 61 is thermally and electrically connected to the fuse element 2 via the heat generator lead-out electrode 64.

Figure 33A:
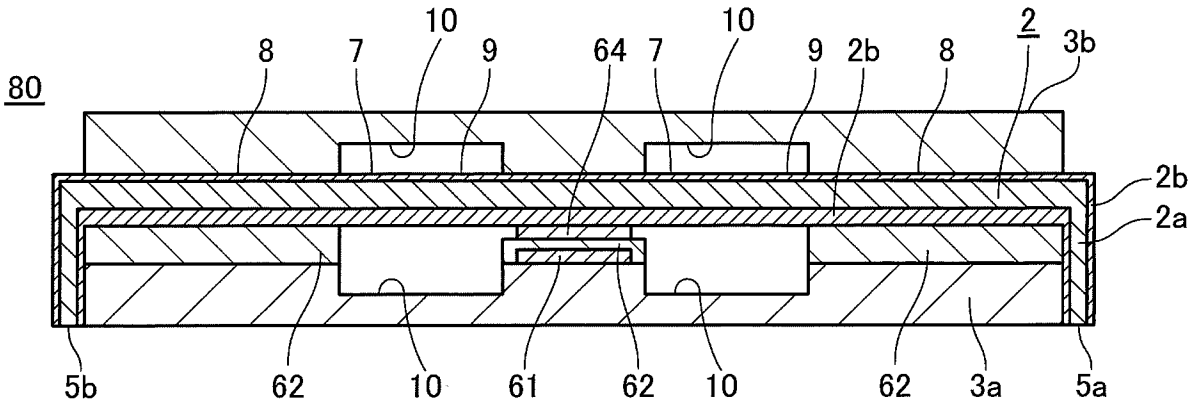
FIG. 33 (A) is a cross-sectional view illustrating a fuse device using a fuse element provided with a plurality of interrupting portions, and FIG. 33 (B) is a circuit diagram.
Figure 33B:
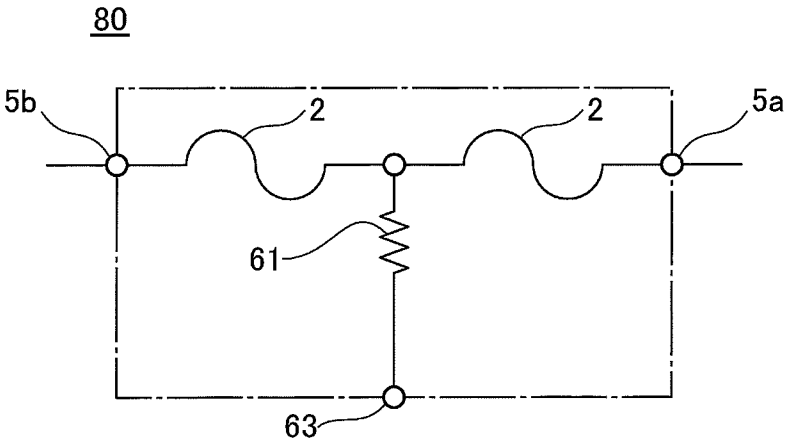

The fuse device 80 shown in FIG. 33 has a circuit configuration as shown in FIG. 33 (B). That is, the fuse device 80 has a circuit configuration including the fuse element 2 connected in series with an external circuit via terminal portions 5*a*, 5*b*, and a heat generator 61 to generate heat with the current flowing from the heat generator electrode 63 to the fuse element 2 to blow out the fuse element 2. In the fuse device 80, the terminal portions 5*a*, 5*b* of the fuse element 2 and the heat generator electrode 63 are connected to the external circuit board.

In the fuse device 80 having such a circuit configuration, when it becomes necessary to interrupt the current path of the external circuit, a current control device provided in the external circuit supplies current to the heat generator 61 for generating heat. Since the heat generated by the heat generator 61 is transmitted to the fuse element 2 through the insulating layer 62 and the heat generator lead-out electrode 64, and the low thermal conductivity portions 7 provided on the left and right are actively heated, the interrupting portion 9 is blown out. Because the fuse element 2 actively cools the heat from the heat generator 61 in the high thermal conductivity portion 8, it is also possible to suppress the effects related to heating the terminal portions 5*a*, 5*b*. As a result, the fuse element 2 reliably blows out the path between the terminal portions 5*a*, 5*b*, and interrupts the current path of the external circuit. In addition, blowing out the fuse element 2 also interrupts the current path of the heat generator 61 so that temperature increase of the heat generator 61 also stops.

Concave Forming Element

Next, a further modified embodiment of the fuse device according to the present disclosure will be described. It should be noted that, in the fuse devices 90 to 160 described below, the same members as those of the above-described fuse devices 1, 20, 30, 40, 50, 60, 70, and 80 are denoted by the same reference signs, and the details thereof are omitted.

Figure 34:
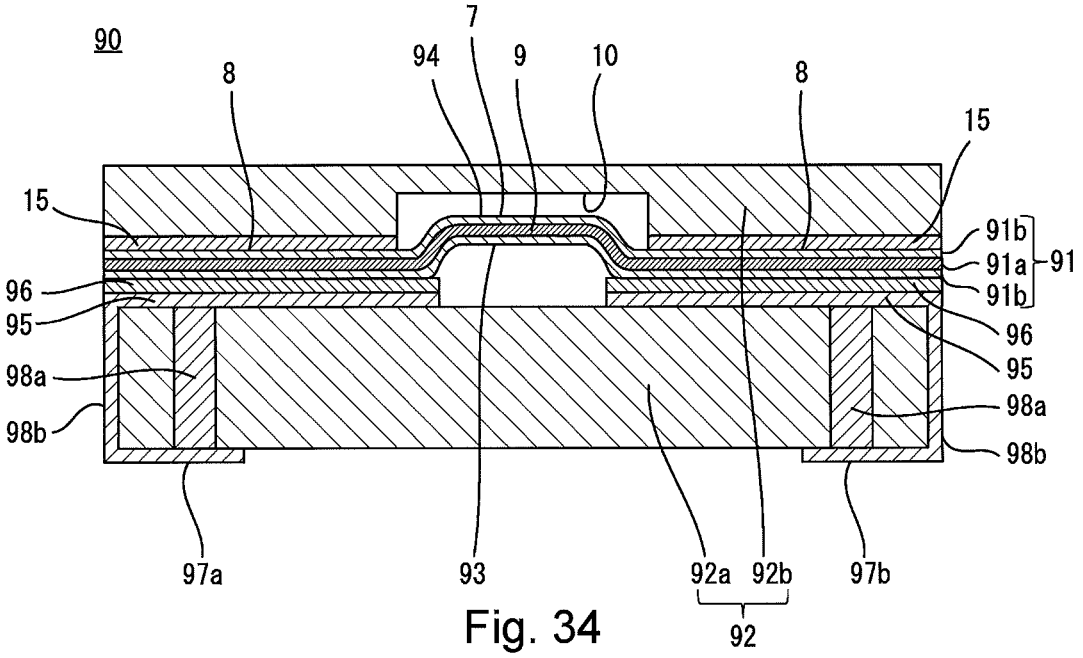
FIG. 34 is a cross-sectional view illustrating an example of a fuse device using a fuse element having a concave.
Figure 35:
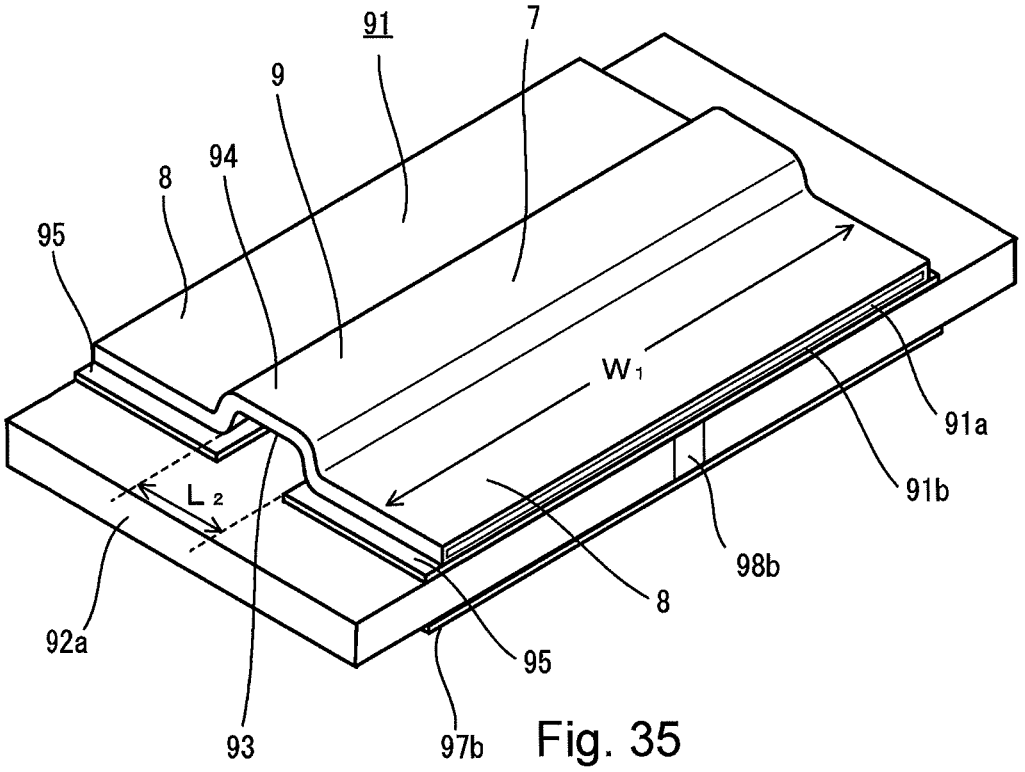
FIG. 35 is a perspective view illustrating a fuse device using a fuse element having a concave, with one of the cooling members omitted.
Figure 36:
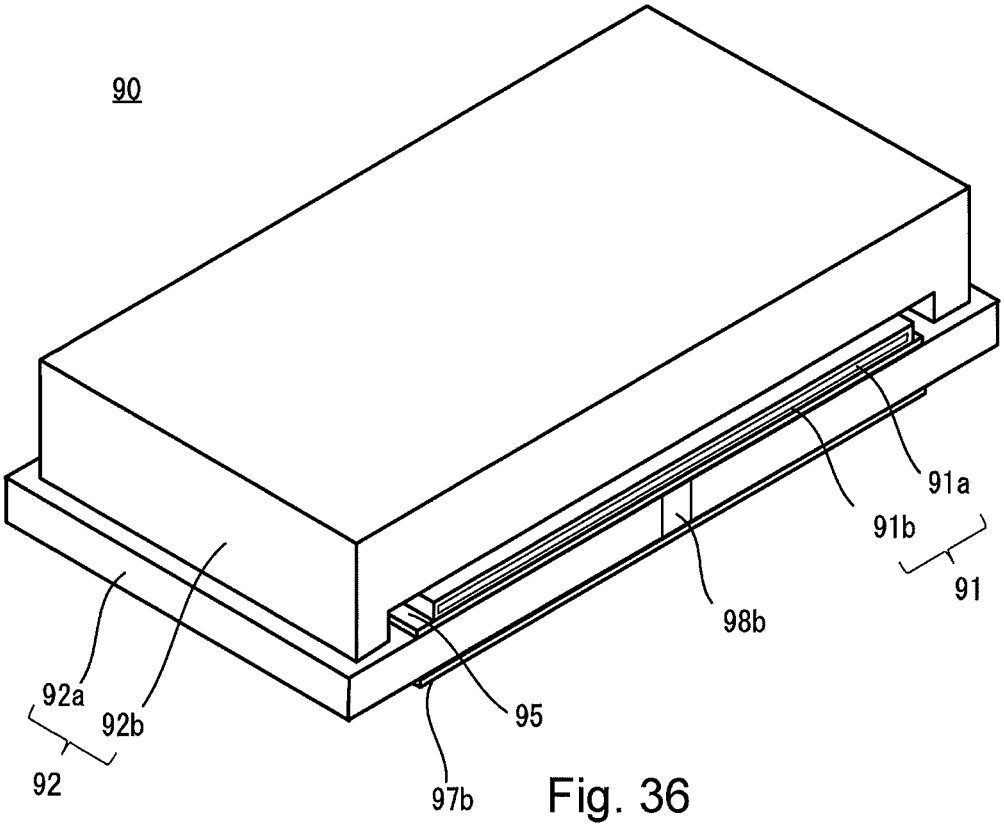
FIG. 36 is an external perspective view illustrating an example of a fuse device using a fuse element having a concave formed therein.

The fuse device 90 shown in FIGS. 34 to 36 includes a fuse element 91 and a cooling member 92; the fuse element 91 is connected on the current path of the external circuit and blown out due to self-heating (Joule heat) by a current exceeding the rating to interrupt the current path, and the cooling member 92 is in contact with or close to the fuse element 91.

The fuse element 91 is provided with a concave 93 in which an interrupting portion 9 is formed with a gap from the cooling member 92. When the fuse element 91 is mounted on the cooling member 92, the concave 93 forms a low thermal conductivity portion 7 having relatively low thermal conductivity by separating the interrupting portion 9 from the cooling member 92 and is formed along the interrupting portion 9 in the width direction orthogonal to the current direction of the fuse element 91.

Figure 37:
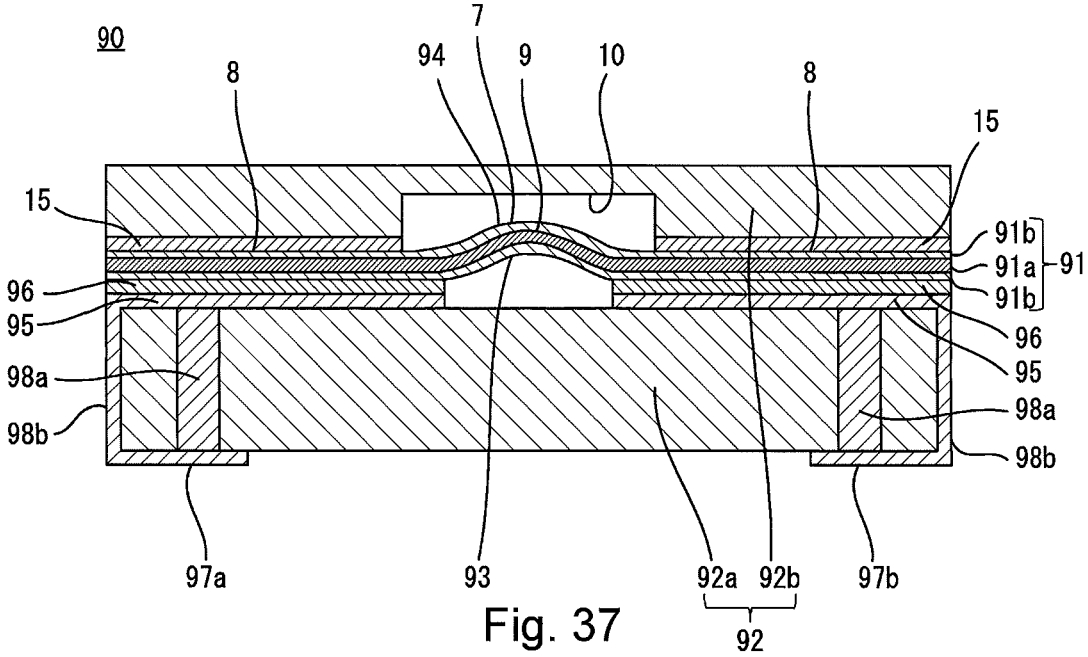
FIG. 37 is a cross-sectional view illustrating an example of a fuse device using a fuse element having a concave formed therein.

Furthermore, as shown in FIG. 34, the concave 93 is formed in a bridge shape so that the portion of the fuse element 91 corresponding to the interrupting portion 9 is spaced apart from the cooling member 92. The bridge-shaped concave 93 may be formed so that its top surface is flat, or it may be formed so that the top surface is curved in an arc shape as shown in FIG. 37. Furthermore, the fuse element 91 is formed with a convex 94 on a surface on the opposite side of the surface on which the bridge-shaped concave is formed, and the convex 94 projects to a level higher than both sides of the concave 93. The concave 93 can be formed by press-molding a plate-like fuse element, for example.

It should be noted that the fuse element 91 has the same structure as the fuse element 2 described above. That is, the fuse element 91 is a low melting point metal such as solder or Pb free solder containing Sn as a primary constituent, or a laminate of low melting point metal and high melting point metal, including a low melting point metal layer 91*a* made of a metal containing Sn as a primary constituent as an inner layer, and a high melting point metal layer 91*b* made of a metal containing Ag, Cu or any one of these as its primary constituent laminated on the low melting point metal layer 91*a* as an outer layer.

It should be noted that, in the fuse element 91, it is preferable to form the volume of the low melting point metal layer 91*a* larger than the volume of the high melting point metal layer 91*b*. The fuse element 91 can melt and blow out promptly by eroding the high melting point metal by melting the low melting point metal by self-heating. Therefore, in the fuse element 91, forming the volume of the low melting point metal layer 91*a* larger than the volume of the high melting point metal layer 91*b* promotes this erosive action, such that the interrupting portion 9 can be promptly interrupted.

In addition, in the fuse device 90, a pair of upper and lower cooling members 92*a*, 92*b* sandwich the fuse element 91 to form a low thermal conductivity portion 7 separated from the cooling member 92*a* by the concave 93 and having a relatively low thermal conductivity, and a high thermal conductivity portion 8 in contact with or close to the cooling members 92*a*, 92*b* and having a relatively high thermal conductivity in the fuse element 91. The low thermal conductivity portion 7 is provided along the interrupting portion 9 in which the fuse element 91 is blown across the width direction orthogonal to the current flow direction of the fuse element 91, and the high thermal conductivity portion 8 is a portion other than the interrupting portion 9, at least a part thereof being in contact with or close to the cooling members 92*a*, 92*b* to form a thermal contact.

As the cooling member 92, an insulating material having high thermal conductivity such as ceramics can be suitably used, and it can be molded into an arbitrary shape by powder molding, among other methods. Furthermore, the cooling member 92 may be formed of a thermosetting or photocurable resin material. Alternatively, the cooling member 92 may be formed of a thermoplastic resin material. Furthermore, the cooling member 92 may be formed of a silicone resin material or an epoxy resin material. In addition, the cooling member 92 may be one in which a resin layer made of the above-described various resin materials is formed on an insulating substrate.

Furthermore, the cooling member 92 preferably has a thermal conductivity of 1 W/(m*k) or more. Although the cooling member 92 may be formed using a metal material, it is preferable to insulate the surface of the cooling member 92 from the viewpoint of prevention of short circuits with surrounding parts and of handling properties. The pair of upper and lower cooling members 92*a*, 92*b* are coupled to each other by, for example, an adhesive, thereby forming a device housing.

Among the pair of cooling members 92*a*, 92*b* sandwiching the fuse element 91, the cooling member 92*b*, which supports the surface of the fuse element 91 opposite to the surface on which the concave 93 is formed, has a groove 10 formed on the surface facing the fuse element 91 at a position corresponding to the convex 94 projecting from the opposite side of the bridge-shaped concave 93, and is separated from the convex 94. Furthermore, the cooling member 92*b* is connected to a portion other than the interrupting portion 9 of the fuse element 91 by the adhesive 15 described above.

The surface of the cooling member 92*a* that supports the surface of the fuse element 91 on which the concave 93 is formed has a flat surface that faces the fuse element 91. Furthermore, the cooling member 92*a* includes a metal layer 95 formed at a position corresponding to the high thermal conductivity portion 8, and the metal layer 95 and the fuse element 91 are electrically and mechanically connected via a conductive connection material such as a solder 96. It should be noted that an electrically conductive adhesive 15 may be used as the connecting material between the cooling member 92*a* and the fuse element 91. Since the cooling members 92*a*, 92*b* and the high thermal conductivity portion 8 of the fuse element 91 are connected via the adhesive 15 and the solder 96 to enhance mutual tight fitting, the fuse device 90 can more efficiently transmit heat to the cooling members 92*a*, 92*b*.

The metal layer 95 is divided into two parts in the current direction of the fuse element 91 at a position in which the concave 93 is formed. The surface of the cooling member 92*a* opposite to the surface on which the fuse element 91 is provided serves as a mounting surface to an external circuit board to which the fuse device 90 is mounted, and a pair of external connection electrodes 97*a*, 97*b* are formed thereon. These external connection electrodes 97*a*, 97*b* are connected to connection electrodes formed on the external circuit board by connection materials such as solder. The external connection electrodes 97*a*, 97*b* are connected to the metal layer 95 via the through holes 98*a* in which the conductive layers are formed and castellations 98*b* formed on the side surfaces of the cooling member 92*a*.

As a result, in the fuse device 90, the pair of external connection electrodes 97*a*, 97*b* are connected via the fuse element 91, and the fuse element 91 constitutes a part of the current path of the external circuit. In addition, the fuse device 90 can interrupt the current path of the external circuit by blowing out the fuse element 91 at the interrupting portion 9.

Figure 38A:
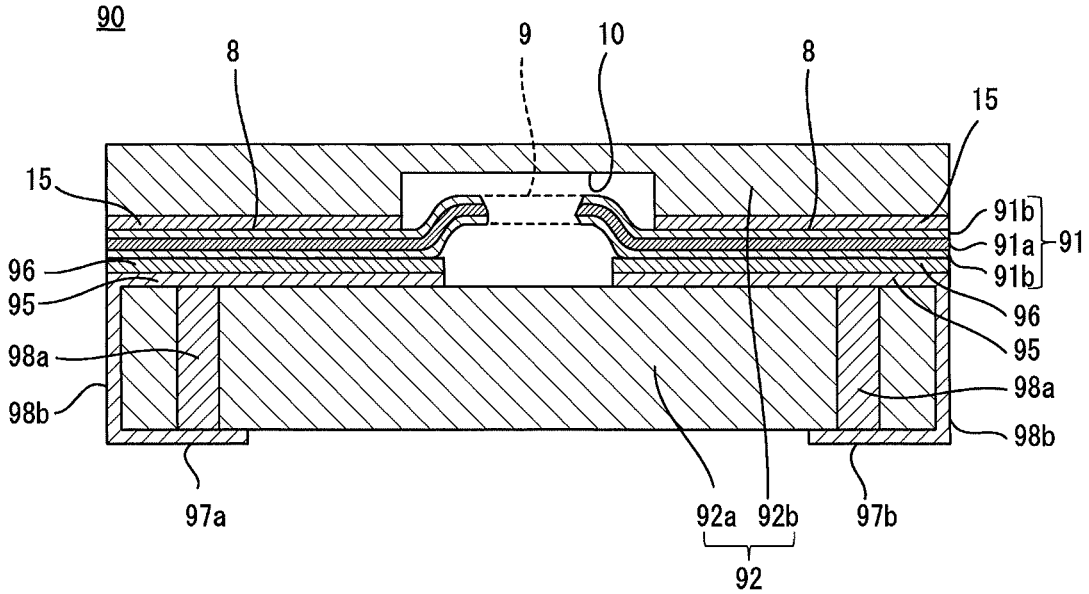
FIG. 38 (A) is a cross-sectional view illustrating a state in which the fuse element of the fuse device shown in FIG. 34 is blown out, and FIG. 38 (B) is a perspective view illustrating a state in which the fuse element is blown out, with one of the cooling members omitted.
Figure 38B:
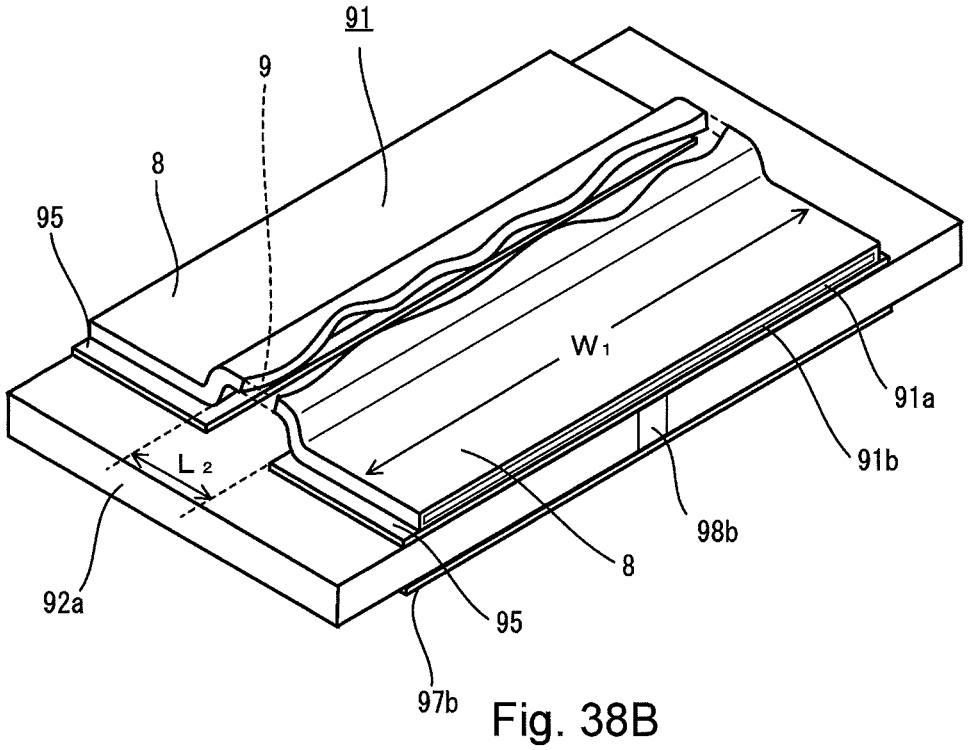

In this case, in the plane of the fuse element 91, the low thermal conductivity portion 7 is provided along the interrupting portion 9, and the high thermal conductivity portion 8 is provided in a portion other than the interrupting portion 9; therefore, as shown in FIG. 38, when the fuse element 91 generates heat at an overcurrent exceeding the rating, the heat of the high thermal conductivity portion 8 is actively dissipated to the outside, and the fuse device 90 can suppress temperature increase in portions other than the interrupting portion 9 and concentrate heat on the low thermal conductivity portion 7 formed along the interrupting portion 9, to blow out the interrupting portion 9 while suppressing the effects of heat on the terminal portions 97*a*, 97*b*. As a result, the fuse device 90 blows out the portion between the external connection electrodes 97*a*, 97*b* of the fuse element 91 and interrupts the current path of the external circuit.

Therefore, the fuse device 90 can solve problems such as melting connection solder for surface mounting, thus realizing size reduction by forming the fuse element 91 into a rectangular plate shape, reducing the length in the current direction to decrease resistance, while improving the current rating to suppress overheating of the terminal portions 97*a*, 97*b* connected to the connection electrodes of the external circuit via connection solder.

It is preferable that the high thermal conductivity portion 8 of the fuse element 91 has an area larger than that of the low thermal conductivity portion 7. This enables the fuse element 91 to selectively heat and blow out the interrupting portion 9, actively dissipate heat from portions other than the interrupting portion 9, and suppress the effects of overheating of the terminal portions 97*a*, 97*b*, thus achieving size reduction and high rating.

In the case of using the fuse element 91 in the form of a substantially rectangular plate as shown in FIG. 35, the length $L_2$ of the concave 93 formed in the fuse element 91 in the current direction of the fuse element 91 is preferably equal to or less than the minimum width of the interrupting portion 9 of the fuse element 91, and more preferably ½ or less of the minimum width of the interrupting portion 9 of the fuse element 91.

The minimum width in the interrupting portion 9 means the minimum width in the width direction orthogonal to the conducting direction of the interrupting portion 9 of the fuse element 91 on the surface of the substantially rectangular plate-like fuse element, and corresponds to the minimum width of the interrupting portion 9 when the interrupting portion 9 has a shape such as an arc shape, a taper shape, a stepped shape, among others and is formed to be narrower than the portion other than the interrupting portion 9, or corresponds to the width $W_1$ of the fuse element 91 when the interrupting portion 9 is formed with the same width as the portion other than the interrupting portion 9 as shown in FIG. 35.

By reducing the length $L_2$ of the concave 93 to be equal to or smaller than the minimum width of the interrupting portion 9 or not more than ½ of the minimum width of the interrupting portion 9, the fuse device 90 can suppress the occurrence of arc discharge at the time of blowout and improve the insulation resistance.

Furthermore, in the fuse device 90 described above, it is preferable that the length $L_2$ of the concave 93 in the current direction of the fuse element 91 is 0.5 mm or more. By providing the low thermal conductivity portion 7 at a length of 0.5 mm or more, the fuse device 90 can form a temperature difference with the high thermal conductivity portion 8 at the time of overcurrent, thereby selectively blowing out the interrupting portion 9.

Furthermore, in the fuse device 90 described above, it is preferable that the length $L_2$ of the concave 93 in the current direction of the fuse element 91 is 5 mm or less. In the fuse device 90, the length $L_2$ of the concave 93 exceeding 5 mm increases the area of the interrupting portion 9 and correspondingly extends the time required for blowing, thus degrading rapid blowout properties, as well as increases the amount of scattering of the fuse element 91 due to arc discharge, resulting in a possibility that the insulation resistance is lowered by the melted metal adhered to the surroundings.

In the above fuse device 90, it is preferable that the minimum gap between the high thermal conductivity portion 8 of the fuse element 91 and the adjacent cooling members 92*a*, 92*b* is 100 μm or less. As described above, the fuse element 91 is sandwiched between the cooling members 92*a*, 92*b*, so that a portion in contact with or close to the cooling members 92*a*, 92*b* serves as the high thermal conductivity portion 8. In this case, by setting the minimum gap between the high thermal conductivity portion 8 of the fuse element 91 and the cooling members 92*a*, 92*b* to 100 μm or less, the portions of the fuse element 91 other than the interrupting portion 9 and the cooling members 92*a*, 92*b* can be brought into close contact with each other, thereby transmitting heat generated at an overcurrent exceeding the rating to the outside via cooling members 92*a* and 92*b*, and selectively blowing out only the interrupting portion 9. In contrast, when the minimum gap between the high thermal conductivity portion 8 of the fuse element 91 and the cooling members 92*a*, 92*b* exceeds 100 μm, the thermal conductivity of these portions decreases, and unexpected portions other than the interrupting portion 9 may be over-heated and melt at an overcurrent exceeding the rating.

Terminal Portion

Figure 39:
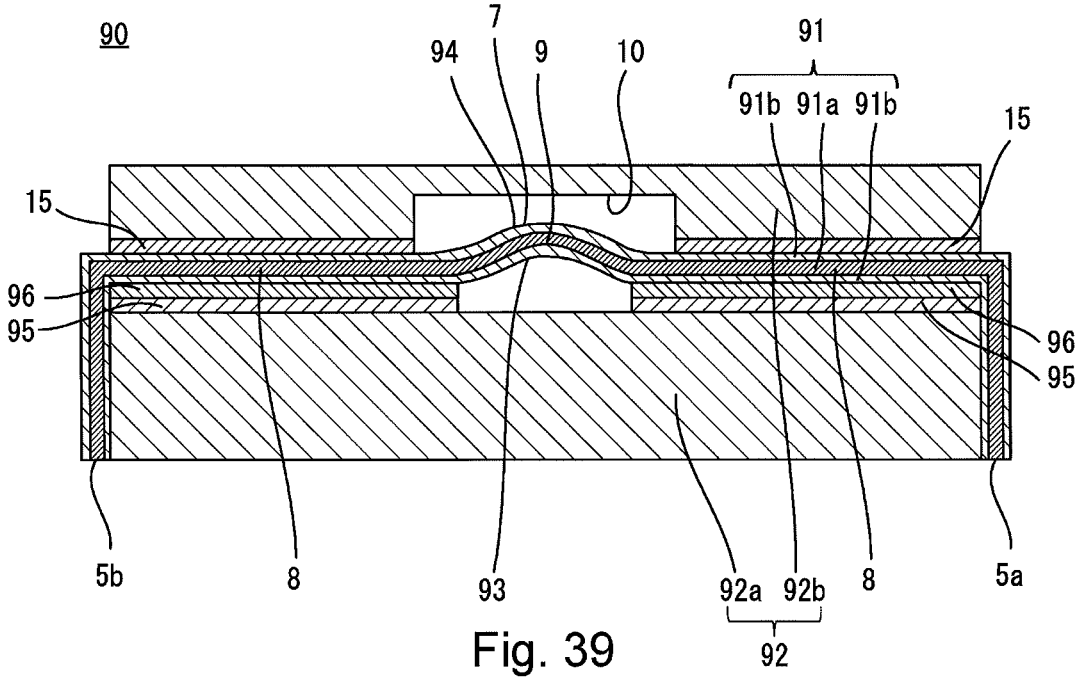
FIG. 39 is a cross-sectional view illustrating an example of a fuse device using a fuse element having both ends as terminal portions.
Figure 40:
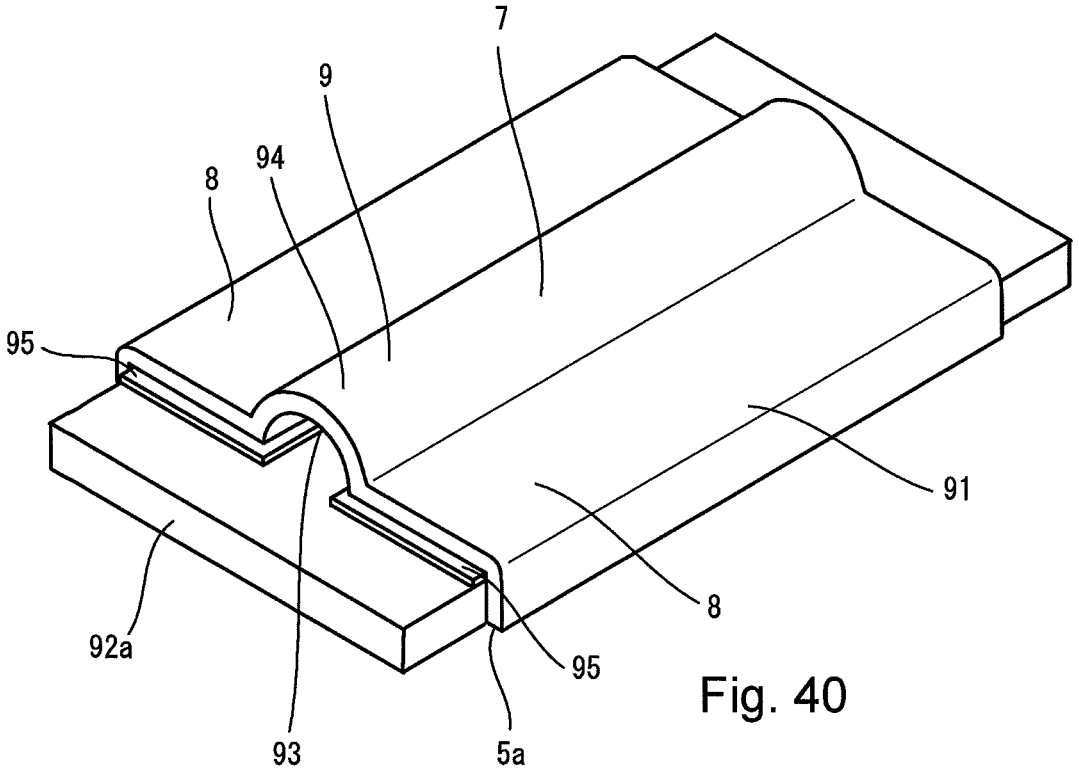
FIG. 40 is a perspective view illustrating a fuse device using a fuse element having both ends as terminal portions, with one of the cooling members omitted.
Figure 41:
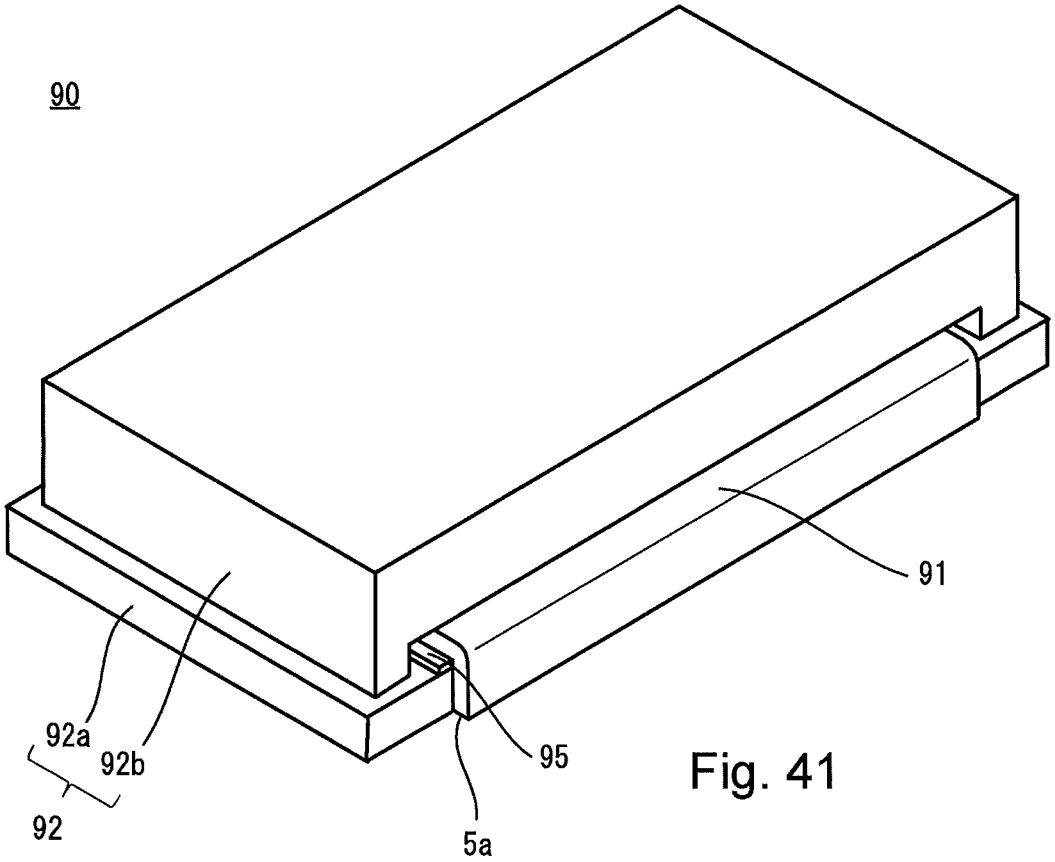
FIG. 41 is an external perspective view illustrating an example of a fuse device using a fuse element having both ends as terminal portions.

Furthermore, as shown in FIGS. 39 to 41, as in the fuse element 2, in the fuse device 90, both ends of the fuse element 91 in the current direction may be terminal portions 5*a* and 5*b* connected to connection electrodes of an external circuit. The terminal portions 5*a* and 5*b* are fitted to the side edges of the cooling member 92*a* so as to be directed toward the back surface of the cooling member 92*a*. The fuse element 91 shown in FIG. 39 is sandwiched between a pair of upper and lower cooling members 92*a*, 92*b* and can be connected to the connection electrodes of the external circuit via a pair of terminal portions 5*a*, 5*b* lead out from the cooling members 92*a*, 92*b*.

By forming, in the fuse element 91, the terminal portions 5*a* and 5*b* serving as connection terminals to the external circuit board, as compared with the case of connecting to the external circuit board through the through hole 98*a*, the castellation 98*b*, and the external connection electrode 97, the resistance of the entire fuse device can be reduced, thereby improving the rating.

In addition, the steps for providing the external connection electrodes 97*a*, 97*b*, the through hole 98*a* and the castellation 98*b* on the cooling member 92*a* can be omitted, thereby simplifying the production process. Although it is not necessary for the cooling member 92*a* to be provided with the external connection electrodes 97*a*, 97*b*, the through hole 98*a* and the castellation 98*b*, they may be provided for cooling or for improving connection strength.

Deformation Restricting Portion

Figure 42:
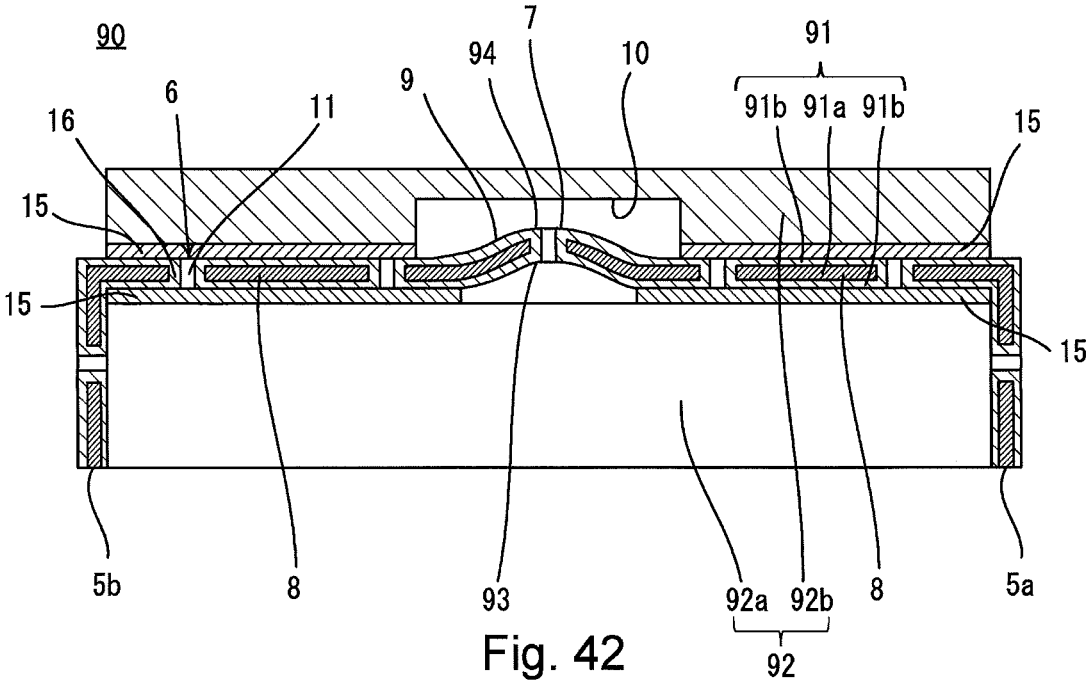
FIG. 42 is a cross-sectional view illustrating an example of a fuse device using a fuse element provided with a deformation restricting portion.
Figure 43:
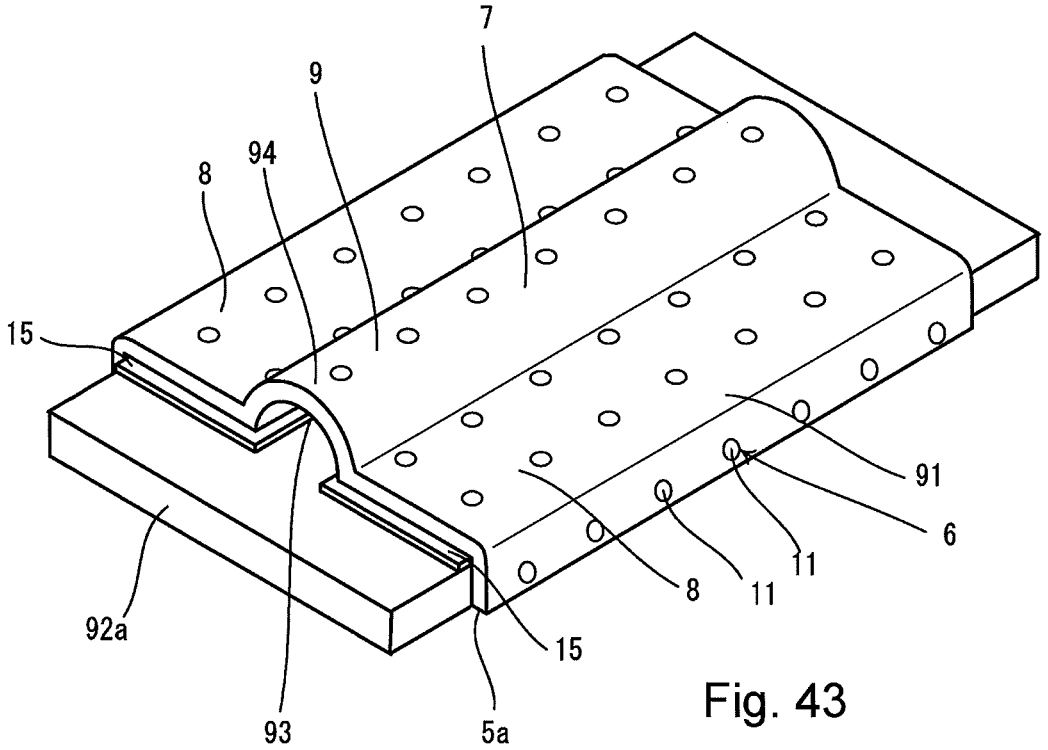
FIG. 43 is a perspective view illustrating a fuse device using a fuse element provided with a deformation restricting portion, with one of the cooling members omitted.
Figure 44:
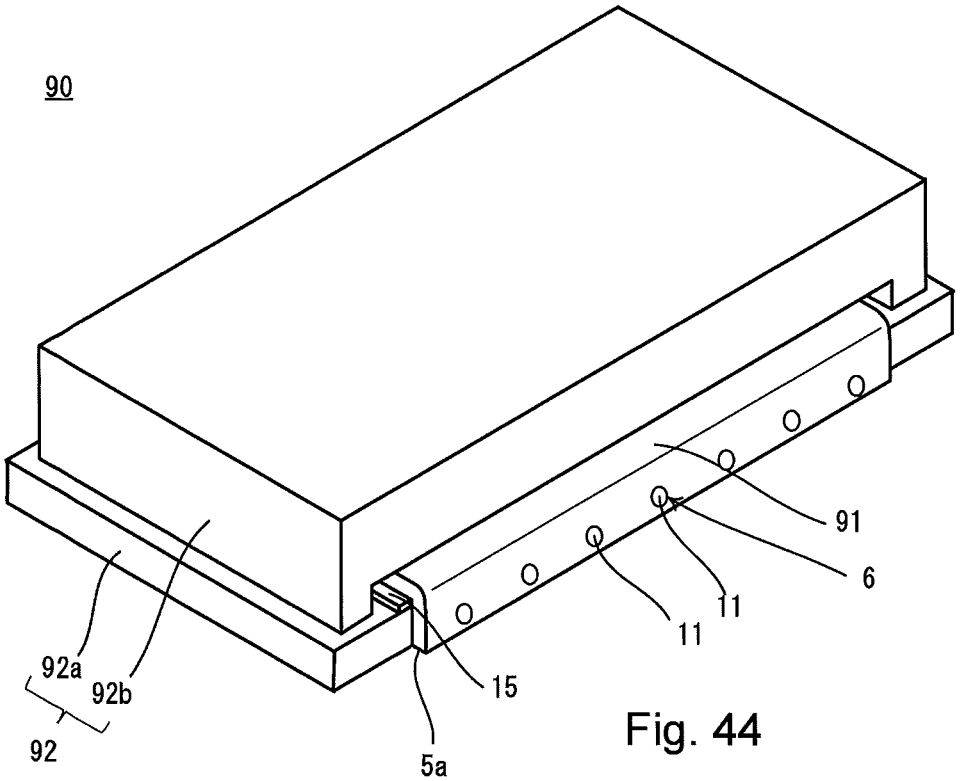
FIG. 44 is an external perspective view illustrating an example of a fuse device using a fuse element provided with a deformation restricting portion.

Furthermore, as shown in FIGS. 42 to 44, the fuse element 91 may be provided with a deformation restricting portion 6 for suppressing the flow of melted low melting point metal and restricting deformation. As described above, by providing the deformation restricting portion 6, it is possible to suppress the deformation of the fuse element 91 within a certain range for suppressing the variation in blowout properties and maintain predetermined blowout properties. Therefore, even when the fuse element 91 has a large area, the fuse device 90 can be reflow mounted, thereby improving the mounting efficiency and the rating.

Also in the fuse element 91, as with the fuse element 2, various configurations of the deformation restricting portion 6 can be applied (see FIGS. 17 to 29).

Figure 45A:
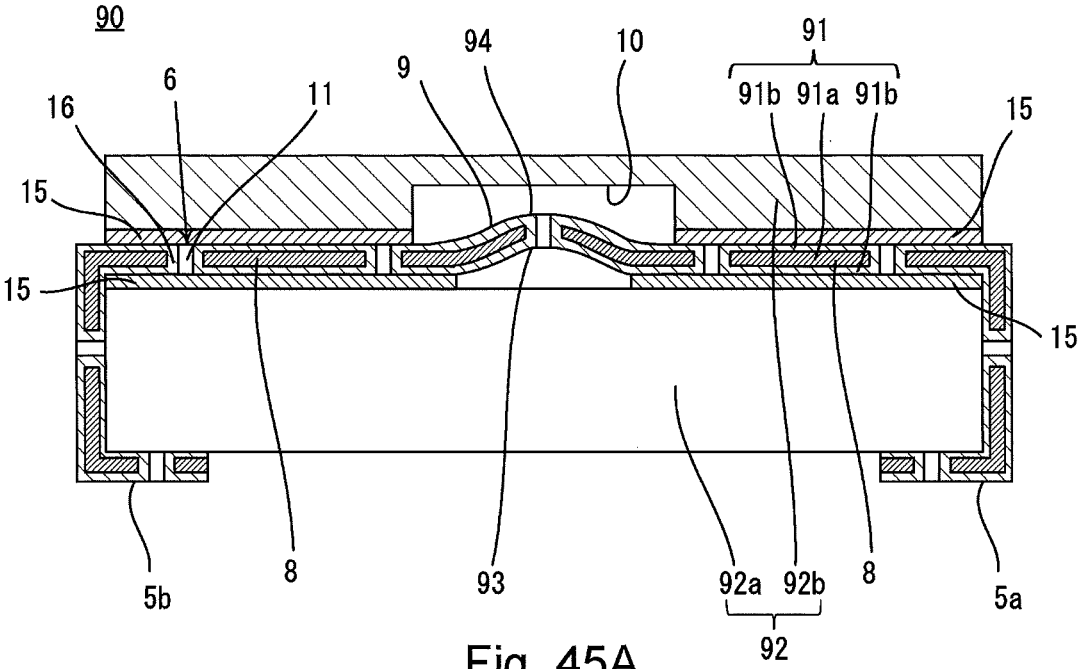
FIG. 45 is a cross-sectional view illustrating an example of a fuse device having terminal portions provided on the back surface of the cooling member.
Figure 45B:
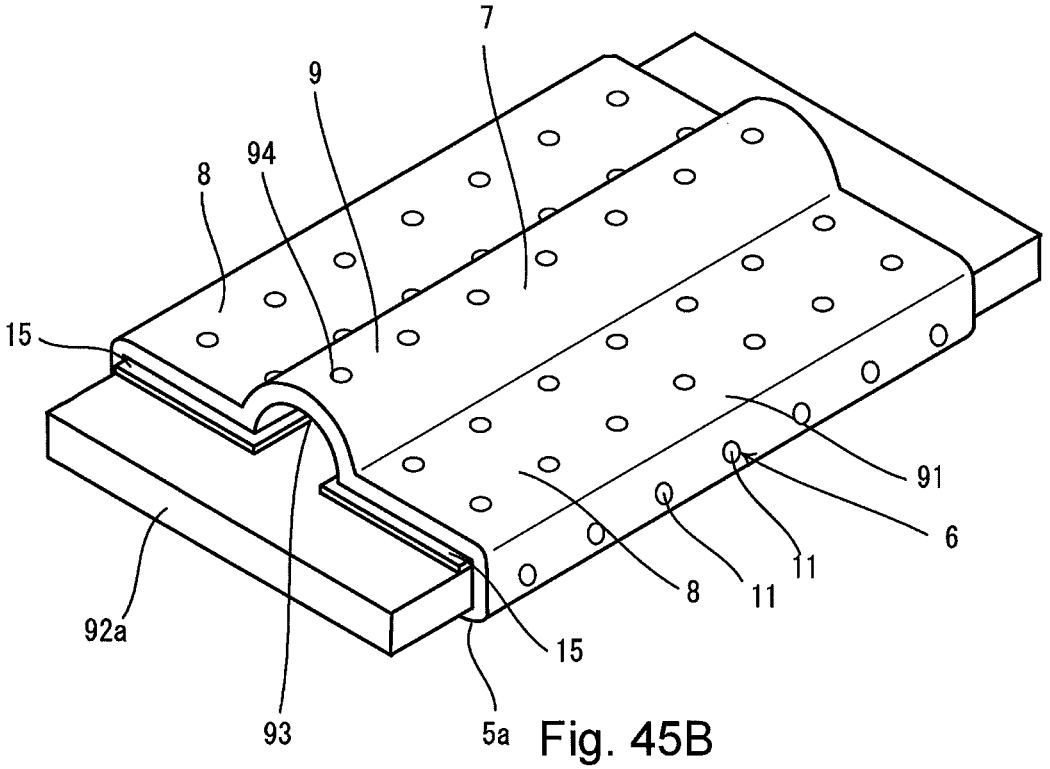

It should be noted that, as shown in FIGS. 45 (A) and (B), while fitting the fuse element 91 to the side surface of the cooling member 92*a*, both ends may be bent toward the back surface of the cooling member 92*a* and the terminal portions 5*a*, 5*b* may be formed on the back surface of the cooling member 92*a*.

As in the fuse element 2, while fitting the fuse element 91 to the side surface of the cooling member 92*a*, both ends may be bent outwardly from the cooling member 92*a* to form the terminal portions 5*a*, 5*b* outside the cooling member 92*a* (see FIG. 19). In this case, the terminal portions 5*a*, 5*b* of the fuse element 91 may be bent so as to be flush with the back surface of the cooling member 92*a*, or alternatively, may be bent so as to protrude from the back surface of the cooling member 92*a*.

By forming the terminal portions 5*a*, 5*b* at positions bent further from the side surface of the cooling member 92*a* to the back surface or outside, the fuse element 91 can suppress outflow of the low melting point metal constituting the inner layer and inflow of the connection solder connecting the terminal portions 5*a*, 5*b* and prevent fluctuation of blowout properties due to local depression or expansion.

As in the fuse device 1, such a fuse device 90 has a circuit configuration shown in FIG. 30 (A). The fuse device 90 is incorporated in a current path of an external circuit by being mounted on the external circuit via the external connection electrodes 97*a*, 97*b* or the terminal portions 5*a*, 5*b*. While a predetermined rated current flows through the fuse element 91, the fuse device 90 is not blown even by self-heating. Then, when an overcurrent exceeding the rating flows through the fuse device 90, the interrupting portion 9 is blown out by the self-heating of the fuse element 91 to disconnect the path between the external connection electrodes 97*a*, 97*b* or the terminal portions 5*a*, 5*b*, thereby interrupting the current path of the external circuit (FIG. 30 (B)).

At this time, since the heat generated by the high thermal conductivity portion 8 is actively cooled through the cooling members 92*a*, 92*b* as described above, the fuse element 91 can selectively overheat the low thermal conductivity portion 7 formed along the interrupting portion 9. Therefore, the fuse element 91 can blow out the interrupting portion 9 while suppressing the effects of heat on the external connection electrodes 97*a*, 97*b* or the terminal portions 5*a*, 5*b*.

In addition, because the device includes the low melting point metal layer 91*a* having a melting point lower than that of the high melting point metal layer 91*b*, self-heating due to overcurrent starts melting from the melting point of the low melting point metal layer 91*a* and begins to erode the high melting point metal layer 91*b*. Therefore, by utilizing the erosive action of the low melting point metal layer 91*a* on the high melting point metal layer 91*b*, the fuse element 91 melts the high melting point metal layer 91*b* at a temperature lower than its own melting point, thereby achieving quick blowout.

Parallel Arrangement of Fuse Element

Figure 46A:
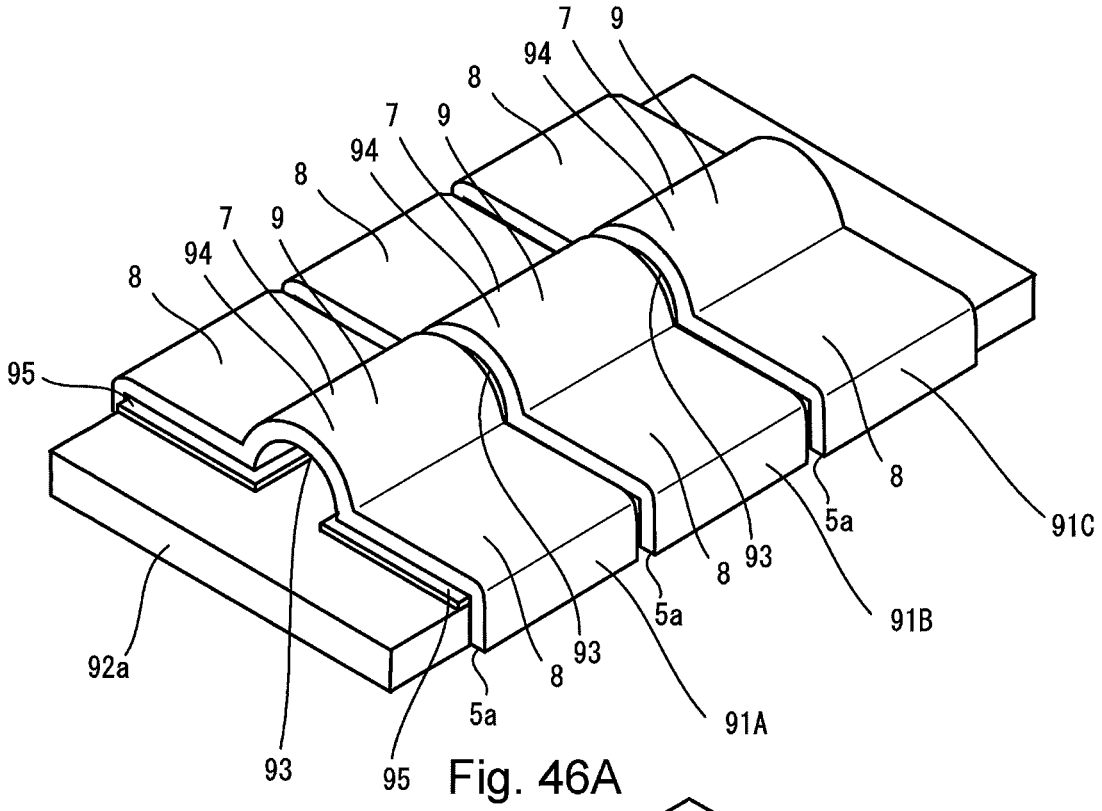
FIG. 46 (A) is a perspective view illustrating a fuse device in which three fuse elements are arranged in parallel, with one of the cooling members omitted, and FIG. 46 (B) is an external perspective view.
Figure 46B:
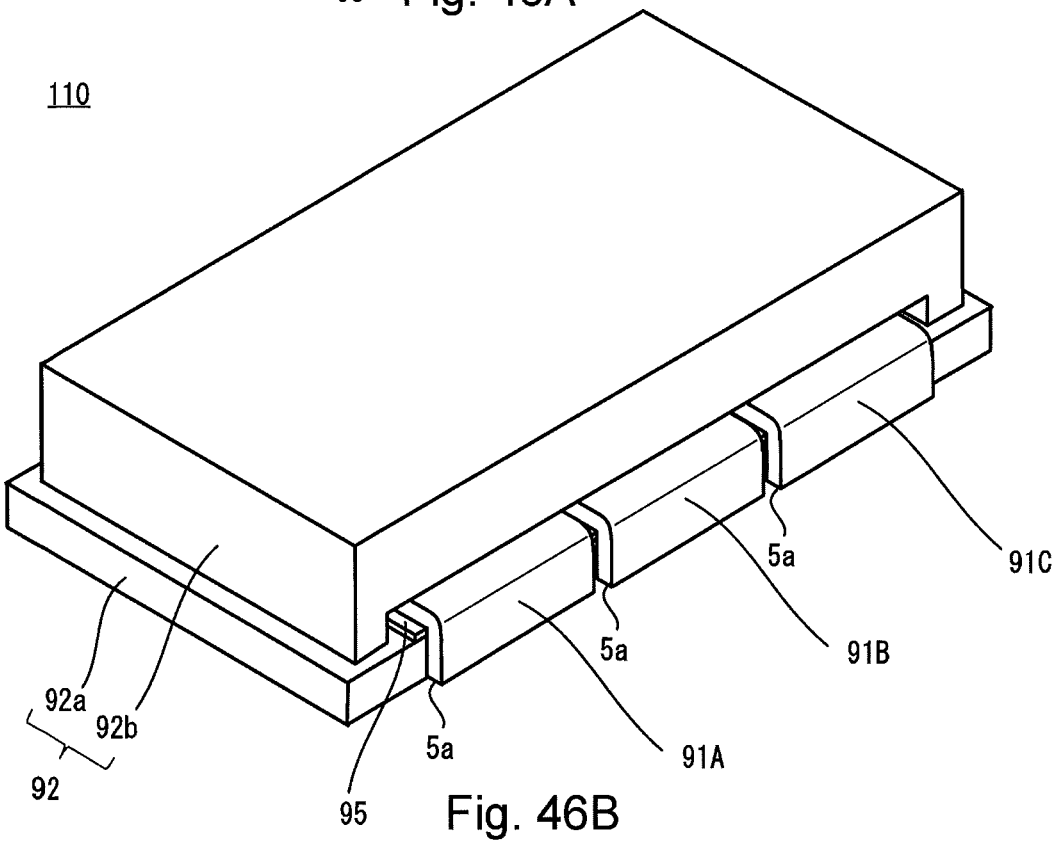

The fuse device may include, as the fuse element, a plurality of fuse elements 91 connected in parallel. As shown in FIGS. 46 (A) and (B), in the fuse device 110, for example, three pieces of fuse elements 91A, 91B, and 91C are arranged in parallel on the cooling member 92*a*. The fuse elements 91A to 91C are formed in a rectangular plate shape, and terminal portions 5*a*, 5*b* are bent at both ends. The fuse elements 91A to 91C are connected in parallel by connecting the respective terminal portions 5*a*, 5*b* to a common connection electrode of an external circuit. As a result, the fuse device 110 has a current rating equivalent to that of the above-described fuse device 90 using one fuse element 91. Each of the fuse elements 91A to 91C is arranged in parallel at a sufficient distance to not contact an adjacent fuse element at the time of blowout.

In the fuse elements 91A to 91C, a concave 93, separated from the cooling member 92*a*, is formed across an interrupting portion 9 which interrupts a current path extending between the terminal portions 5*a*, 5*b*, and the convex 94 projecting to the opposite side of the bridge-shaped concave 93 is separated from the groove 10 formed in the cooling member 92*b*. In this way, in the plane of the fuse elements 91A to 91C, the low thermal conductivity portion 7 is provided along the interrupting portion 9, and the high thermal conductivity portion 8 is formed in a portion other than the interrupting portion 9. When overcurrent exceeding the rating generates heat, the fuse elements 91A to 91C actively dissipate the heat of the high thermal conductivity portion 8 to the outside via the cooling members 92*a*, 92*b*, thereby suppressing temperature increase in portions other than the interrupting portion 9 and concentrating heat on the low thermal conductivity portion 7 formed along the interrupting portion 9 to blow out the interrupting portion 9.

At this time, the fuse elements 91A to 91C are sequentially blown out from one having a lower resistance value through which a larger amount of current flows. The fuse device 110 interrupts the current path of the external circuit by blowing out all the fuse elements 91A to 91C.

As in the above-described fuse device 50, the fuse device 110 sequentially blows out the fuse element 91A to 91C by a current exceeding the rating such that, even when an arc discharge occurs at the time of blowout of the finally remaining fuse element 91, the arc discharge is reduced in size in accordance with the volume of the fuse element 91, thereby preventing melted fuse element from scattering over a wide range to form a new current path by the scattered fuse element, or preventing scattering metal from adhering to terminals, surrounding electronic components, among others. Furthermore, since the fuse device 110 blows out the plurality of fuse elements 91A to 91C one by one, the thermal energy required for blowing out each fuse element can be reduced, thereby achieving rapid interruption.

In addition, the fuse device 110 may control the blowout sequence by making the width of the interrupting portion 9 of one of the plurality of fuse element 91 narrower than the width of the interrupting portion 9 of the other fuse element to relatively increase the resistance. Furthermore, it is preferable that three or more fuse elements 91 are arranged in parallel in the fuse device 110, and the width of at least one fuse element 91 other than the both sides of the parallel arrangement is narrower than the width of the other fuse elements.

For example, in the fuse device 110, a part or the whole of width of the middle fuse element 91B among the fuse elements 91A to 91C is made narrower than the widths of the other fuse elements 91A and 91C to provide a difference in cross-sectional area, thereby relatively increasing the resistance of the fuse element 91B. As a result, when a current exceeding the rating flows, the fuse elements 91A and 91C having relatively low resistance receive a large portion of the current and are blown out first in the fuse device 110. Thereafter, current concentrates on the remaining high-resistance fuse element 91B, and finally blows it out accompanied by arc discharge; however, the arc discharge is reduced in scale in accordance with the volume of the fuse element 91B, thereby preventing explosive scattering of melted metal.

Furthermore, in the fuse device 110, by finally blowing out the fuse element 91B disposed in an inner position, even if an arc discharge occurs, the melted metal of the fuse element 91B can be trapped by the precedingly blown out fuse elements 91A and 91C disposed on outer sides. This suppresses scattering of the melted metal of the fuse element 91B and prevents short circuits, among other problems, caused by the melted metal.

High Melting Point Fuse Element

Figure 47A:
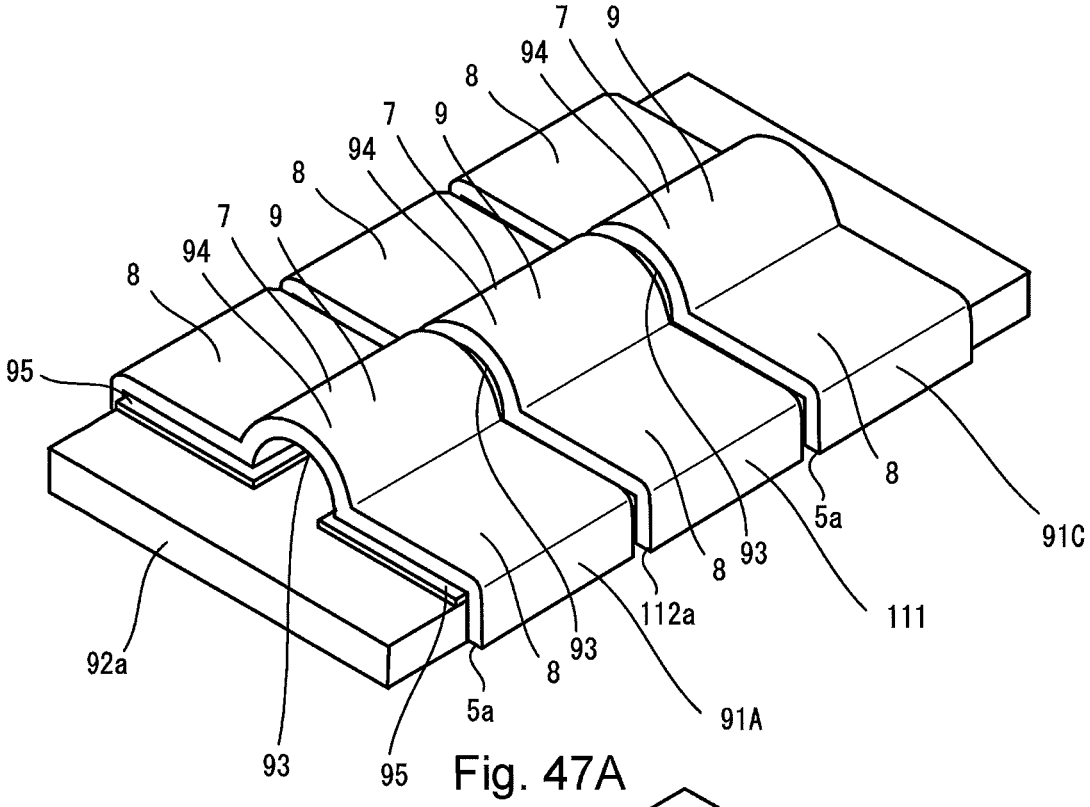
FIG. 47 (A) is a perspective view illustrating a fuse device in which a high melting point fuse element is arranged, with one of the cooling members omitted, and FIG. 47 (B) is an external perspective view.
Figure 47B:
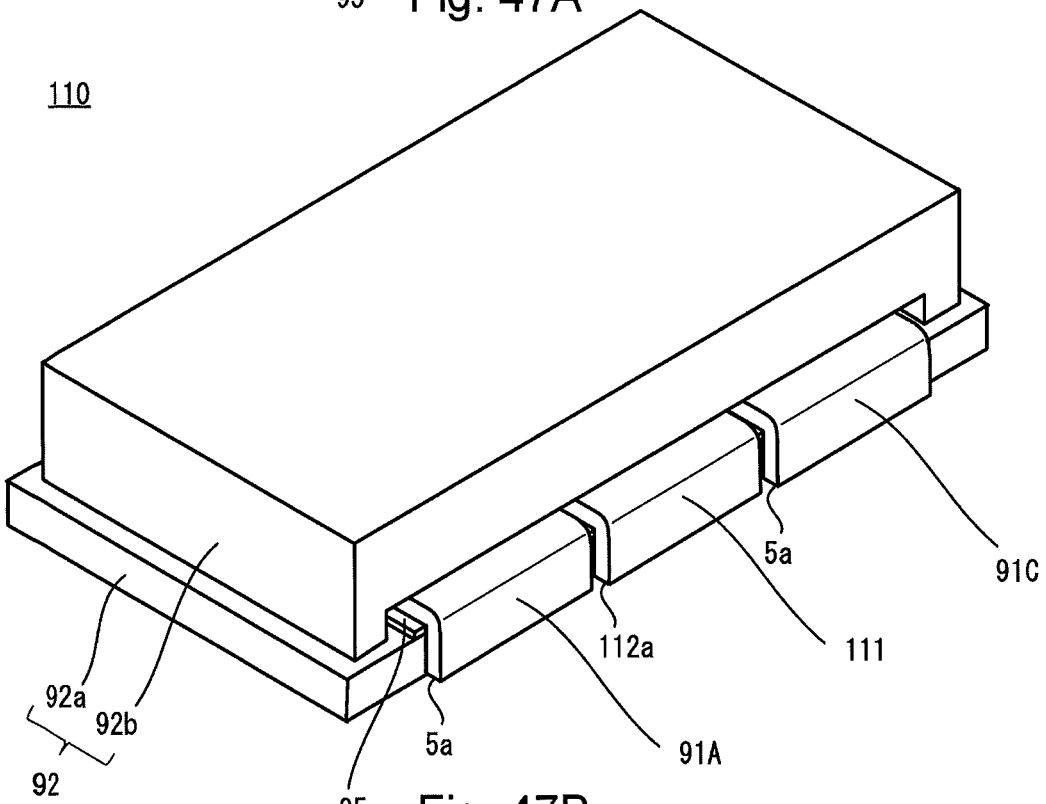

Furthermore, the fuse device 110 may include a high melting point fuse element 111 having a melting temperature higher than that of the fuse element 91, and a plurality of the fuse elements 91 and the high melting point fuse element 111 may be disposed at a predetermined interval. As shown in FIGS. 47 (A) and (B), for example, in the fuse device 110, three pieces of the fuse elements 91A, 91C and the high melting point fuse element 111 are arranged in parallel on the cooling member 92*a*.

As in the high melting point fuse element 51, the high melting point fuse element 111 can be formed using a high melting point metal such as Ag or Cu, or an alloy containing any of these as a primary constituent. In addition, the high melting point fuse element 111 may be composed of a low melting point metal and a high melting point metal.

In addition, the high melting point fuse element 111 can be manufactured in the same manner as the fuse element 91. In this case, the melting point of the high melting point fuse element 111 can be made substantially higher than that of the fuse element 91, for example, by making the thickness of the high melting point metal layer 91*b* thicker than that of the fuse element 91, or by using a high melting point metal having a melting point higher than that of the high melting point metal used for the fuse element 91.

The high melting point fuse element 111 is formed in a substantially rectangular plate shape which is the same as the fuse elements 91A, 91C, and terminal portions 112*a*, 112*b* are bent at both end portions, these terminal portions 112*a*, 112*b*, together with the terminal portions 5*a*, 5*b* of the fuse elements 91A, 91C being connected to the common connection electrode of the external circuit, thus being connected in parallel with the fuse elements 91A, 91C. As a result, the fuse device 110 has a current rating equal to or higher than that of the above-described fuse device 90 using one fuse element 91. It should be noted that the fuse elements 91A, 91C and the high melting point fuse element 111 are arranged in parallel at a sufficient distance to not contact an adjacent fuse element at the time of blowout.

As shown in FIG. 47, as in the fuse elements 91A, 91C, in the high melting point fuse element 111, a concave 93, separated from the cooling member 92*a*, is formed across an interrupting portion 9 which interrupts a current path extending between the terminal portions 112*a*, 112*b*, and the convex 94 projecting to the opposite side of the bridge-shaped concave 93 is separated from the groove 10 formed in the cooling member 92*b*. In this way, in the plane of the fuse element 111, the low thermal conductivity portion 7 is provided along the interrupting portion 9, and the high thermal conductivity portion 8 is formed in a portion other than the interrupting portion 9. When overcurrent exceeding the rating generates heat, the fuse element 111 actively dissipates the heat of the high thermal conductivity portion 8 to the outside, thereby suppressing temperature increase in portions other than the interrupting portion 9 and concentrating heat on the low thermal conductivity portion 7 formed along the interrupting portion 9 to blow out the interrupting portion 9.

In the fuse device 110 shown in FIG. 47, the fuse elements 91A, 91C having a low melting point are blown out first at an overcurrent exceeding the rating, and the high melting point fuse element 111 having a high melting point is blown out last. Therefore, the high melting point fuse element 111 can be interrupted in a short time in accordance with its volume, in addition, even when an arc discharge occurs at the time of blowout of the finally remaining high melting point fuse element 111, the arc discharge is reduced in size in accordance with the volume of the high melting point fuse element 111, so that explosive scattering of melted metal can be prevented, thereby significantly improving the insulation property after blowout. The fuse device 110 interrupts the current path of the external circuit by blowing out all the fuse elements 91A, 91C and the high melting point fuse element 111.

It is preferable that the high melting point fuse element 111 is disposed in a place other than both sides of the parallel arrangement in parallel with the fuse element 91. For example, as shown in FIG. 47, the high melting point fuse element 111 is preferably disposed between the two fuse elements 91A, 91C.

By finally blowing out the high melting point fuse element 111 disposed in an inner position, even if an arc discharge occurs, the melted metal of the high melting point fuse element 111 can be trapped by the precedingly blown out fuse elements 91A, 91C disposed on outer sides and it is possible to suppress scattering of the melted metal of the high melting point fuse element 111 and to prevent short circuits, among other problems, caused by the melted metal.

Element with Parallel Interrupting Portions

Figure 48:
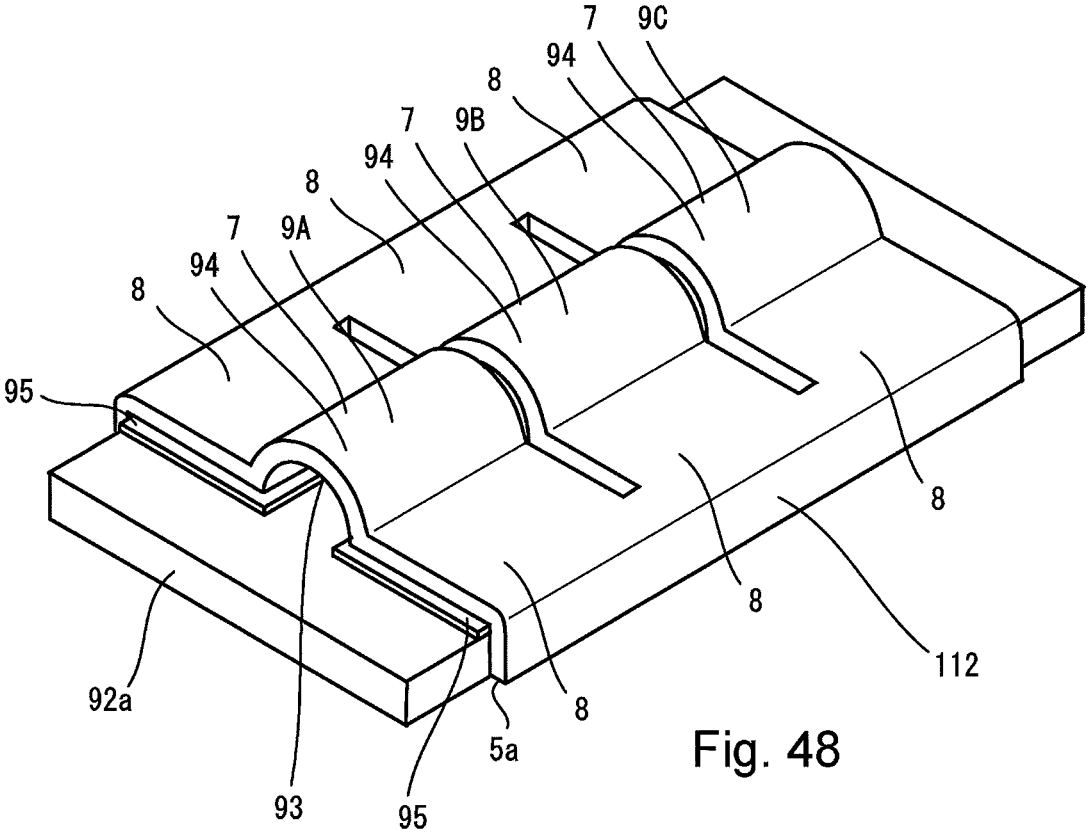
FIG. 48 is a perspective view illustrating a fuse device using a fuse element in which a plurality of interrupting portions are arranged in parallel, with one of the cooling members omitted.

In addition, as shown in FIG. 48, the fuse device according to the present disclosure may use the fuse element 112 in which a plurality of interrupting portions 9 are arranged in parallel. In the description of this fuse element, the same components as those of the above-described fuse element 91 are denoted by the same reference numerals, and details thereof are omitted.

The fuse element 112 is formed in a plate shape, and terminal portions 5*a*, 5*b* connected to an external circuit are provided at both ends. In the fuse element 112, a plurality of interrupting portions 9 are formed between a pair of terminal portions 5*a*, 5*b* and at least one, preferably all, of the interrupting portions 9 are formed with concaves 93 which are spaced apart from the cooling member 92*a*. It should be noted that the fuse element 112 preferably contains a low melting point metal layer and a high melting point metal layer as in the above-described fuse element 91 and can be formed with various configurations.

Hereinafter, a case where the fuse element 112 in which the three interrupting portions 9A to 9C are arranged in parallel will be described as an example. As shown in FIG. 48, the interrupting portions 9A to 9C are mounted across the terminal portions 5*a*, 5*b*, thereby constituting a plurality of current paths of the fuse element 112. Then, the plurality of interrupting portions 9A to 9C are blown by self-heating due to overcurrent, and by blowing out all the interrupting portions 9A to 9C, the current path extending between the terminal portions 5*a*, 5*b* is interrupted.

It should be noted that the fuse element 112 sequentially blows out the interrupting portions 9A to 9C when a current exceeding the rating flows therethrough such that arc discharge generated at the time of the blowout of the finally remaining interrupting portion 9 is reduced in size, thereby preventing the melted fuse element from scattering over a wide range to form a new current path by the scattered metal, or preventing scattering metal from adhering to terminals and surrounding electronic components, among others. In addition, since the fuse element 112 blows out the plurality of interrupting portions 9A to 9C one by one, the thermal energy required for blowing out the interrupting portions 9A to 9C can be reduced, thereby achieving rapid interruption.

In the fuse element 112, the cross sectional area of a part or the whole of one interrupting portion 9 among the plurality of interrupting portions 9A to 9C may be smaller than the cross sectional area of the other interrupting portion to relatively increase the resistance. In addition, in the fuse element 112, it is preferable to provide three or more interrupting portions and to blow out the inner interrupting portion last; for example, as shown in FIG. 48, three interrupting portions 9A, 9B, and 9C are provided, and the middle interrupting portion 9B is blown out last.

By relatively increasing the resistance of one interrupting portion 9, when a current exceeding the rating flows, a large amount of electric current flows through the other interrupting portions 9 of the fuse element 91 having a relatively low resistance to blow them out first. Thereafter, the current concentrates in the remaining high-resistance interrupting portion 9 and finally blows it out accompanied by arc discharge. Therefore, the fuse element 112 can sequentially blow out the interrupting portions 9A to 9C, and arc discharge occurs only when the interrupting portion 9 having a small cross-sectional area is blown out, thereby reducing the arc discharge in size in accordance with the volume of the interrupting portion 9 and preventing explosive scattering of melted metal.

Even if an arc discharge occurs at the time of the last blowout of the middle interrupting portion 9B, the melted metal of the interrupting portion 9B can be trapped by the precedingly blown out interrupting portions 9A, 9C disposed on outer sides and it is possible to suppress scattering of the melted metal of the interrupting portion 9B and to prevent short circuits, among other problems, due to the melted metal.

Figure 49A:
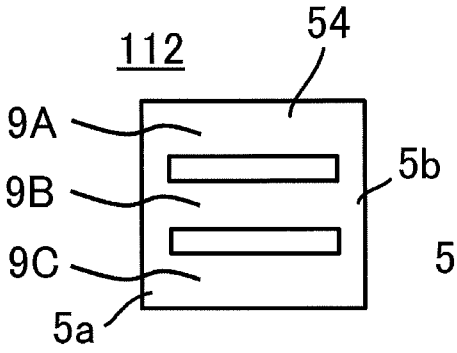
FIG. 49 is a plan view for explaining a manufacturing process of a fusible conductor having a plurality of interrupting portions, wherein (A) illustrates a case in which both sides of an interrupting portion are integrally supported by terminal portions, and (B) illustrates a case in which one side of the interrupting portion is integrally supported by a terminal portion.
Figure 49B:
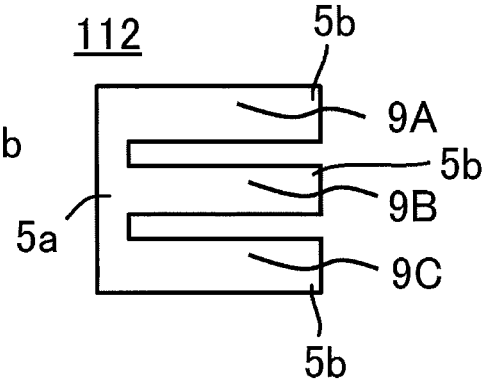

As shown in FIG. 49 (A), the fuse element 112 on which the plurality of interrupting portions 9 are formed as described above can be formed, for example, by punching out two portions near the center of the plate-shaped body 113 including the plate-like low melting point metal and the high melting point metal in rectangular shapes, and then forming the concave 93 and the terminal portions 5*a*, 5*b* by press molding. The fuse element 112 is integrally supported by the terminal portions 5*a*, 5*b* on both sides of three parallel interrupting portions 9A to 9C. Furthermore, the fuse element 112 provided may be manufactured by connecting a plate-like body constituting the terminal portions 5*a*, 5*b* and a plurality of plate-like bodies constituting the interrupting portion 9. Alternatively, as shown in FIG. 49 (B), the fuse element 112 may have one end at which the three parallel interrupting portions 9A to 9C are supported integrally by the terminal portion 5*a*, and the terminal portions 5*b* may be formed at the other end.

Heat Generator

Furthermore, the fuse device may include a heat generator in the cooling member, and the fuse element may be melted by heat generated by the heat generator. For example, in the fuse device 120 shown in FIG. 50 (A), the heat generators 61 are formed on both sides of a position of the cooling member 92*a* facing the low thermal conductivity portion 7, and the heat generators 61 are covered with the insulating layer 62.

As described above, the heat generator 61 is a member having conductivity that generates heat when energized, and is made of, for example, nichrome, W, Mo, Ru, or a material containing these materials, which can be formed on the cooling member 92*a* by using a screen printing technique.

Furthermore, the heat generator 61 is provided in the vicinity of the low thermal conductivity portion 7 where the interrupting portion 9 of the fuse element 91 is formed. Therefore, in the fuse device 120, heat generated by the heat generator 61 can also be transferred to the low thermal conductivity portion 7 to blow out the interrupting portion 9. It should be noted that the heat generator 61 may be formed on only one side of the position facing the low thermal conductivity portion 7 or on both sides or one side of the groove 10 of the other cooling member 92*b*.

Furthermore, the heat generator 61 is covered with an electrically insulating layer 62. As a result, the heat generator 61 is overlapped with the fuse element 91 via the insulating layer 62. The insulating layer 62 is provided to protect and insulate the heat generator 61 and to efficiently transfer the heat of the heat generator 61 to the fuse element 91, and comprises, for example, a glass layer.

It should be noted that the heat generator 61 may be formed inside the insulating layer 62 laminated on the cooling member 92*a*. Furthermore, the heat generator 61 may be formed on the back surface opposite to the top surface of the cooling member 92*a* or may be formed inside the cooling member 92*a*.

Figure 50A:
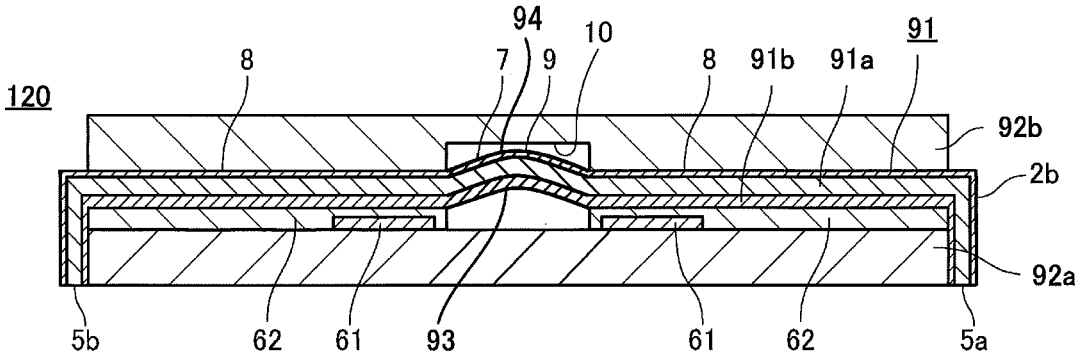
FIG. 50 (A) is a cross-sectional view illustrating an example of a fuse device in which a heat generator is formed in a cooling member, and FIG. 50 (B) is a circuit diagram.
Figure 50B:
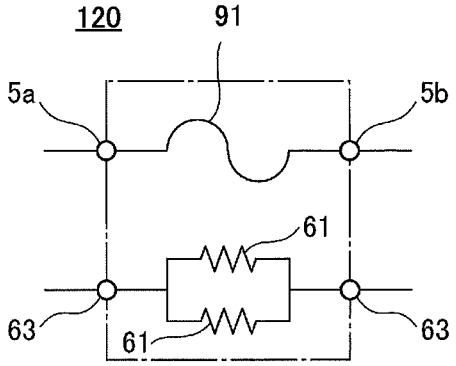

As shown in FIG. 50 (B), the heat generator 61 is connected to an external power supply circuit via the heat generator electrode 63, and when it becomes necessary to interrupt the current path of the external circuit, supplied with current from the external power supply circuit. As a result, the fuse device 120 blows out the interrupting portion 9 of the fuse element 91 incorporated in the current path of the external circuit with heat generated by the heat generator 61 to interrupt the current path of the external circuit. After interrupting the current path of the external circuit, the current from the power supply circuit is disconnected, and the heat generator 61 stops generating heat.

In this case, while the heat of the heat generator 61 is dissipated via the high thermal conductivity portion 8, the fuse element 91 starts melting from the melting point of the low melting point metal layer 91*a* having a melting point lower than that of the high melting point metal layer 91*b* selectively in the low thermal conductivity portion 7 by heat generated by the heat generator 61, such that the interrupting portion 9 is promptly melted by the erosive action on the high melting point metal layer 91*b*, and the current path of the external circuit can be interrupted.

Figure 51A:
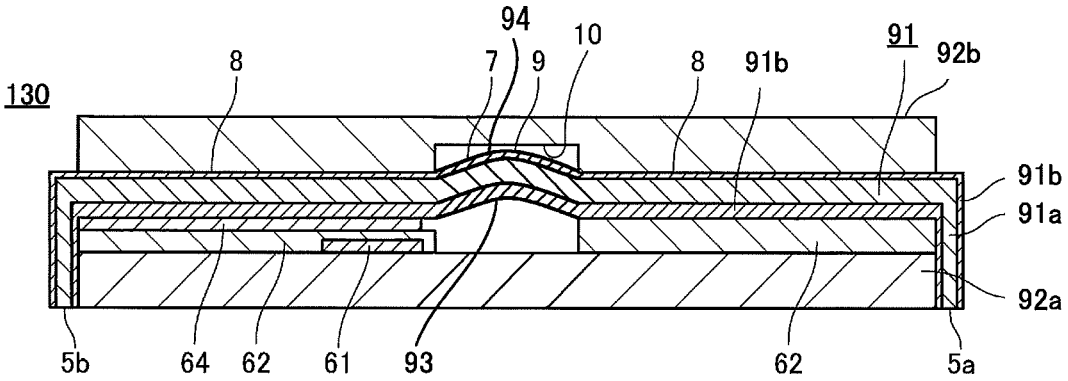
FIG. 51 (A) is a cross-sectional view illustrating an example of a fuse device in which a heat generator lead-out electrode is formed on an insulating layer covering a heat generator, and FIG. 51 (B) is a circuit diagram.
Figure 51B:
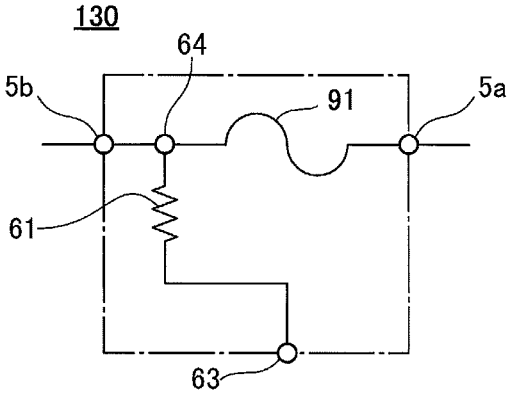

Alternatively, the fuse device may have a configuration of a fuse device 130 shown in FIG. 51 (A) in which the heat generator 61, the insulating layer 62 and the heat generator lead-out electrode 64 are formed on one side of the position of the insulating layer 62 facing the low thermal conductivity portion 7, for example, only on the left side surface, to connect the fuse element 91 to the heat generator lead-out electrode 64 via connection solder (not shown). One end of the heat generator 61 is connected to the heat generator lead-out electrode 64 and the other end is connected to the heat generator electrode 63 connected to an external power supply circuit. The heat generator lead-out electrode 64 is connected to the fuse element 91. As a result, the heat generator 61 is thermally and electrically connected to the fuse element 91 via the heat generator lead-out electrode 64. In the fuse device 130, an electrically insulating layer 62 having excellent thermal conductivity may be provided on the side (the right side in FIG. 51 (A)) opposite to the side of the low thermal conductivity portion 7 where the heat generator 61 and other components are provided to align the heights.

In this fuse device 130, a current path to the heat generator 61 is formed, which connects the heat generator electrode 63, the heat generator 61, the heat generator lead-out electrode 64, and the fuse element 91. Furthermore, the fuse device 130 is connected to a power supply circuit for supplying current to the heat generator 61 via the heat generator electrode 63, and the power supply circuit controls the current flowing through the heat generator electrode 63 and the fuse element 91.

The fuse device 130 has a circuit configuration as shown in FIG. 51 (B). That is, the fuse device 130 has a circuit configuration including the fuse element 91 connected in series with an external circuit via the terminal portions 5*a*, 5*b*, and the heat generator 61 to generate heat with the current flowing through the fuse element 91 and the heat generator lead-out electrode 64 to blow out the fuse element 91. In the fuse device 130, the terminal portions 5*a*, 5*b* of the fuse element 91 and the heat generator electrode 63 are connected to the external circuit board.

In the fuse device 130 having such a circuit configuration, when it becomes necessary to interrupt the current path of the external circuit, a current control device provided in the external circuit supplies current to the heat generator 61. Accordingly, in the fuse device 130, the heat generated by the heat generator 61 blows out the interrupting portion 9 of the fuse element 91 incorporated in the current path of the external circuit. As a result, the fuse element 91 reliably blows out the path between the terminal portions 5*a*, 5*b*, and interrupts the current path of the external circuit.

Furthermore, the fuse device may be provided with a plurality of interrupting portions 9 in the fuse element 91. In the fuse device 140 shown in FIG. 52 (A), two interrupting portions 9 are provided in the fuse element 91; the heat generator 61, the insulating layer 62 covering the heat generator, and a heat generator lead-out electrode 64 connected to one end of the heat generator 61 and connected to the fuse element 91 are provided in this order in a portion of the cooling member 92*a* between the portions facing the two interrupting portions 9.

In addition, the cooling member 92*a* is provided with insulating layers 62, which have substantially the same height as that of the heat generator lead-out electrode 64, on both sides of the heat generator 61. Then, the fuse element 91 is mounted on the heat generator lead-out electrode 64 and the insulating layer 62 via connection solder as appropriate and is sandwiched by the pair of cooling members 92*a*, 92*b*. As a result, in the fuse element 91, the interrupting portion 9 separated from the cooling member 92*a* by the concave 93 serves as the low thermal conductivity portion 7, and the portion overlapping the insulating layer 62 serves as the high thermal conductivity portion 8.

One end of the heat generator 61 is connected to the heat generator lead-out electrode 64 and the other end is connected to the heat generator electrode 63 connected to an external power supply circuit. As a result, the heat generator 61 is thermally and electrically connected to the fuse element 91 via the heat generator lead-out electrode 64.

Figure 52A:
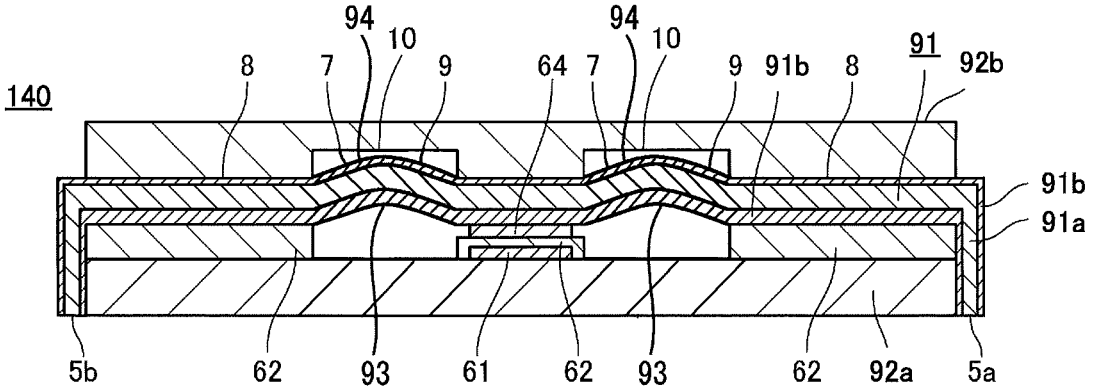
FIG. 52 (A) is a cross-sectional view illustrating an example of a fuse device using a fuse element provided with a plurality of interrupting portions, and FIG. 52 (B) is a circuit diagram.
Figure 52B:
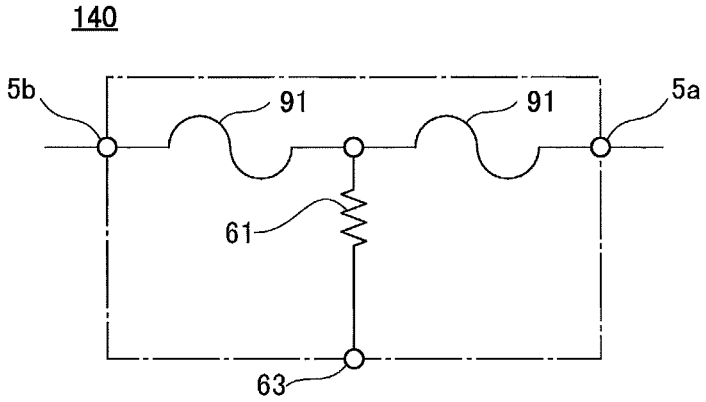

The fuse device 140 shown in FIG. 52 (A) has a circuit configuration as shown in FIG. 52 (B). That is, the fuse device 140 has a circuit configuration including the fuse element 91 connected in series with an external circuit via terminal portions 5*a*, 5*b*, and the heat generator 61 to generate heat with current flowing through the current path extending from the heat generator electrode 63 to the fuse element 91 to blow out the fuse element 91. In the fuse device 140, the terminal portions 5*a*, 5*b* of the fuse element 91 and the heat generator electrode 63 are connected to the external circuit board.

In the fuse device 140 having such a circuit configuration, when it becomes necessary to interrupt the current path of the external circuit, a current control device provided in the external circuit supplies current to the heat generator 61 for generating heat. Since the heat generated by the heat generator 61 is transmitted to the fuse element 91 through the insulating layer 62 and the heat generator lead-out electrode 64, and the low thermal conductivity portions 7 provided on the left and right are actively heated, the interrupting portion 9 is blown out. Because the fuse element 91 actively cools the heat from the heat generator 61 in the high thermal conductivity portion 8, it is also possible to suppress the effects of heating the terminal portions 5*a*, 5*b*. As a result, the fuse element 91 reliably blows out the path between the terminal portions 5*a*, 5*b*, and interrupts the current path of the external circuit. In addition, blowing out the fuse element 91 also interrupts the current path of the heat generator 61 so that the heat generation of the heat generator 61 also stops.

Heat Insulating Member

Figure 53:
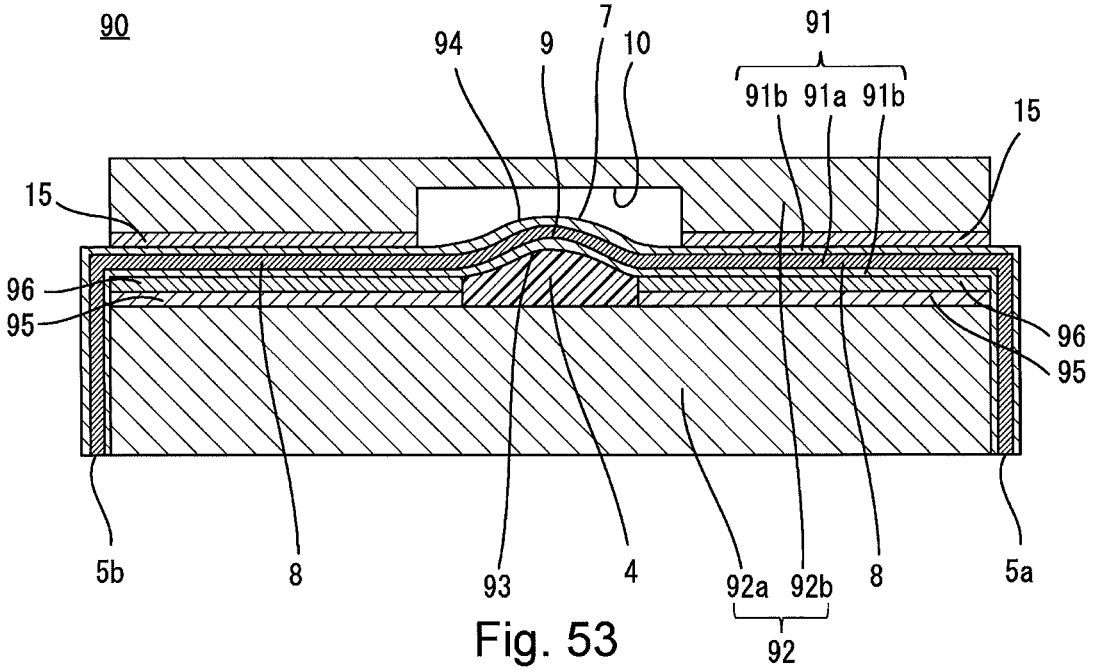
FIG. 53 is a cross-sectional view illustrating another embodiment of the fuse device according to the present disclosure.

Furthermore, the fuse device may include a heat insulating member 4 having a thermal conductivity lower than the cooling members 92*a*, 92*b*, such that the interrupting portion 9 of the fuse element 91 comes into contact with or comes close to the heat insulating member 4 to form the low thermal conductivity portion 7 having a thermal conductivity relatively lower than that of the high thermal conductivity portion 8. In the fuse device 90 shown in FIG. 53, the heat insulating member 4 is disposed at a position of the cooling member 92*a* corresponding to the concave 93 of the fuse element 91 and is disposed in contact with or close to the interrupting portion 9.

Cover Member

Furthermore, the fuse device may be constituted so that on one side of the fuse element 91 is overlapped with the cooling member 92*a* and the other side may be covered with the cover member 13. In the fuse device 150 shown in FIG. 54, the cooling member 92*a* is in contact with or close to the lower surface of the fuse element 91, and the upper surface thereof is covered with a cover member 13. The cooling member 92*a* is separated from the interrupting portion 9 of the fuse element 91 by the concave 93 and is in contact with or close to a portion other than the interrupting portion 9.

Figure 54:
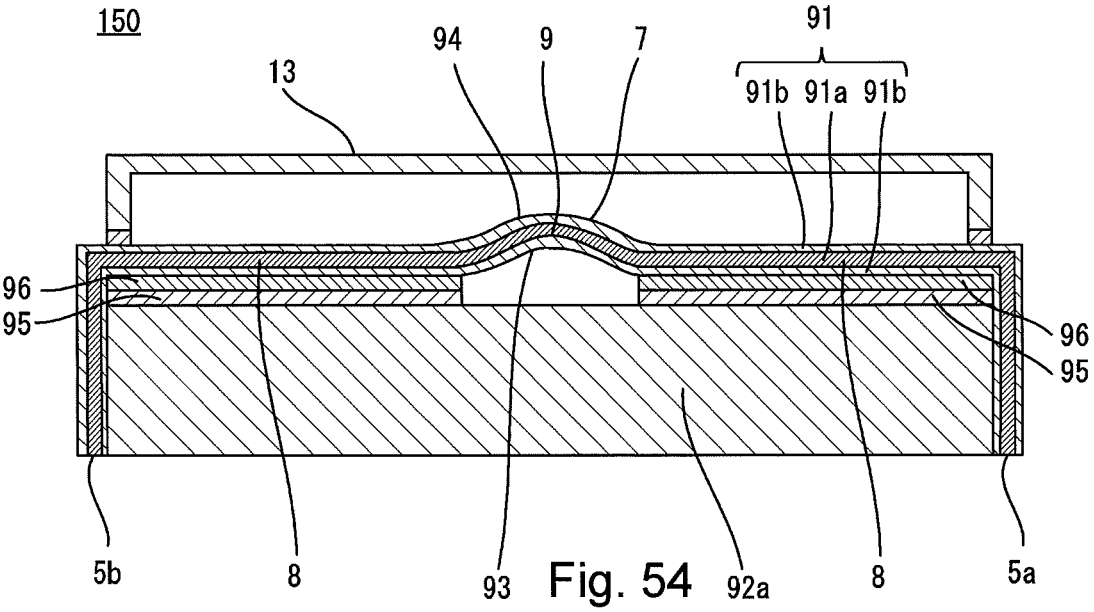
FIG. 54 is a cross-sectional view illustrating another embodiment of the fuse device according to the present disclosure.

Also in the fuse device 150 shown in FIG. 54, a difference in thermal conductivity is provided between the interrupting portion 9 and a portion other than the interrupting portion 9, the low thermal conductivity portion 7 is provided along the interrupting portion 9 in the plane of the fuse element 91, and the high thermal conductivity portion 8 is formed in a portion other than the interrupting portion 9. In this way, the fuse device actively dissipates the heat of the high thermal conductivity portion 8 to the outside when the fuse element 91 generates heat at an overcurrent exceeding the rating, thereby suppressing temperature increase in portions other than the interrupting portion 9 and concentrating heat on the low thermal conductivity portion 7 formed along the interrupting portion 9 to blow out the interrupting portion 9.

By leading out the terminal portions 5*a*, 5*b* of the fuse device 150 and disposing the cooling member 92*a* on the mounting surface mounted on the circuit board on which the external circuit is formed, the heat of the fuse element 91 can be transmitted to the circuit board, thereby achieving more efficient cooling.

In the fuse device 150, the cooling member 92*a* may be disposed on the opposite side of the mounting surface to the circuit board, and the cover member 13 may be disposed on the mounting surface from which the terminal portions 5*a*, 5*b* are led out. In this case, since the terminal portions 5*a*, 5*b* are in contact with the side surface of the cover member 13, the transmission of heat to the terminal portions 5*a*, 5*b* via the cooling member 92*a* is suppressed, thereby further reducing the risk of melting connection solder for surface mounting.

Concave

Figure 55:
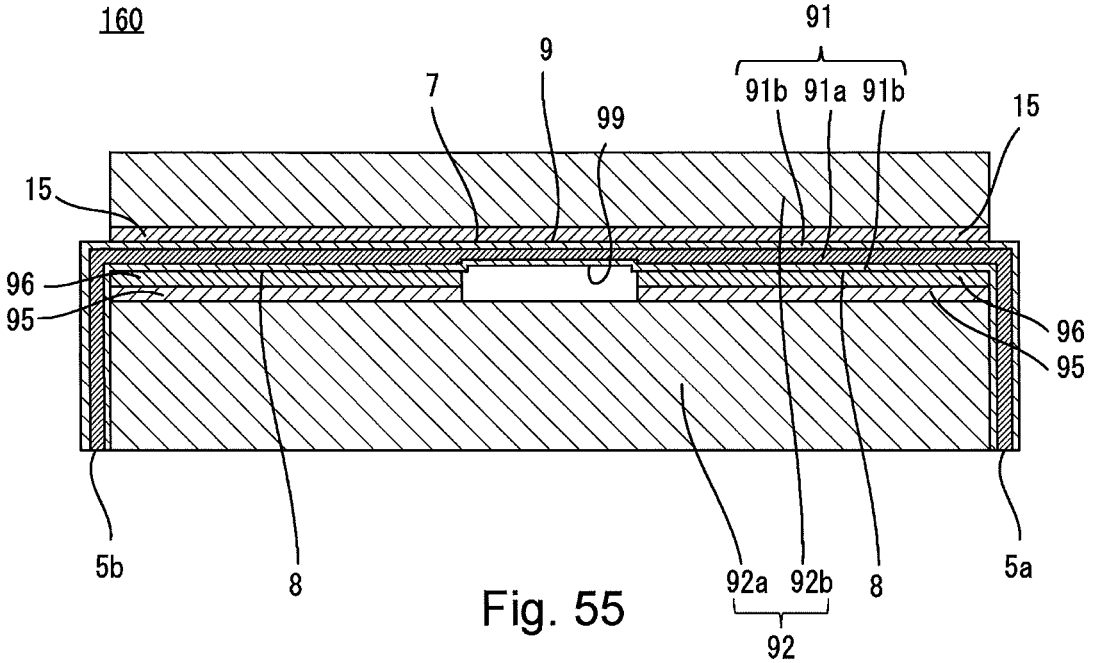
FIG. 55 is a cross-sectional view illustrating a fuse device using a fuse element having a concave on one side.
Figure 56:
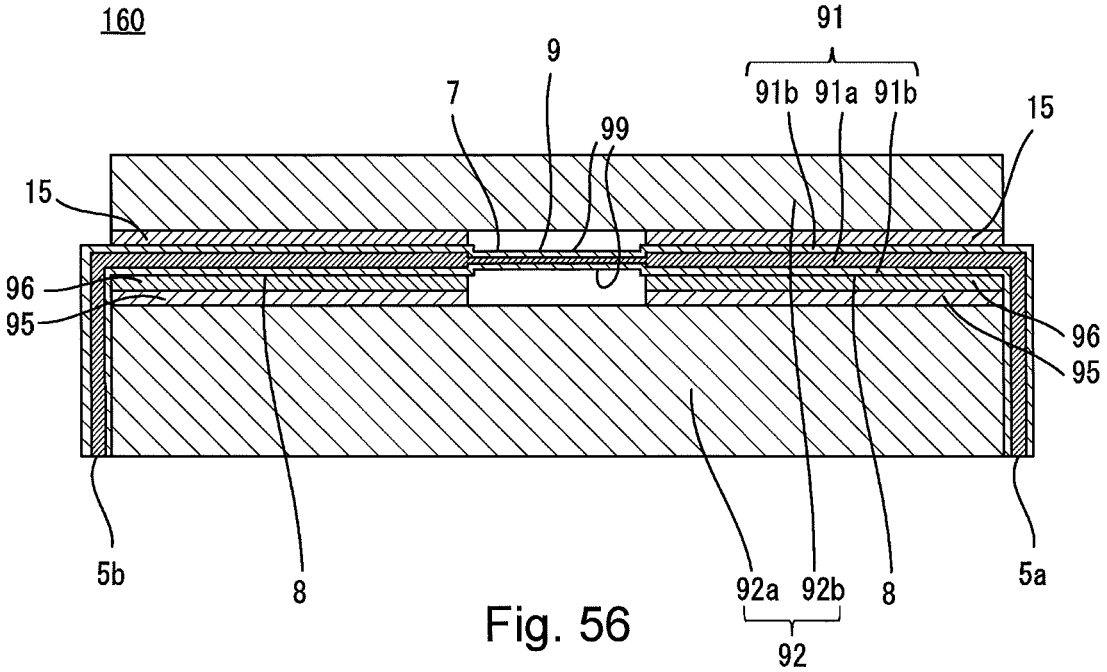
FIG. 56 is a cross-sectional view illustrating a fuse device using a fuse element having concaves on both surfaces.

Instead of forming the bridge-shaped concave 93, as shown in FIGS. 55 and 56, the fuse element 91 may be provided with a concave 99 in which the convex protruding from the portion other than the interrupting portion 9 is not formed on the opposite surface. The concave 99 can be formed, for example, by press working along the interrupting portion 9 of the fuse element 91, or by further providing metal layers on both sides of the interrupting portion 9, so that a concave recessing with respect to the other potions is formed along the interrupting portion 9.

In the fuse element 91 provided with the concave 99, the convex 94 protruding with respect to both sides of the interrupting portion 9 is not formed. Therefore, in the fuse device 160 using the fuse element 91 provided with the concave 99, both of the upper and lower cooling members 92*a*, 92*b* sandwiching the fuse element 91 can be planarized. Also, in the fuse device 160, a difference in thermal conductivity is provided between the interrupting portion 9 and a portion other than the interrupting portion 9, the low thermal conductivity portion 7 is provided along the interrupting portion 9 in the plane of the fuse element 91, and the high thermal conductivity portion 8 is formed in a portion other than the interrupting portion 9. In this way, the fuse device 160 actively dissipates the heat of the high thermal conductivity portion 8 to the outside when the fuse element 91 generates heat at an overcurrent exceeding the rating, thereby suppressing temperature increase in portions other than the interrupting portion 9 and concentrating heat on the low thermal conductivity portion 7 formed along the interrupting portion 9 to blow out the interrupting portion 9.

Figure 57:
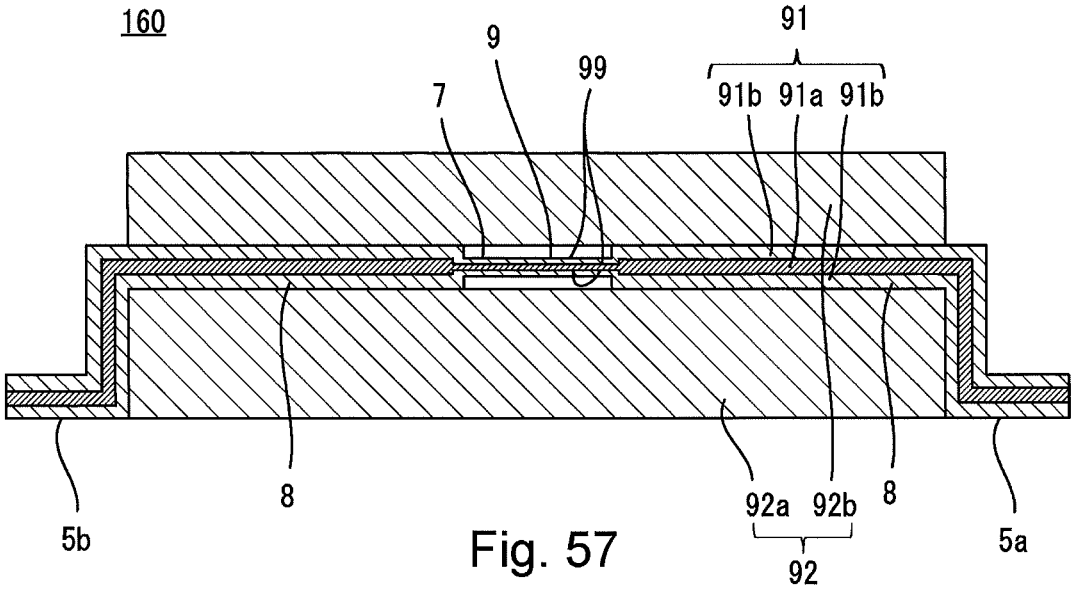
FIG. 57 is a cross-sectional view illustrating a fuse device in which a fuse element having a concave is directly sandwiched by a pair of cooling members without interposing a metal layer.

As shown in FIG. 57, in the fuse device 160, the fuse element 91 may be sandwiched directly by the cooling members 92*a*, 92*b* without providing the metal layer 95. In this case, the adhesive 15 can be interposed between the cooling members 92*a*, 92*b* and the fuse element 91 as appropriate.

The cooling member 92*b* may be provided with a groove 10 at a position corresponding to the interrupting portion 9. Furthermore, the fuse element 91 may be provided with a concave 99 on one side or may be provided with concaves 99 on both sides. In addition, the concaves 99 formed on both sides of the fuse element 91 may be formed at facing positions or may not face each other.

REFERENCE SIGNS LIST

1 fuse device, 2 fuse element, 2*a* low melting point metal layer, 2*b* high melting point metal layer, 3 cooling member,

5 terminal portion, 6 deformation restricting portion, 7 low thermal conductivity portion, 8 high thermal conductivity portion, 9 interrupting portion, 10 groove, 11 hole, 12 fitting recess, 13 cover member, 14 metal layer, 15 adhesive, 16 second high melting point metal layer, 17 first high melting point particle, 18 second high melting point particle, 19 flange portion, 20 fuse device, 21 supporting member, 30 fuse device, 40 fuse device, 41 fuse element, 42 terminal piece, 50 fuse device, 51 high melting point fuse element, 52 terminal portion, 60 fuse device, 61 heat generator, 62 insulating layer, 63 heat generator electrode, 64 heat generator lead-out electrode, 70 fuse device, 80 fuse device, 90 fuse device, 91 fuse element, 92 cooling member, 93 concave, 94 convex, 95 metal layer, 96 solder, 97 external connection electrode, 98*a* through hole, 98*b* castellation, 99 concave, 110 fuse device, 111 high melting point fuse element, 120 fuse device, 130 fuse device, 140 fuse device, 150 fuse device, 160 fuse device

The invention claimed is:

1. A fuse device comprising:

a fuse element; and a cooling member, wherein the fuse element includes a low thermal conductivity portion provided with a relatively low thermal conductivity in which an interrupting portion that is blown out by heat is separated from the cooling member, and a high thermal conductivity portion provided with a relatively high thermal conductivity, the high thermal conductivity portion being in contact with or close to the cooling member at a portion other than the interrupting portion, wherein the fuse element is a plate-shaped, and wherein the length of the low thermal conductivity portion in a current direction of the fuse element is equal to or less than a minimum width of the fuse element at the interrupting portion.

2. The fuse device according to claim 1, wherein the high thermal conductivity portion has an area larger than that of the low thermal conductivity portion.

3. The fuse device according to claim 1, further comprising a heat insulating member having a thermal conductivity lower than that of the cooling member, wherein the low thermal conductivity portion of the fuse element is formed by the interrupting portion in contact with or close to the heat insulating member.

4. The fuse device according to claim 1, wherein the low thermal conductivity portion of the fuse element is formed by the interrupting portion contacting air.

5. The fuse device according to claim 1, wherein the cooling member has a groove formed at a position corresponding to the interrupting portion, and the interrupting portion is overlapped on the groove.

6. The fuse device according to claim 5, wherein the fuse element is sandwiched by a pair of the cooling members, and both surfaces of the interrupting portion are overlapped with the groove.

7. The fuse device according to claim 1, wherein the fuse element is sandwiched by a pair of the cooling members, wherein one of the cooling members is provided with a groove at a position corresponding to the interrupting portion, the groove being disposed on the interrupting portion and the one of the cooling members being in contact with or close to a portion other than the interrupting portion, and wherein the other of the cooling members is in contact with or close to the interrupting portion and a portion other than the interrupting portion.

8. The device according to claim 5, wherein the cooling member is overlapped on one face of the fuse element.

9. The fuse device according to claim 5, wherein the groove is continuously formed across the width direction of the interrupting portion orthogonal to the current direction of the fuse element.

10. The fuse device according to claim 9, wherein the groove is formed over a part or the entirety of the interrupting portion in the width direction orthogonal to the current direction of the fuse element.

11. The fuse device according to claim 5, wherein a plurality of the grooves are intermittently formed in the width direction of the interrupting portion orthogonal to the current direction of the fuse element.

12. The fuse device according to claim 5, wherein the fuse element is plate-shaped, and wherein the groove has a length in the current direction of the fuse element equal to or less than the minimum width of the fuse element at the interrupting portion.

13. The fuse device according to claim 12, wherein the groove has a length in the current direction of the fuse element equal to or less than ½ of the minimum width of the fuse element at the interrupting portion.

14. The fuse device according to claim 5, wherein the groove has a length of 0.5 mm or more in the current direction of the fuse element.

15. The fuse device according to claim 5, wherein the groove has a length of 5 mm or less in the current direction of the fuse element.

16. The fuse device according to claim 1, wherein the minimum gap between the high thermal conductivity portion of the fuse element and the adjacent cooling member is 100 μm or less.

17. The fuse device according to claim 1, wherein a plurality of the fuse element are connected in parallel at a predetermined interval.

18. The fuse device according to claim 17, further comprising a high melting point fuse element having a melting temperature higher than that of the fuse element, wherein a plurality of the fuse element and the high melting point fuse element are connected in parallel at a predetermined interval.

19. The fuse device according to claim 1, wherein the fuse element extends to the outside of the cooling member and has a terminal portion for mounting.

20. The fuse device according to claim 18, wherein the high melting point fuse element extends to the outside of the cooling member and has a terminal portion for mounting.

21. The fuse device according to claim 1, wherein the cooling member is made of an insulating material.

22. The fuse device according to claim 21, wherein the cooling member is made of a ceramic.

23. The fuse device according to claim 21, wherein a metal layer is formed on a part or the whole of the surface of the cooling member contacting the fuse element.

24. The fuse device according to claim 1, wherein the cooling member is made of a metal material.

25. The fuse device according to claim 1, wherein the cooling member has a thermal conductivity of 1 W/(m*k) or more.

26. The fuse device according to claim 1, wherein the fuse element is connected to the cooling member with an adhesive.

27. The fuse device according to claim 26, wherein the adhesive is thermally conductive.

28. The fuse device according to claim 27, wherein the adhesive is electrically conductive.

29. The fuse device according to claim 23, wherein the fuse element is connected to the cooling member with a solder.

30. The fuse device according claim 1, wherein the fuse element has a laminate of a low melting point metal and a high melting point metal having a melting point higher than that of the low melting point metal, and the low melting point metal erodes and blows out the high melting point metal.

31. The fuse device according to claim 30, wherein, the fuse element comprises an inner layer as the low melting point metal and an outer layer as the high melting point metal.

32. The fuse device according to claim 31, wherein the fuse device is provided with a deformation restricting portion for suppressing the flow of the melted low melting point metal and restricting deformation.

33. The fuse device according to claim 1, further comprising:

one or a plurality of heat generators formed on the cooling member and disposed in the vicinity of the low thermal conductivity portion of the fuse element;

an insulating layer covering the heat generator; and one or a plurality of electrodes formed on a surface of the insulating layer, wherein the fuse element is connected to the electrode.

34. The fuse device according to claim 1, wherein the fuse element is provided with a concave by which the interrupting portion is separated from the cooling member, and wherein, in the cooling member, a surface facing the surface having the concave of the fuse element is formed flat.

35. The fuse device according to claim 34, wherein the fuse element is formed in a bridge shape in a direction in which a position corresponding to the interrupting portion is away from the cooling member.

36. The fuse device according to claim 34, wherein the high thermal conductivity portion has an area larger than that of the low thermal conductivity portion.

37. The fuse device according to claim 34, wherein the low thermal conductivity portion of the fuse element is formed by the interrupting portion contacting air.

38. The fuse device according to claim 1, wherein the fuse element is provided with a concave by which the interrupting portion is separated from the cooling member, and wherein the cooling member is provided with a groove formed at a position corresponding to the interrupting portion in a surface facing the surface having the concave of the fuse element, and the interrupting portion overlaps the groove.

39. The fuse device according to claim 35, wherein the fuse element is sandwiched by a pair of the cooling members, wherein one of the cooling members, which faces the surface of the fuse element having the concave, is formed flat, and is in contact with or close to portions other than the interrupting portion, and wherein the other of the cooling members, which faces the surface of the fuse element opposite to the surface having the concave, is provided with a groove at a position corresponding to a convex projecting to the opposite side of the concave of the fuse element and is in contact with or close to portions other than the interrupting portion.

40. The fuse device according to claim 34, wherein the fuse element is not provided with a convex on the surface opposite to the surface having the concave, and is sandwiched by a pair of the cooling members, and wherein both surfaces of the pair of cooling members facing the fuse element are formed flat.

41. The fuse device according to claim 34, wherein the fuse element is plate-shaped, and wherein the concave has a length in the current direction of the fuse element equal to or less than the minimum width of the fuse element at the interrupting portion.

42. The fuse device according to claim 34, wherein the minimum gap between the high thermal conductivity portion of the fuse element and the adjacent cooling member is 100 μm or less.

43. The fuse device according to claim 34, wherein a plurality of the fuse element are connected in parallel at a predetermined interval.

44. The fuse device according to claim 34, wherein the fuse element extends to the outside of the cooling member and has a terminal portion for mounting.

45. The fuse device according to claim 34, wherein the cooling member is made of an insulating material.

46. The fuse device according to claim 45, wherein the cooling member is made of a ceramic.

47. The fuse device according to claim 45, wherein the cooling member is made of a resin material.

48. The fuse device according to claim 45, wherein a metal layer is formed on a part or the whole of the surface of the cooling member contacting the fuse element.

49. The fuse device according to claim 34, wherein the cooling member is made of a metal material.

50. The fuse device according to claim 34, wherein the fuse element is connected to the cooling member with an adhesive.

51. The fuse device according to claim 48, wherein the fuse element is connected to the cooling member with a solder.

52. The fuse device according to claim 34, wherein the fuse element has a laminate of a low melting point metal and a high melting point metal having a melting point higher than that of the low melting point metal, and the low melting point metal erodes and blows out the high melting point metal.

53. The fuse device according to claim 52, wherein, the fuse element comprises an inner layer as the low melting point metal and an outer layer as the high melting point metal.

54. The fuse device according to claim 53, wherein the fuse device is provided with a deformation restricting portion for suppressing the flow of the melted low melting point metal and restricting deformation.

55. The fuse device according to claim 34, further comprising:

one or a plurality of heat generators formed in the cooling member and disposed in the vicinity of the low thermal conductivity portion of the fuse element;

an insulating layer covering the heat generator; and one or a plurality of electrodes formed on a surface of the insulating layer, wherein the fuse element is connected to the electrode.

* * * * *